US008698848B2

(12) United States Patent
Yamamoto et al.

(10) Patent No.: US 8,698,848 B2
(45) Date of Patent: Apr. 15, 2014

(54) DISPLAY APPARATUS, LIGHT DETECTION METHOD AND ELECTRONIC APPARATUS

(75) Inventors: Tetsuro Yamamoto, Kanagawa (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 622 days.

(21) Appl. No.: 12/662,119

(22) Filed: Mar. 31, 2010

(65) Prior Publication Data

US 2010/0289829 A1 Nov. 18, 2010

(30) Foreign Application Priority Data

May 12, 2009 (JP) ..... 2009-115192
Jan. 7, 2010 (JP) ..... 2010-001879

(51) Int. Cl.
*G09G 5/10* (2006.01)
*G09G 3/30* (2006.01)

(52) U.S. Cl.
USPC ..... 345/690; 345/76

(58) Field of Classification Search
USPC ..... 345/76, 207, 78, 690; 315/169.3
See application file for complete search history.

(56) References Cited

U.S. PATENT DOCUMENTS 6,720,942 B2 * 4/2004 Lee et al. ..... 345/82
2009/0128534 A1 5/2009 Fish et al.
2009/0243498 A1 10/2009 Childs et al.

FOREIGN PATENT DOCUMENTS

JP 2007-501953 2/2007
JP 2008-518263 5/2008

* cited by examiner

*Primary Examiner* — Alexander S Beck
*Assistant Examiner* — Ibrahim Khan
(74) *Attorney, Agent, or Firm* — Rader, Fishman & Grauer PLLC

(57) ABSTRACT

Disclosed herein is a display apparatus, including a plurality of pixel circuits disposed in a matrix at positions at which a plurality of signal lines and a plurality of scanning lines cross each other and individually including a light emitting element, a light emission driving section adapted to apply a signal value to each of the pixel circuits to cause the pixel circuit to emit light of a luminance corresponding to the signal value, and a light detection section including a light detection element which functions as a switching element by switching the light detection element between an on state and an off state and functions as a light sensor for detecting light from the light emitting element in the off state, the light detection section further including a detection signal outputting circuit formed in the light detection section for outputting light detection information from the light detection element.

20 Claims, 37 Drawing Sheets

DISPLAY APPARATUS, LIGHT DETECTION METHOD AND ELECTRONIC APPARATUS

BACKGROUND OF THE INVENTION

1. Field of the Invention

The present invention relates to a display apparatus and an electronic apparatus wherein a self-luminous device such as, for example, an organic electroluminescence device (organic EL device) is used in a pixel circuit and a light detection method for a light detection section provided in the pixel circuit.

2. Description of the Related Art

In a display apparatus of the active matrix type wherein an organic electroluminescence (EL: Electroluminescence) light emitting element is used as a pixel, current flowing to a light emitting element in each pixel circuit is controlled by an active device, generally a thin film transistor (TFT) provided in each pixel circuit. Since an organic EL device is a current light emitting element, a gradation of color development is obtained by controlling the amount of current flowing to the EL device.

In particular, in a pixel circuit which includes an organic EL device, current corresponding to an applied signal value voltage is supplied to the organic EL device to carry out light emission of a gradation in accordance with the signal value.

In a display apparatus which uses a self-luminous device such as a display apparatus which uses such an organic EL device as described above, it is important to cancel the dispersion in light emission luminance among pixels to eliminate non-uniformity which appears on a screen.

While the dispersion in light emission luminance among pixels appears also in an initial state upon panel fabrication, the dispersion is caused by time-dependent variation.

A light emission efficiency of an organic EL device is degraded by passage of time. In particular, even if the same current flows, the emitted light luminance degrades together with passage of time.

As a result, a screen burn that, if a white WINDOW pattern is displayed on the black background and then the white is displayed on the full screen as shown, for example, in FIG. 37A, then the luminance at the portion at which the WINDOW pattern is displayed decreases.

A countermeasure against such a situation as described above is disclosed in JP-T-2007-501953 or JP-T-2008-518263 (referred to as Patent Documents 1 and 2, respectively, hereinafter). In particular, Patent Document 1 discloses an apparatus wherein a light sensor is disposed in each pixel circuit and a detection value of the light sensor is fed back to the system to correct the emitted light luminance. Patent Document 2 discloses an apparatus wherein a detection value is fed back from a light sensor to a system to carry out correction of the emitted light luminance.

SUMMARY OF THE INVENTION

The present invention is directed to a display apparatus wherein a light detection section for detecting light from a light emitting element of a pixel circuit is provided for the pixel circuit. The display apparatus is implemented wherein a signal value is corrected in accordance with light amount information detected by the light detection section to prevent such a screen burn as described above. The present invention further provides a light detection section which can carry out detection with a high degree of accuracy and can be configured from a small number of elements and a small number of control lines.

According to an embodiment of the present invention, there is provided a display apparatus including:

a plurality of pixel circuits disposed in a matrix at positions at which a plurality of signal lines and a plurality of scanning lines cross each other and individually including a light emitting element;

a light emission driving section adapted to apply a signal value to each of the pixel circuits to cause the pixel circuit to emit light of a luminance corresponding to the signal value; and a light detection section including a light detection element which functions as a switching element by switching the light detection element between an on state and an off state and functions as a light sensor for detecting light from the light emitting element of the pixel circuit in the off state, the light detection section further including a detection signal outputting circuit formed in the light detection section for outputting light detection information from the light detection element.

According to another embodiment of the present invention, there is provided a light detection method for a display apparatus which includes a pixel circuit having a light emitting element and a light detection section for detecting light from the light emitting element of the pixel circuit and outputting light detection information, including a step of outputting light detection information corresponding to a variation amount of current flowing to a sensor-switch serving element, which functions as a switching element by switching between an on state and an off state, functions as a light sensor for detecting light from the light emitting element of the pixel circuit in the off state thereof, and is provided in the light detection section, while the sensor-switch serving element is in an off state.

According to a further embodiment of the present invention, there is provided an electronic apparatus including a plurality of pixel circuits disposed in a matrix at positions at which a plurality of signal lines and a plurality of scanning lines cross each other and individually including a light emitting element, a light emission driving section adapted to apply a signal value to each of the pixel circuits to cause the pixel circuit to emit light of a luminance corresponding to the signal value, and a light detection section including a sensor-switch serving element which functions as a switching element by switching thereof between an on state and an off state and functions as a light sensor for detecting light in the off state thereof, the light detection section further including a detection signal outputting circuit formed therein for outputting light detection information from the sensor-switch serving element.

According to a further embodiment of the present invention, there is provided a display apparatus, including: a pixel circuit including a light emitting element; and a light detection section including a light detecting transistor, a detection signal outputting transistor and a power supply line. The light detecting transistor is connected between the power supply line and the gate of the detection signal outputting transistor. The detection signal outputting transistor varies current to flow between the drain and the source in accordance with a potential to the gate. A first potential is supplied to the power supply line and also to the gate of the detection signal outputting transistor but through the light detecting transistor. A second potential is supplied, within a detection period within which the light detecting transistor is placed in a second state, to the power supply line while a gate potential of the detection signal outputting transistor varies toward the second potential in response to light of the light emitting element.

According to a further embodiment of the present invention, there is provided a display apparatus, including: a pixel circuit including a light emitting element; and a light detection section including a light detecting transistor, a detection signal outputting transistor, a power supply line and a capacitance element. The light detecting transistor is connected between the power supply line and the gate of the detection signal outputting transistor. The detection signal outputting transistor varies current to flow between the drain and the source in accordance with a potential to the gate. The capacitance element is connected between the gate of the light detecting transistor and the gate of the detection signal outputting transistor. A predetermined potential is supplied to the power supply line. The predetermined potential is supplied to the gate of the detection signal outputting transistor through the light detecting transistor within a detection preparation period within which the light detecting transistor is placed in a first state. A gate potential of the detection signal outputting transistor is varied by changeover of the light detecting transistor from the first state to a second state. The gate potential of the detection signal outputting transistor is varied toward the predetermined potential in response to light of the light emitting element within a detection period within which the light detecting transistor is placed in the second state.

In the display apparatus, light detection method and electronic apparatus, a sensor-switch serving element which functions as a switching element by switching thereof between an on state and an off state and further functions as a light sensor for detecting light from a light emitting element when the sensor-switching serving element is in the off state is used as a light detection element of the light detection section. Consequently, a preparation operation and a detection operation for predetermined detection of the detection signal outputting circuit in the light detection section can be implemented by the single element.

With the display apparatus, light detection method and electronic apparatus, the configuration of the detection signal outputting circuit can be simplified by using a sensor-switch serving element as the light detection element such that the sensor-switch serving element is used as the switching device when it is in an on state but is used as the light detection element when it is in an off state. For example, the number of transistors which compose the detection signal outputting circuit can be decreased. As a result, enhancement of the yield can be implemented, and a detection operation with a high degree of accuracy can be implemented. Further, by carrying out signal correction and so forth using a result of the light detection, a countermeasure against a drawback in picture quality caused by efficiency degradation of the light emitting element such as a screen burn can be implemented.

The above and other objects, features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENTS

In the following, embodiments of the present invention are described in the following order.

<1. Configuration of the Display Apparatus>

<2. Taken into Consideration in the Course to the Present Invention>

<3. First Embodiment>

[3-1. Circuit Configuration]

[3-2. Light Detection Operation Period]

[3-3. Light Detection Operation]

[3-4. Modification to the First Embodiment]

<4. Second Embodiment>

[4-1. Circuit Configuration]

[4-2. Light Detection Operation]

[4-3. Modifications to the Second Embodiment]

<5. Applications>

1. Configuration of the Display Apparatus

Figure 1:
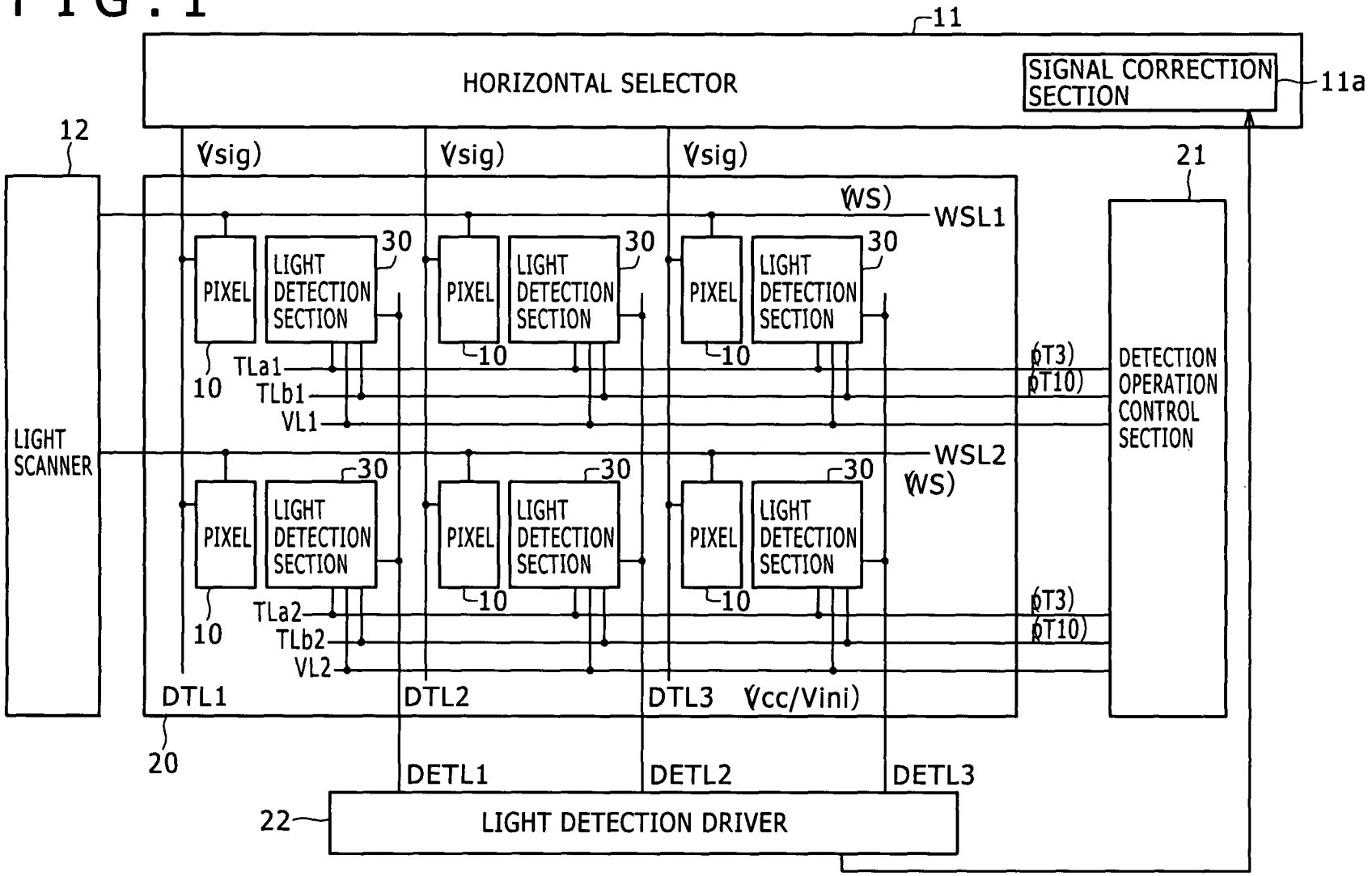
FIG. 1 is a block diagram showing a display apparatus according to an embodiment of the present invention.

A configuration of an organic EL display apparatus according to an embodiment of the present invention is shown in FIG. 1.

The organic EL display apparatus includes a plurality of pixel circuits 10 each including an organic EL device as a light emitting element for carrying out light emission driving in accordance with an active matrix method. The organic EL display apparatus is incorporated as a display device in various electronic apparatus. In particular, the organic EL display apparatus is incorporated in various electronic apparatus such as, for example, a television receiver, a monitor apparatus, a recording and reproduction apparatus, a communication apparatus, a computer apparatus, an audio apparatus, a video apparatus, a game machine and a home electronics apparatus.

Referring to FIG. 1, the organic EL display apparatus includes a pixel array 20 wherein a great number of pixel circuits 10 are arranged in a matrix in a row direction and a column direction, that is, in m rows×n columns. It is to be noted that each of the pixel circuits 10 functions as one of light emitting pixels of R (red), G (green) and B (blue), and a color display apparatus is configured by arranging the pixel circuits 10 of the individual colors in accordance with a predetermined rule.

As components for driving the pixel circuits 10 to emit light, a horizontal selector 11 and a write scanner 12 are provided.

Signal lines DTL, particularly DTL1, DTL2, . . . , which are selected by the horizontal selector 11 for supplying a voltage in accordance with a signal value, that is, a gradation value, of a luminance signal as display data to the pixel circuits 10 are arranged in the column direction on the pixel array 20. The number of signal lines DTL1, DTL2, . . . is equal to the number of columns of the pixel circuits 10 disposed in a matrix in the pixel array 20.

Further, on the pixel array 20, writing control lines WSL, that is, WSL1, WSL2, . . . , are arranged in the row direction. The number of writing control lines WSL is equal to the number of the pixel circuits 10 disposed in a matrix in the row direction on the pixel array 20.

The writing control lines WSL, that is, WSL1, WSL2, . . . , are driven by the write scanner 12. The write scanner 12 successively supplies a scanning pulse WS to the writing control lines WSL1, WSL2, . . . disposed in rows to line-sequentially scan the pixel circuits 10 in a unit of a row.

The horizontal selector 11 supplies a signal value potential Vsig as an input signal to the pixel circuits 10 to the signal lines DTL1, DTL2, . . . disposed in the column direction in a timed relationship with the line-sequential scanning by the write scanner 12.

A light detection section 30 is provided corresponding to each of the pixel circuits 10. The light detection section 30 includes an element, which is a sensor serving transistor T10 hereinafter described, in the inside thereof which functions as a light sensor, and a detection signal outputting circuit including the element. The light detection section 30 outputs detection information of an emitted light amount of the light emitting element of the corresponding pixel circuit 10.

Further, a detection operation control section 21 for controlling operation of the light detection section 30 is provided. Control lines TLa, that is, TLa1, TLa2, . . . , and control lines TLb, that is, TLb1, TLb2, . . . , extend from the detection operation control section 21 to the light detection sections 30.

While a configuration of the detection signal outputting circuit of the light detection section 30 is hereinafter described, the control lines TLa function to supply a control pulse pT3 for on/off control of a switching transistor T3 in the light detection sections 30 to the switching transistor T3. Meanwhile, the control lines TLb function to supply a control pulse pT10 for on/off control of the sensor serving transistor T10 in the light detection sections 30 to the sensor serving transistor T10.

Further, power supply lines VL, that is, VL1, VL2, . . . , for supplying an operation power supply voltage for the light detection section 30 are arranged for the light detection sections 30. The detection operation control section 21 applies a pulse voltage formed from an operation power supply voltage Vcc and a reference potential Vini to the power supply lines VL, that is, VL1, VL2, . . . .

Further, light detection lines DETL, that is, DETL1, DETL2, . . . , are disposed, for example, in a column direction for the light detection section 30. The light detection lines DETL are used as lines for outputting a voltage as detection information by the light detection sections 30.

The light detection lines DETL, that is, DETL1, DETL2, . . . , are connected to a light detection driver 22. The light detection driver 22 carries out voltage detection regarding the light detection lines DETL to detect light amount detection information by the light detection sections 30.

The light detection driver 22 applies light amount detection information regarding the pixel circuits 10 by the light detection sections 30 to a signal value correction section 11*a* in the horizontal selector 11.

The signal value correction section 11*a* decides a degree of degradation of the light emission efficiency of the organic EL device in the pixel circuits 10 based on the light amount detection information and carries out a correction process of the signal value Vsig to be applied to the pixel circuits 10 in accordance with a result of the decision.

The light emission efficiency of an organic EL device degrades as time passes. In particular, even if the same current is supplied, the light emission luminance decreases as time passes. Therefore, in the display apparatus according to the present embodiment, the emitted light amount of each pixel circuit 10 is detected and degradation of the light emission luminance is decided based on a result of the detection. Then, the signal value Vsig itself is corrected in response to the degree of degradation. For example, where the signal value Vsig as a certain voltage value V1 is to be applied, correction is carried out such that a correction value $\alpha$ determined based on the degree of degradation of the light emission luminance is set and the signal value Vsig as the voltage value V1+$\alpha$ is applied.

The degradation of the light emission luminance of each pixel circuit 10 detected in such a manner as just described is compensated for by feeding back the same to the signal value Vsig to decrease a screen burn.

Figure 37A:
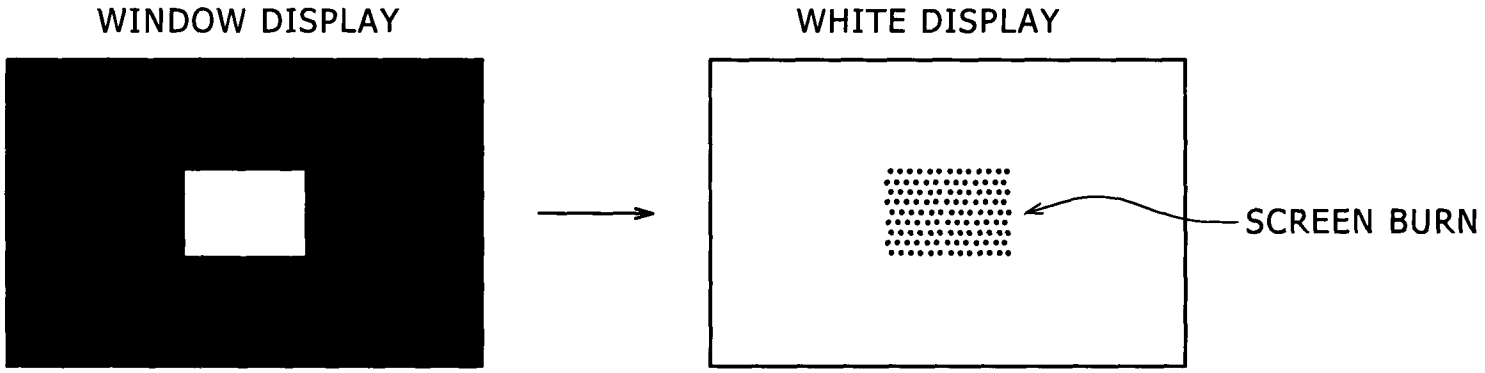
FIGS. 37A and 37B are schematic views illustrating correction against a screen burn.
Figure 37B:
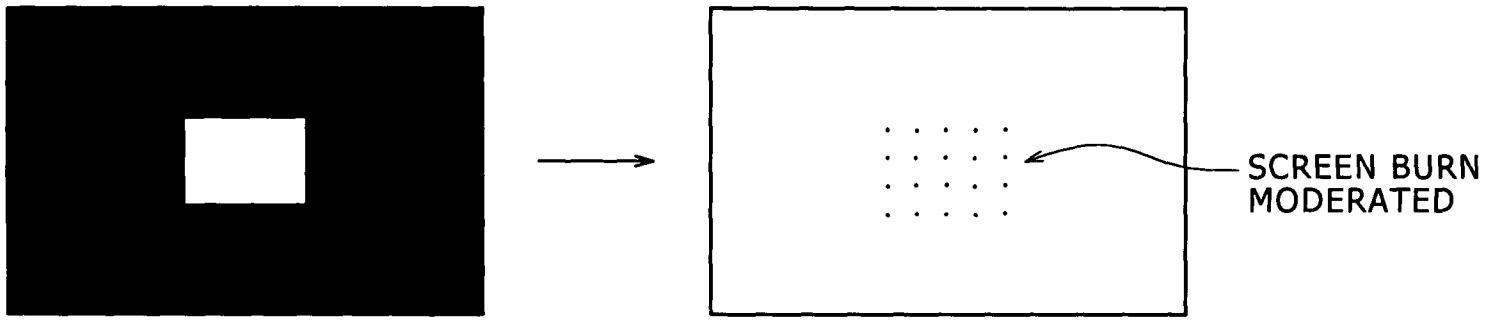

In particular, for example, in a situation wherein a screen burn occurs as seen in FIG. 37A, the screen burn is decreased as seen in FIG. 37B.

Figure 10:
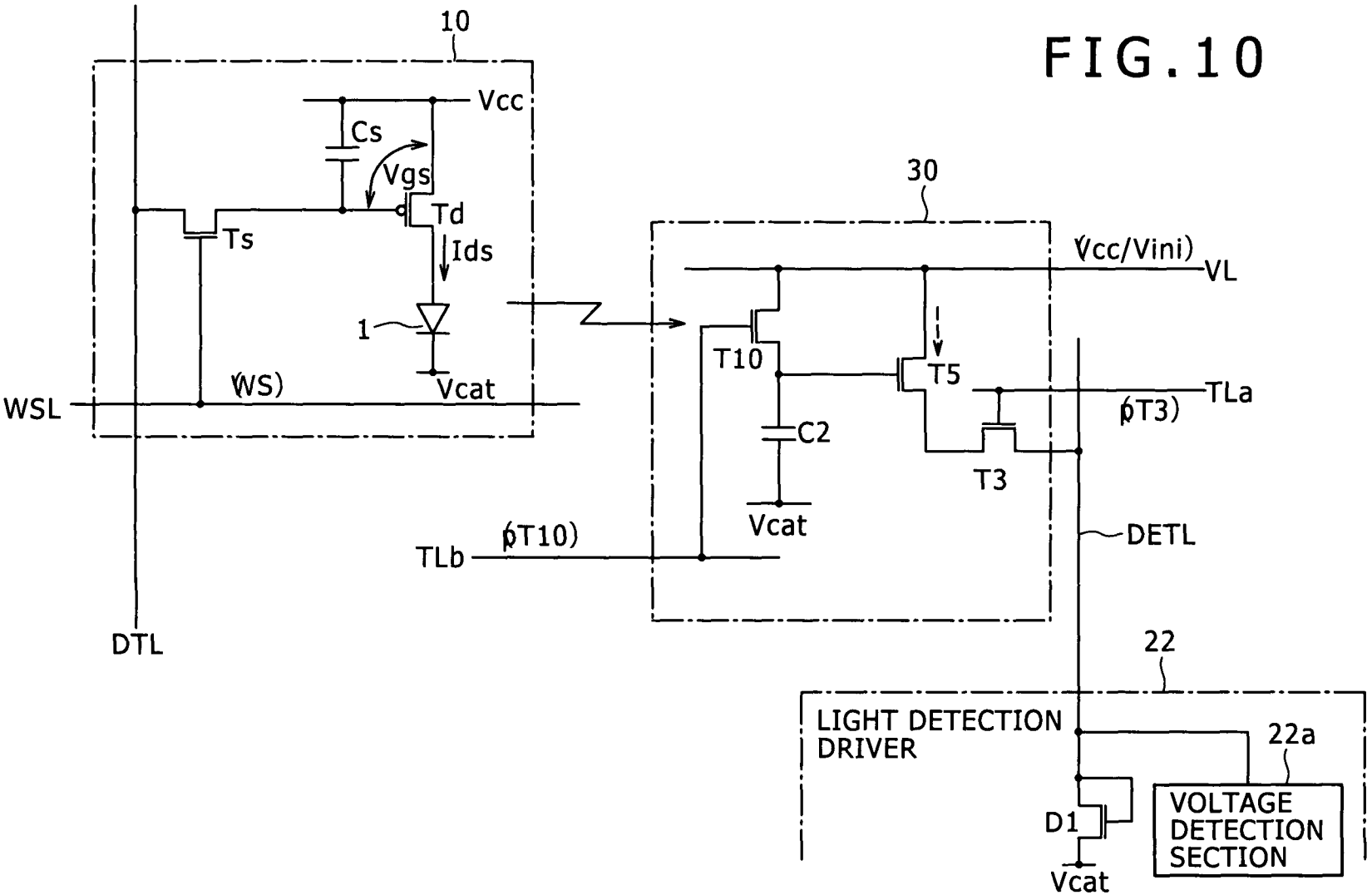
FIG. 10 is a circuit diagram showing a pixel circuit and a light detection section according to a first embodiment of the present invention.

It is to be noted that, though not shown in FIG. 1, potential lines for supply a cathode potential Vcat as a required fixed potential are connected to the pixel circuits 10 and the light detection sections 30 (shown in FIG. 10).

Further, FIG. 1 shows a configuration of the display apparatus according to a first embodiment of the present invention, and a display apparatus according to a second embodiment of the present invention is hereinafter described with reference to FIG. 20.

Incidentally, while a single light detection section 30 is provided for each of the pixel circuits 10, there is no necessity to provide one light detection section 30 for each pixel circuit 10.

Figure 2:
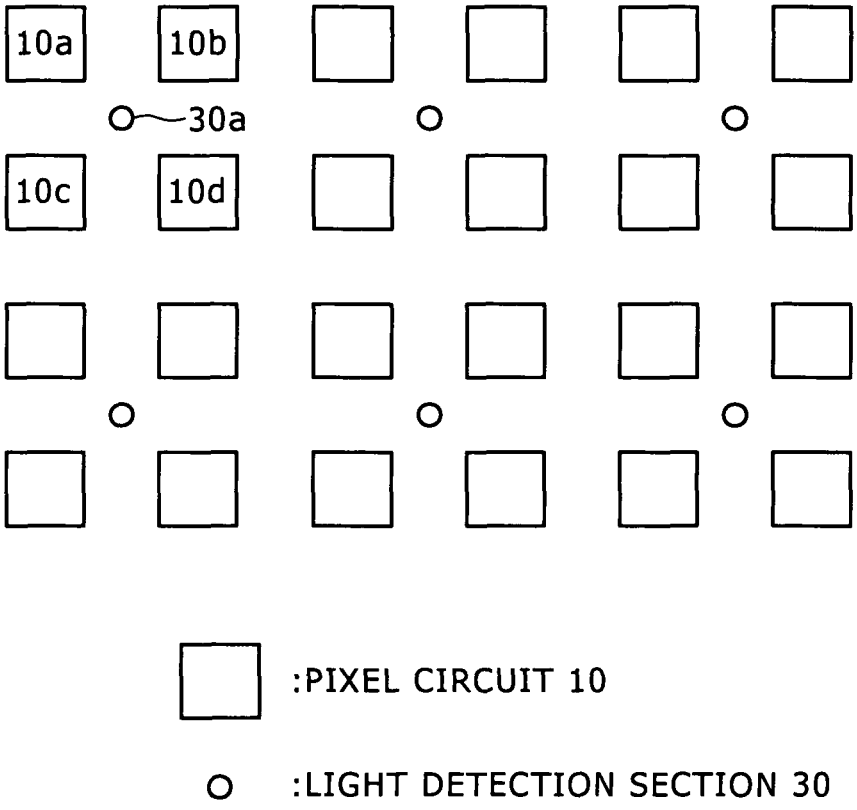
FIG. 2 is a diagrammatic view showing an example of disposition of a light detection section in the display apparatus of FIG. 1.

In other words, another configuration may be applied wherein one light detection section 30 carries out light detection for a plurality of pixel circuits 10, for example, like a configuration shown in FIG. 2 wherein one light detection section 30 is disposed for four pixel circuits 10. For example, such a technique may be taken that, where light detection regarding four pixel circuits 10*a*, 10*b*, 10*c* and 10*d* shown in FIG. 2 is carried out while the pixel circuits 10*a*, 10*b*, 10*c* and 10*d* are successively driven to emit light in order, light detection is carried out successively by a light detection section 30*a* disposed at a central position among the pixel circuits 10*a*, 10*b*, 10*c* and 10*d*. Or another technique may be taken that, while a plurality of pixel circuits 10 are driven to emit light at the same time, the light amount is detected in a unit of a pixel block including, for example, the pixel circuits 10*a*, 10*b*, 10*c* and 10*d*.

2. Configuration Taken into Consideration in the Course to the Present Invention Here, before the circuit configuration and operation of the embodiment of the present invention are described, the light detection section which has been taken into consideration in the course to the present invention is described to facilitate understandings of the present embodiment.

Figure 3:
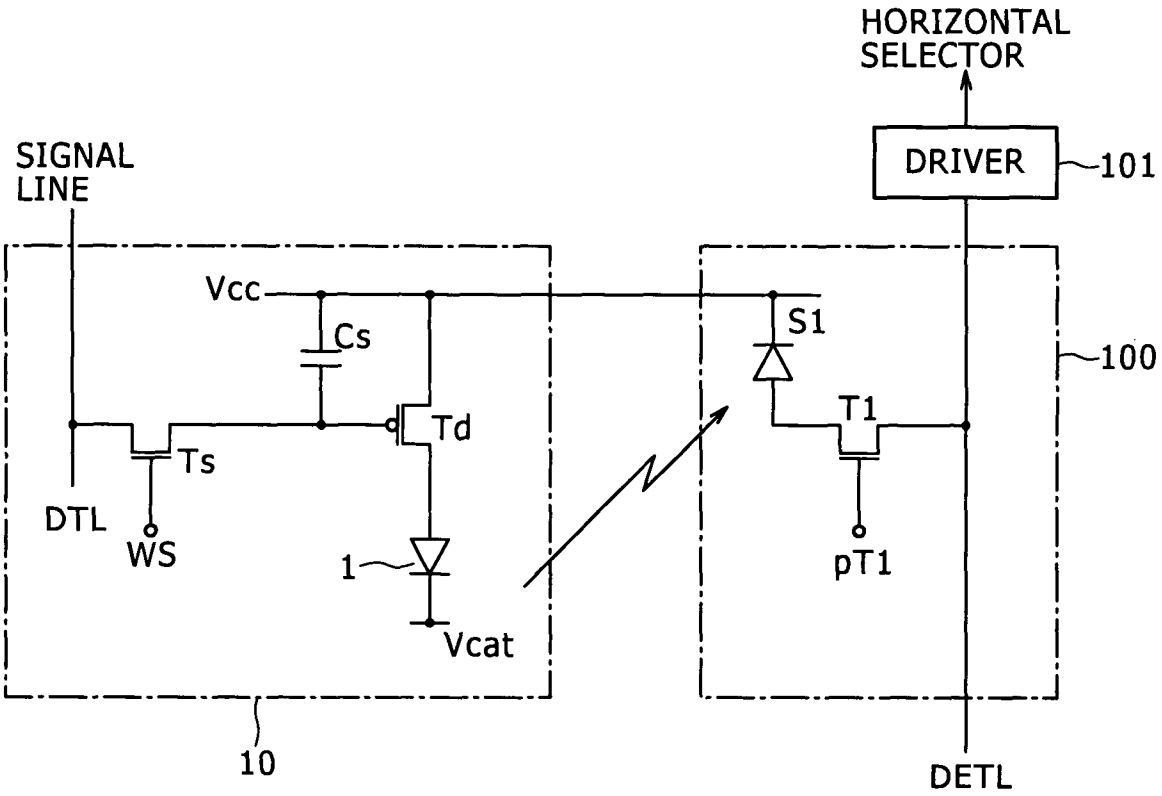
FIG. 3 is a circuit diagram showing a configuration which has been taken into consideration in the course to the present invention.

FIG. 3 shows a pixel circuit 10 and a light detection section 100 contrived for reduction of a screen burn.

Referring to FIG. 3, the pixel circuit 10 includes a driving transistor Td, a sampling transistor Ts, a holding capacitor Cs and an organic EL element 1. The pixel circuit 10 having the configuration is hereinafter described more particularly.

In order to compensate for a drop of the light emission efficiency of the organic EL element 1 of the pixel circuit 10, the light detection section 100 is provided which includes a light detection element or light sensor S1 and a switching transistor T1 interposed between a power supply voltage Vcc and a fixed light detection line DETL.

In this instance, the light sensor S1, for example, in the form of a photodiode supplies leak current corresponding to the amount of emitted light from the organic EL element 1.

Generally, when a diode detects light, current thereof increases. Further, the increasing amount of current varies depending upon the amount of light incident to the diode. In particular, if the light amount is great, then the increasing amount of current is great, and if the light amount is small, then the increasing amount of current is small.

The current flowing through the light sensor S1 flows to the light detection line DETL if the switching transistor T1 is rendered conducting.

An external driver 101 connected to the light detection line DETL detects the amount of current supplied from the light sensor S1 to the light detection line DETL.

The current value detected by the external driver 101 is converted into a detection information signal and supplied to a horizontal selector 11. The horizontal selector 11 decides from the detection information signal whether or not the detection current value corresponds to the signal value Vsig provided to the pixel circuit 10. If the luminance of the emitted light of the organic EL element 1 indicates a degraded level, then the detection current amount indicates a reduced level. In this instance, the signal value Vsig is corrected.

Figure 4:
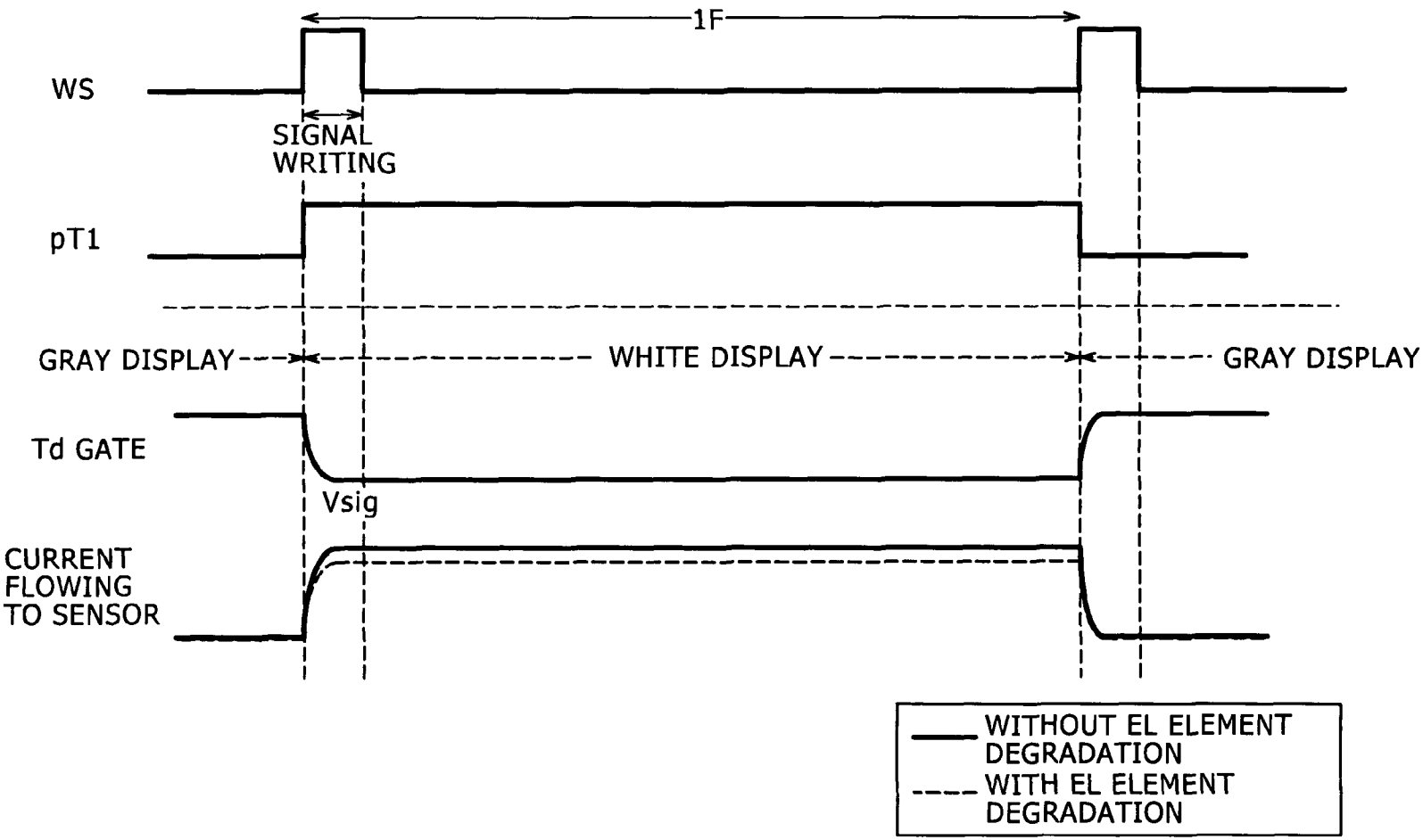
FIG. 4 is a waveform diagram illustrating operation of the circuit of FIG. 3.

A light detection operation waveform is illustrated in FIG. 4. Here, the period within which the light detection section 100 outputs detection current to the external driver 101 is determined as one frame.

Within a signal writing period illustrated in FIG. 4, the sampling transistor Ts in the pixel circuit 10 exhibits an on state with a scanning pulse WS, and the signal value Vsig applied to a signal line DTL from the horizontal selector 11 is inputted to the pixel circuit 10. The signal value Vsig is inputted to the gate of the driving transistor Td and is retained into the holding capacitor Cs. Therefore, the driving transistor Td supplies current corresponding to the gate-source voltage thereof to the organic EL element 1 so that the organic EL element 1 emits light. For example, if the signal value Vsig is supplied for a white display within a current frame, then the organic EL element 1 emits light of the white level within the current frame.

Within the frame within which light of the white level is emitted, the switching transistor T1 in the light detection section 100 is rendered conducting with a control pulse pT1. Therefore, the variation of current of the light sensor S1 which receives the light of the organic EL element 1 is reflected on the light detection line DETL.

For example, if the amount of current flowing through the light sensor S1 thereupon is equal to the amount of light which should originally be emitted and is such as indicated by a solid line in FIG. 4, then if the emitted light amount is reduced by deterioration of the organic EL element 1, then it is such as indicated by a broken line in FIG. 4.

Since a variation of current corresponding to degradation of the luminance of emitted light appears on the light detection line DETL, the external driver 101 can detect the current amount and obtain information of the degree of degradation. Then, the information is fed back to the horizontal selector 11 to correct the signal value Vsig to carry out compensation for the luminance degradation. Accordingly, a screen burn can be decreased.

However, such a light detection system as described above gives rise to the following disadvantage.

In particular, the light sensor S1 receives emitted light of the organic EL element 1 and increases the current thereof. For a diode as the light sensor S1, preferably an off region thereof in which a great current variation is exhibited, that is, an applied voltage of a negative value proximate to zero, is used. This is because the current variation can be detected comparatively precisely.

However, even if the current value at this time indicates an increase, since it is very low with respect to the on current, if it is intended to detect the luminance variation with a high degree of accuracy, then a long period of time may be required for charging the parasitic capacitance of the light detection line DETL. For example, it is difficult to detect a current variation with a high degree of accuracy in one frame.

As a countermeasure, it is a possible idea to increase the size of the light sensor S1 to increase the amount of current. However, as the size increases, the ratio of the area which the light detection section 100 occupies in a pixel array 20 increases.

Figure 5:
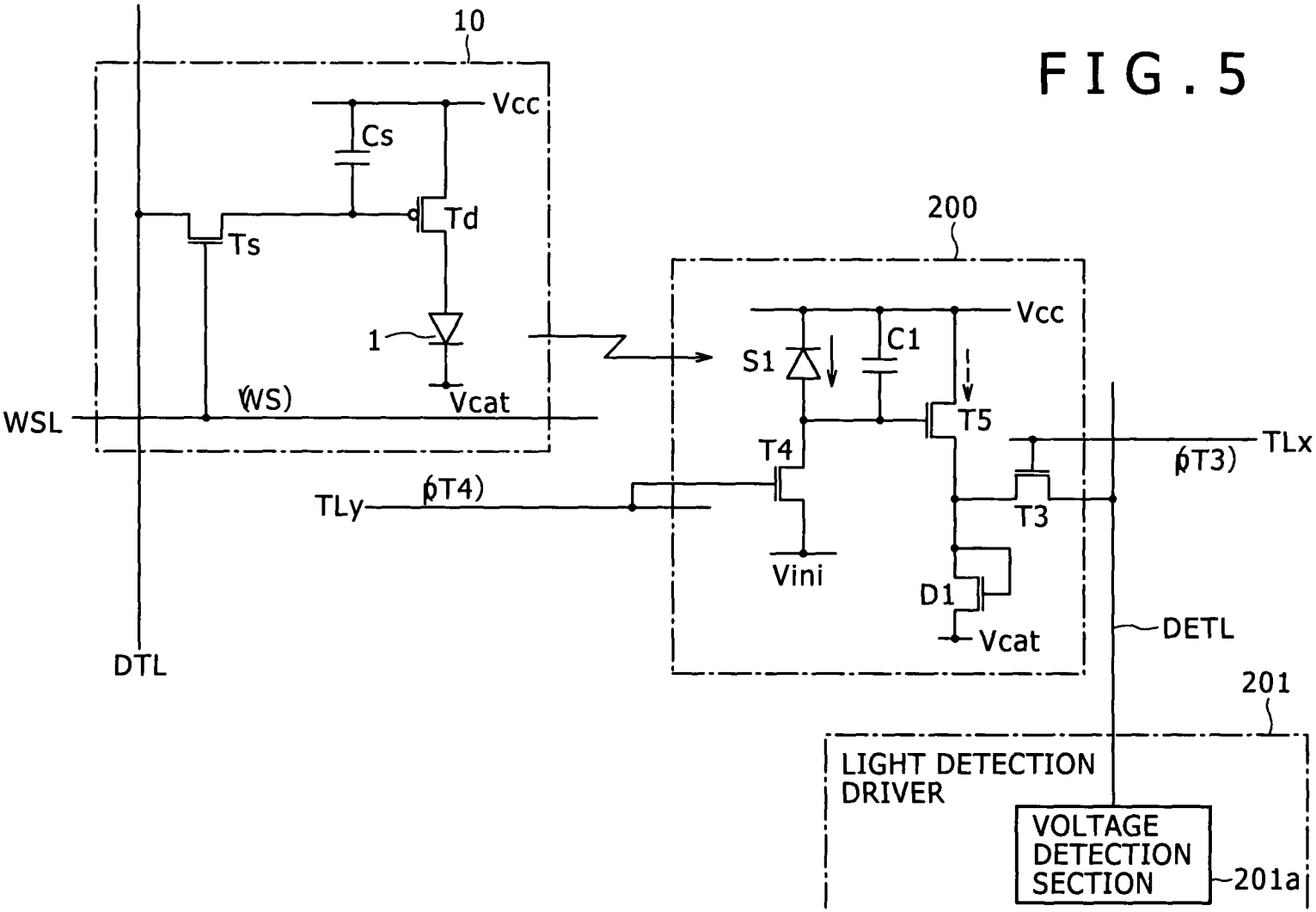
FIG. 5 is a circuit diagram showing another configuration which has been taken into consideration in the course to the present invention.

Therefore, such a light detection section 200 as shown in FIG. 5 has been contrived.

Referring to FIG. 5, a detection signal outputting circuit as the light detection section 200 includes a light sensor S1, a capacitor C1, a detection signal outputting transistor T5 in the form of an n-channel TFT, switching transistors T3 and T4, and a diode D1 in the form of a diode connection of a transistor.

The light sensor S1 is connected between the power supply voltage Vcc and the gate of the detection signal outputting transistor T5.

The light sensor S1 is produced using a PIN diode or amorphous silicon.

The light sensor S1 is disposed so as to detect light emitted from the organic EL element 1. The current of the light sensor S1 increases or decreases in response to the detection light amount. In particular, if the emission light amount of the organic EL element 1 is great, then the current increasing amount is great, but if the emission light amount of the organic EL element 1 is small, then the current increasing amount is small.

The capacitor C1 is connected between the power supply voltage Vcc and the gate of the detection signal outputting transistor T5.

The detection signal outputting transistor T5 is connected at the drain thereof to the power supply voltage Vcc and at the source thereof to the switching transistor T3.

The switching transistor T3 is connected between the source of the detection signal outputting transistor T5 and the light detection line DETL. The switching transistor T3 is turned on/off with a control pulse pT3 provided to the gate thereof from a control line TLx. When the switching transistor T3 is turned on, the source potential of the detection signal outputting transistor T5 is outputted to the light detection line DETL.

The diode D1 is connected between the source of the detection signal outputting transistor T5 and a cathode potential Vcat.

The switching transistor T4 is connected at the drain and the source thereof between the gate of the detection signal outputting transistor T5 and a reference potential Vini. The switching transistor T4 is turned on/off with a control pulse pT4 supplied from a control line TLy to the gate thereof.

When the switching transistor T4 is on, the reference potential Vini is inputted to the gate of the switching transistor T5.

A light detection driver 201 includes a voltage detection section 201*a* for detecting the potential of each light detection line DETL. The voltage detection section 201*a* detects a detection signal voltage outputted from the light detection section 200 and supplies the detected detection signal voltage as emission light amount information, which is information of luminance degradation, of the organic EL element 1 to the horizontal selector 11.

Figure 6:
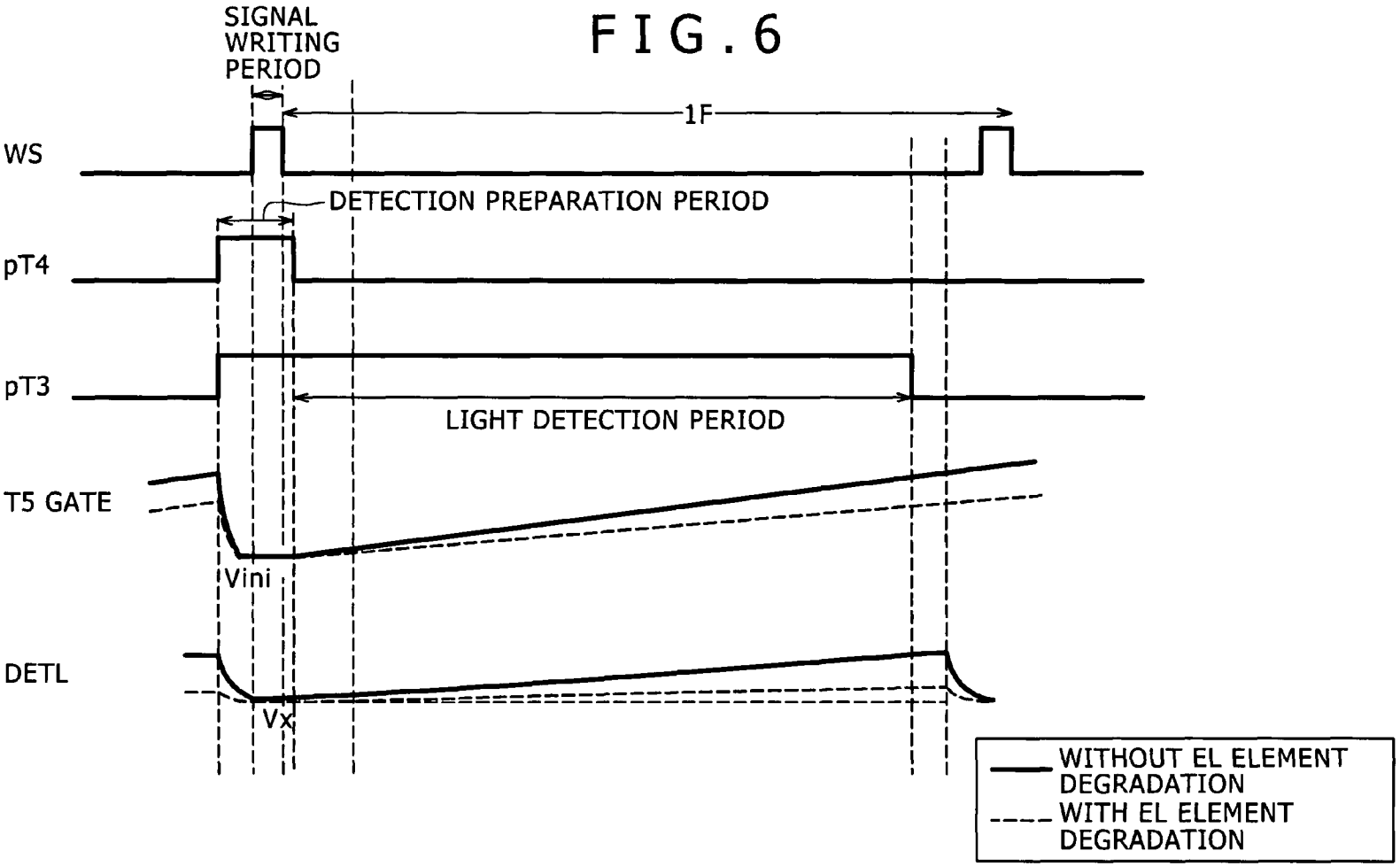
FIG. 6 is a waveform diagram illustrating operation of the circuit of FIG. 5.

FIG. 6 illustrates operation waveforms upon light detection operation.

In particular, FIG. 6 illustrates the scanning pulse WS for writing the signal value Vsig into the pixel circuit 10, control pulses pT4 and pT3 for the light detection section 200, a gate voltage of the detection signal outputting transistor T5 and a voltage appearing on the light detection line DETL.

Figure 7:
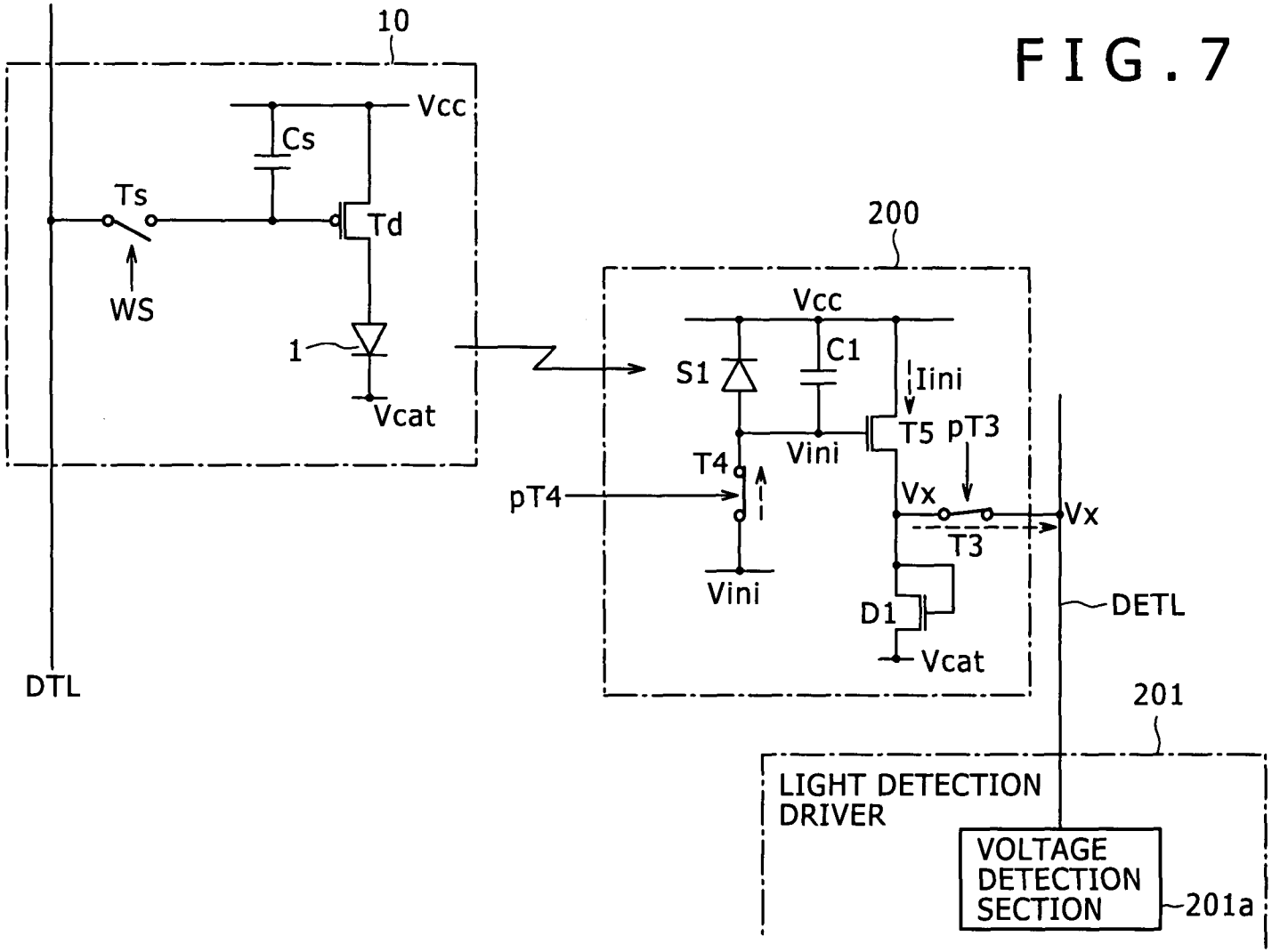
FIGS. 7 to 9 are equivalent circuit diagrams illustrating operation of the circuit of FIG. 5.

In the light detection section 200, first as a detection preparation period, the switching transistors T3 and T4 are turned on with the control pulses pT4 and pT3, respectively. A state at this time is illustrated in FIG. 7.

When the switching transistor T4 is turned on, the reference potential Vini is inputted to the gate of the detection signal outputting transistor T5.

The reference potential Vini is set to a level with which the detection signal outputting transistor T5 and the diode D1 are turned on. In particular, the reference potential Vini is higher than the sum of a threshold voltage VthT5 of the detection signal outputting transistor T5, a threshold voltage VthD1 of the diode D1 and the cathode potential Vcat, that is, VthT5+VthD1+Vcat. Therefore, since current Iini flows as seen in FIG. 7 and also the switching transistor T3 is on, a potential Vx is outputted to the light detection line DETL.

Within the detection preparation period, the gate potential of the detection signal outputting transistor T5=Vini and the potential of the light detection line DETL=Vx are obtained as seen in FIG. 6.

Figure 8:
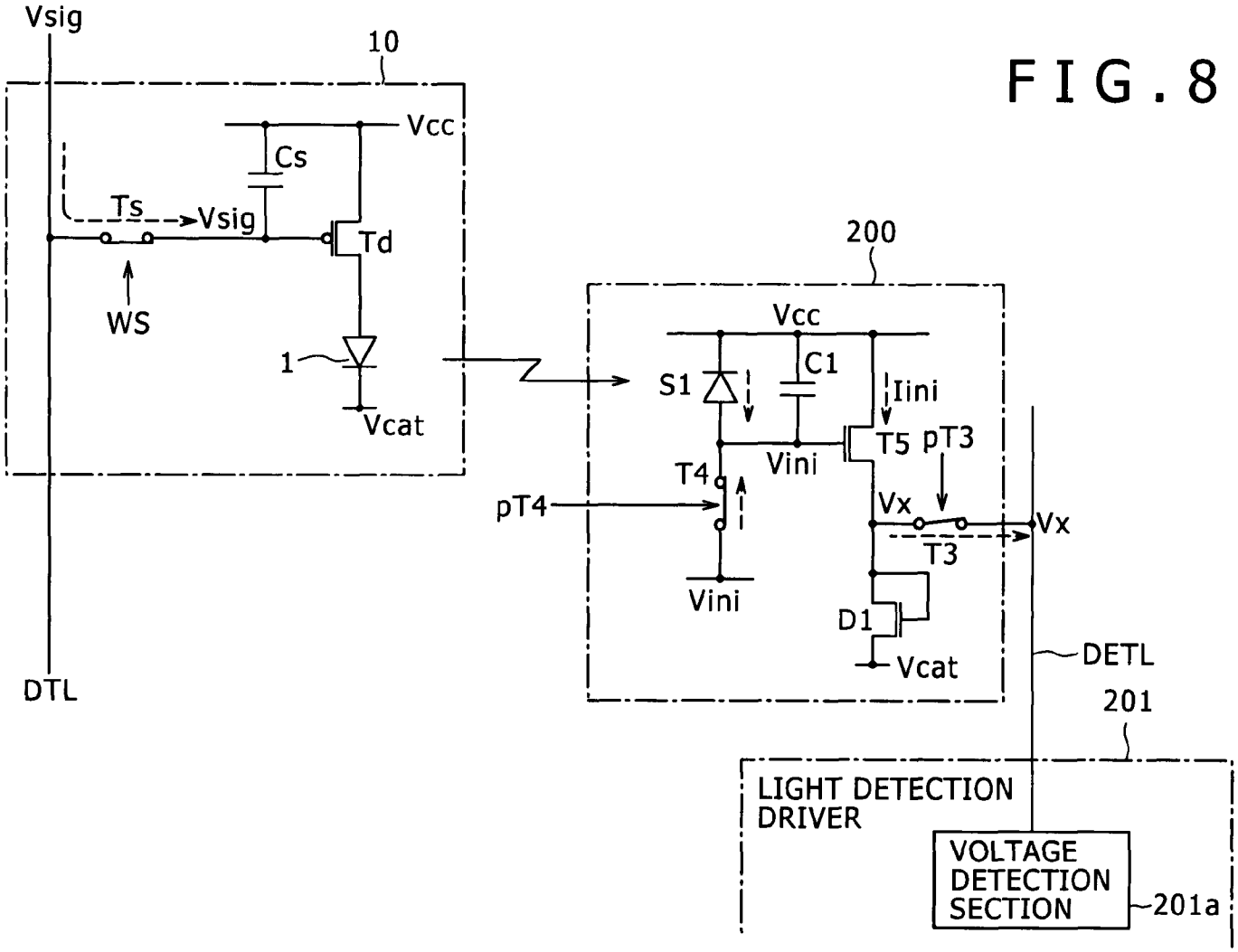

For a display within a period of one frame, signal writing is carried out in the pixel circuit 10. In particular, within the signal writing period of FIG. 6, the scanning pulse WS is placed into the H (High) level to render the sampling transistor Ts conducting. At this time, the horizontal selector 11 provides the signal value Vsig for a gradation of a white display to the signal line DTL. Consequently, in the pixel circuit 10, the organic EL element 1 emits light in accordance with the signal value Vsig. A state at this time is illustrated in FIG. 8.

At this time, the light sensor S1 receives the light emitted from the organic EL element 1 and leak current thereof varies. However, since the switching transistor T4 is in an on state, the gate voltage of the detection signal outputting transistor T5 remains the reference potential Vini.

After the signal writing ends, the sampling transistor Ts in the pixel circuit 10 is turned off.

Figure 9:
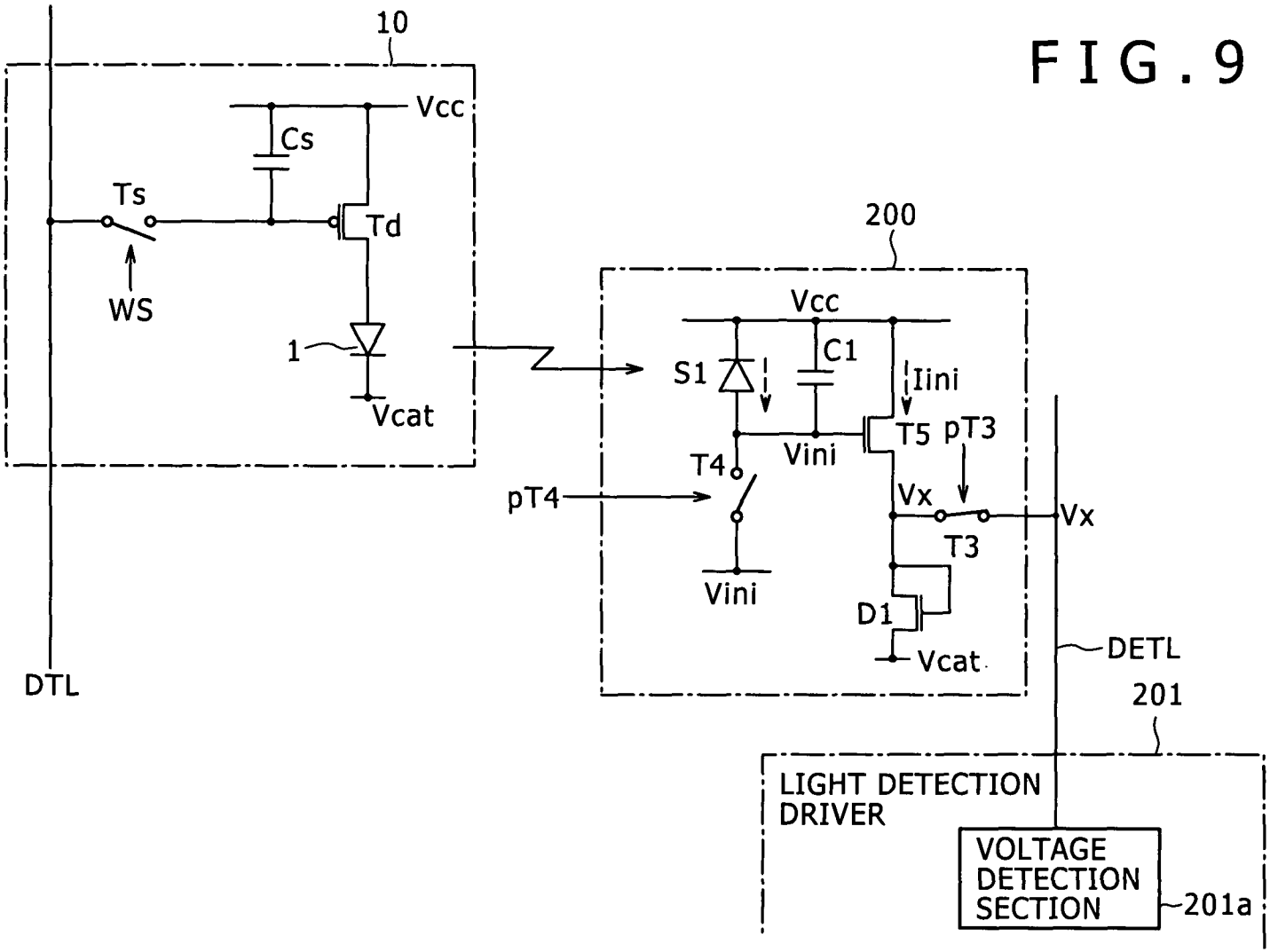

Meanwhile, in the light detection section 200, the control pulse pT4 is placed into the L (Low) level to turn off the switching transistor T4. This state is illustrated in FIG. 9.

When the switching transistor T4 is turned off, the light sensor S1 receives the light emitted from the organic EL element 1 and supplies leak current from the power supply voltage Vcc to the gate of the detection signal outputting transistor T5.

By this operation, the gate voltage of the detection signal outputting transistor. T5 gradually rises from the reference potential Vini as seen in FIG. 6, and together with this, also the potential of the light detection line DETL rises from the potential Vx. This potential variation of the light detection line DETL is detected by the voltage detection section 201*a*. The detected potential corresponds to the amount of emitted light of the organic EL element 1. In other words, if a particular gradation display such as, for example, a white display is executed by the pixel circuit 10, then the detected potential represents a degree of degradation of the organic EL element 1. For example, the potential difference of the light detection line DETL represented by a solid line in FIG. 6 represents the potential difference when the organic EL element 1 is not degraded at all while the potential difference represented by a broken line in FIG. 6 represents the potential difference when the organic EL element 1 suffers from degradation.

After lapse of a fixed period of time, the control pulse pT3 is placed into the L level to turn off the switching transistor T3 thereby to end the detection operation.

Detection, for example, regarding the pixel circuits 10 in a pertaining line within one frame is carried out in such a manner as described above.

The detection signal outputting circuit of the light detection section 200 has a configuration of a source follower circuit, and if the gate voltage of the detection signal outputting transistor T5 varies, then the variation is outputted from the source of the detection signal outputting transistor T5. In other words, the variation of the gate voltage of the detection signal outputting transistor T5 by variation of leak current of the light sensor S1 is outputted from the source of the detection signal outputting transistor T5 to the light detection line DETL.

Meanwhile, the gate-source voltage Vgs of the detection signal outputting transistor T5 is set so as to be higher than the threshold voltage Vth of the detection signal outputting transistor T5. Therefore, the value of current outputted from the detection signal outputting transistor T5 is much higher than that of the circuit configuration described hereinabove with reference to FIG. 3, and even if the value of current of the light sensor S1 is low, since it passes the detection signal outputting transistor T5, detection information of the emitted light amount can be outputted to the light detection driver 201.

Therefore, although a light detection operation of high accuracy is possible, the light detection section 200 is formed from an increased number of elements. In particular, the light detection section 200 may require the light sensor S1, the four transistors T3, T4, T5 and D1, and the capacitor C1, and this gives rise to increase of the number of elements per one pixel and increase of the ratio of transistors including the pixel circuit 10. This makes a cause of a low yield.

Therefore, taking the foregoing into consideration, the present embodiment simplifies the configuration of the light detection section to implement a high yield while maintaining good light detection like the light detection section 200.

3. First Embodiment

3-1. Circuit Configuration

A configuration of the pixel circuit 10 and a light detection section 30 of the embodiment shown in FIG. 1 is shown in FIG. 10.

Referring to FIG. 10, the pixel circuit 10 shown includes a sampling transistor Ts in the form of an re-channel TFT, a holding capacitor Cs, a driving transistor Td in the form of a p-channel TFT, and an organic EL element 1.

As seen in FIG. 1, the pixel circuit 10 is disposed at a crossing point between a signal line DTL and a writing control line WSL. The signal line DTL is connected to the drain of the sampling transistor Ts, and the writing control line WSL is connected to the gate of the sampling transistor Ts.

The driving transistor Td and the organic EL element 1 are connected in series between a power supply voltage Vcc and a cathode potential Vcat.

The sampling transistor Ts and the holding capacitor Cs are connected to the gate of the driving transistor Td. The gate-source voltage of the driving transistor Td is represented by Vgs.

In the present pixel circuit 10, when the horizontal selector 11 applies a signal value corresponding to a luminance signal to the signal line DTL, if a write scanner 12 places the scanning pulse WS of the writing control line WSL to the H level, then the sampling transistor Ts is rendered conducting and the signal value is written into the holding capacitor Cs. The signal value potential written in the holding capacitor Cs becomes the gate potential of the driving transistor Td.

If the write scanner 12 places the scanning pulse WS of the writing control line WSL into the L level, then although the signal line DTL and the driving transistor Td are electrically disconnected from each other, the gate potential of the driving transistor Td is held stably by the holding capacitor Cs.

Then, driving current Ids flows to the driving transistor Td and the organic EL element 1 so as to be directed from the power supply voltage Vcc toward the cathode potential Vcat.

At this time, the driving current Ids exhibits a value corresponding to the gate-source voltage Vgs of the driving transistor Td, and the organic EL element 1 emits light with a luminance corresponding to the current value.

In short, in the pixel circuit 10, the signal value potential is written from the signal line DTL into the holding capacitor Cs to vary the gate application voltage of the driving transistor Td thereby to control the value of current to flow to the organic EL element 1 to obtain a gradation of color development.

Since the driving transistor Td in the form of a p-channel TFT is designed such that it is connected at the source thereof to the power supply voltage Vcc so that the driving transistor Td normally operates within a saturation region thereof, the driving transistor Td serves as a source of constant current which has a value given by the following expression (1):

$$Ids=(1/2)\cdot\mu\cdot(W/L)\cdot Cox\cdot(\mathrm{Vgs}-\mathrm{Vth})^2 \quad (1)$$

where Ids is current flowing between the drain and the source of the transistor which operates in its saturation region, μ the mobility, W the channel width, L the channel length, Cox the gate capacitance, and Vth the threshold voltage of the driving transistor Td.

As apparently recognized from the expression (1) above, within the saturation region, the drain current Ids of the driving transistor Td is controlled by the gate-source voltage Vgs. Since the gate-source voltage Vgs of the driving transistor Td is kept fixed, the driving transistor Td operates as a constant current source and can cause the organic EL element 1 to emit light with a fixed luminance.

Generally, the current-voltage characteristic of the organic EL element 1 degrades as time passes. Thus, in the pixel circuit 10, together with a time-dependent variation of the organic EL element 1, the drain voltage of the driving transistor Td varies. However, since the gate-source voltage Vgs of the driving transistor Td is fixed in the pixel circuit 10, a fixed amount of current flows to the organic EL element 1 and the emitted light luminance does not vary. In short, stabilized gradation control can be anticipated.

However, as time passes, not only the driving voltage but also the light emission efficiency of the organic EL element 1 degrades. In other words, even if the same current is supplied to the organic EL element 1, the emitted light luminance of the organic EL element 1 drops together with time. As a result, such a screen burn as described hereinabove with reference to FIG. 37A appears.

Therefore, the light detection section 30 is provided so that correction or compensation corresponding to degradation of the emitted light luminance is carried out.

The detection signal outputting circuit as the light detection section 30 in the present embodiment includes a sensor serving transistor T10, a capacitor C2, a detection signal outputting transistor T5 in the form of an n-channel TFT, and a switching transistor T3 as seen in FIG. 10.

The sensor serving transistor T10 is connected between a power supply line VL and the gate of the detection signal outputting transistor T5.

The sensor serving transistor T10 is provided in place of the light sensor S1 in the form of a diode in the configuration described hereinabove with reference to FIG. 5, and is changed over between an on state and an off state so as to function as a switching element and besides functions as a light sensor in the off state thereof.

A TFT has a structure wherein it is formed by disposing a gate metal, a source metal and so forth on a channel layer. The sensor serving transistor T10 is formed so as to have a structure wherein, for example, a metal layer which forms the source and the drain does not comparatively intercept light to the channel layer above the channel layer. In other words, the TFT should be formed so that external light may be admitted into the channel layer.

The sensor serving transistor T10 is disposed so as to detect light emitted from the organic EL element 1. Then, in the off state of the sensor serving transistor T10, leak current thereof increases or decreases in response to the emitted light amount. In particular, if the emitted light amount of the organic EL element 1 is great, then the increasing amount of the leak current is great, but if the emitted light amount is small, then the increasing amount of the leak current is small.

The sensor serving transistor T10 is connected at the gate thereof to a control line TLb. Accordingly, the sensor serving transistor T10 is turned on/off with a control pulse pT10 of a detection operation control section 21 described hereinabove with reference to FIG. 1. When the sensor serving transistor T10 is turned on, the potential of the power supply line VL is inputted to the gate of the detection signal outputting transistor T5.

It is to be noted that, as described hereinabove, a pulse voltage which can assume the two values of the power supply voltage Vcc and the reference potential Vini is supplied from the detection operation control section 21 to the power supply line VL.

The capacitor C2 is connected between the cathode potential Vcat and the gate of the detection signal outputting transistor T5. The capacitor C2 is provided to retain the gate voltage of the detection signal outputting transistor T5.

The detection signal outputting transistor T5 is connected at the drain thereof to the power supply line VL. The detection signal outputting transistor T5 is connected at the source thereof to the switching transistor T3.

The switching transistor T3 is connected between the source of the detection signal outputting transistor T5 and the light detection line DETL. The switching transistor T3 is connected at the gate thereof to a control line TLa and accordingly is turned on/off with the control pulse pT3 of the detection operation control section 21 described hereinabove with reference to FIG. 1. When the switching transistor T3 is turned on, current flowing to the detection signal outputting transistor T5 is outputted to the light detection line DETL.

A light detection driver 22 includes a voltage detection section 22*a* for detecting the potential of each of the light detection lines DETL. The voltage detection section 22*a* detects a detection signal voltage outputted from the light detection section 30 and supplies the detection signal voltage as emitted light amount information of the organic EL element 1, that is, as information of luminance degradation of the organic EL element 1, to the horizontal selector 11 described hereinabove with reference to FIG. 1, particularly to the signal value correction section 11*a*.

It is to be noted that the diode D1, for example, in the form of a transistor of a diode connection is connected to the light detection line DETL so as to provide a current path to a fixed value, for example, to the cathode potential Vcat.

According to this, the diode D1 in the light detection section 200 shown in FIG. 5 is disposed outside of the pixel array 20, that is, on the light detection driver 22 side, and this makes a factor for reduction of the number of elements of the light detection section 30 of the present example.

In this manner, the light detection section 30 of the present example is configured from the three transistors T3, T5 and T10 and the capacitor C2 by providing the sensor serving transistor T10 and by externally disposing the diode D1.

3-2. Light Detection Operation Period

While the light detection operation of detecting the emitted light amount of the organic EL element 1 of the pixel circuit 10 is carried out by the light detection section 30 described hereinabove with reference to FIG. 10, an execution period of the light detection operation and so forth of the light detection section 30 is described here.

Figure 11A:
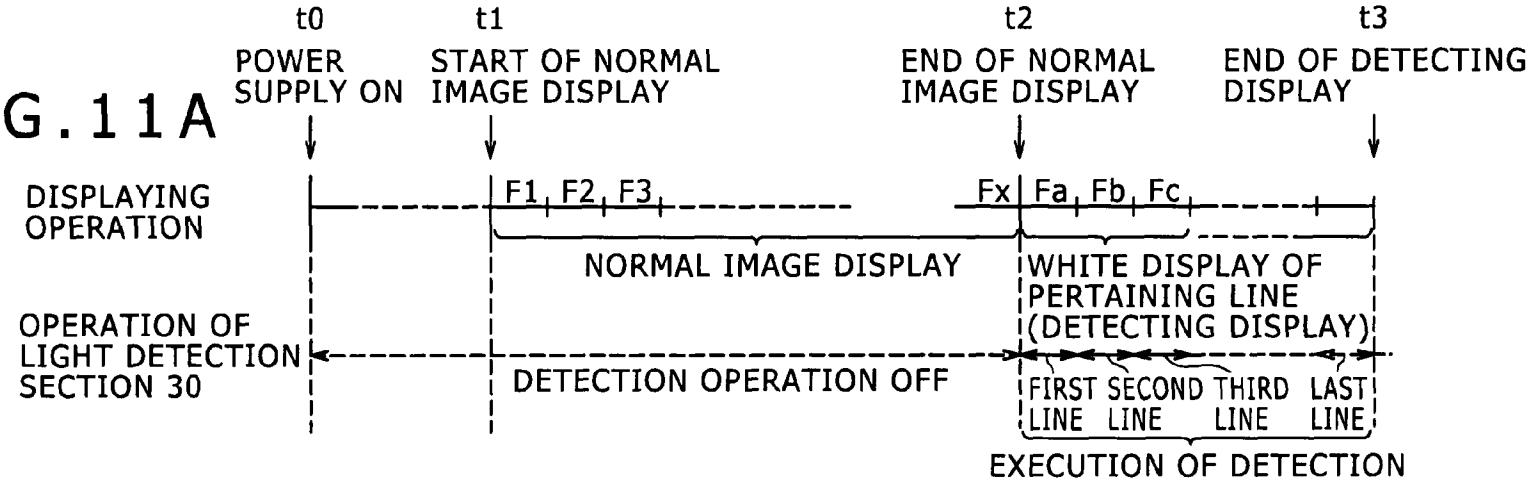
FIGS. 11A, 11B, 12A and 12B are diagrammatic views illustrating a light detection operation period by the light detection section shown in FIG. 10.

FIG. 11A illustrates a light detection operation carried out after a normal image display.

It is to be noted that the term "normal image display" used hereinbelow signifies a state wherein a signal value Vsig based on an image signal supplied to the display apparatus is provided to each pixel circuit 10 to carry out an image display of an ordinary dynamic image or still image.

It is assumed that, in FIG. 11A, the power supply to the display apparatus is turned on at time t0.

Here, various initialization operations upon turning on of the power supply are carried out before time t1, and a normal image display is started at time t1. Then, after time t1, a display of frames F1, F2, . . . of video images is executed as the normal image display.

In this period, the light detection section 30 does not execute a light detection operation.

At time t2, the normal image display ends. This corresponds to such a case that, for example, a turning off operation for the power supply is carried out.

In the example of FIG. 11A, the light detection section 30 executes a light detection operation after time t2.

In this instance, the light detection operation is carried out for pixels for one line, for example, within a period of one frame.

Figure 11B:
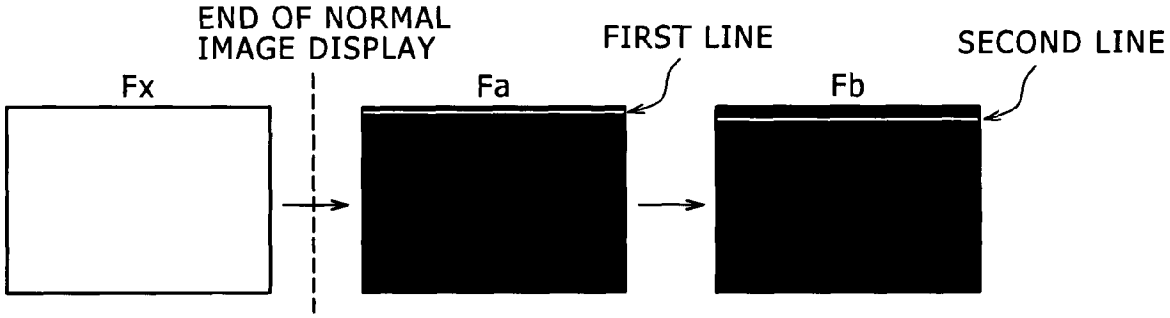

For example, when the light detection operation is started, the horizontal selector 11 causes the pixel circuits 10 within a first frame Fa to execute such a display that the first line is displayed by a white display as seen in FIG. 11B. In short, the signal value Vsig is applied to the pixel circuits 10 such that the pixel circuits 10 in the first line carry out a white display, that is, a high luminance gradation display while all of the other pixel circuits 10 execute a black display.

Within the period of the frame Fa, the light detection sections 30 corresponding to the pixels in the first line detect the emitted light amount of the corresponding pixels. The light detection driver 22 carries out voltage detection of the light detection lines DETL of the columns to obtain emitted light luminance information of the pixels in the first line. Then, the emitted light luminance information is fed back to the horizontal selector 11.

In the next frame Fb, the horizontal selector 11 causes the pixel circuits 10 to execute such a display that a white display is executed in the second line as seen in FIG. 11B. In other words, the horizontal selector 11 causes the pixel circuits 10 in the second line to execute a white display, that is, a high luminance gradation display but causes all of the other pixel circuits 10 to execute a black display.

Within the period of the frame Fb, the light detection sections 30 corresponding to the pixels in the second line detect the emitted light amount of the corresponding pixels. The light detection driver 22 carries out voltage detection of the light detection lines DETL of the columns to obtain emitted light luminance information of the pixels in the second line. Then, the emitted light luminance information is fed back to the horizontal selector 11.

Such a sequence of operations as described above is repeated up to the last line. At a stage wherein emitted light luminance information of the pixels of the last line is detected and fed back to the horizontal selector 11, the light detection operation ends.

The horizontal selector 11 carries out a signal value correction process based on the emitted light luminance information of the pixels.

When the light detection operation described above is completed at time t3, required processes such as, for example, to switch off the power supply to the display apparatus are carried out.

It is to be noted that, while, in the light detection operation for each line, the light detection sections 30 corresponding to the pixels in the line are selected, the selection is carried out with the control pulse pT3 of the detection operation control section 21.

In particular, since the switching transistor T3 is turned on in the light detection sections 30 which correspond to the pixels of the pertaining line, information of the light detection sections 30 in the other lines is not outputted to the light detection lines DETL, and consequently, light amount detection of the pixels of the pertaining line can be carried out.

Figure 12A:
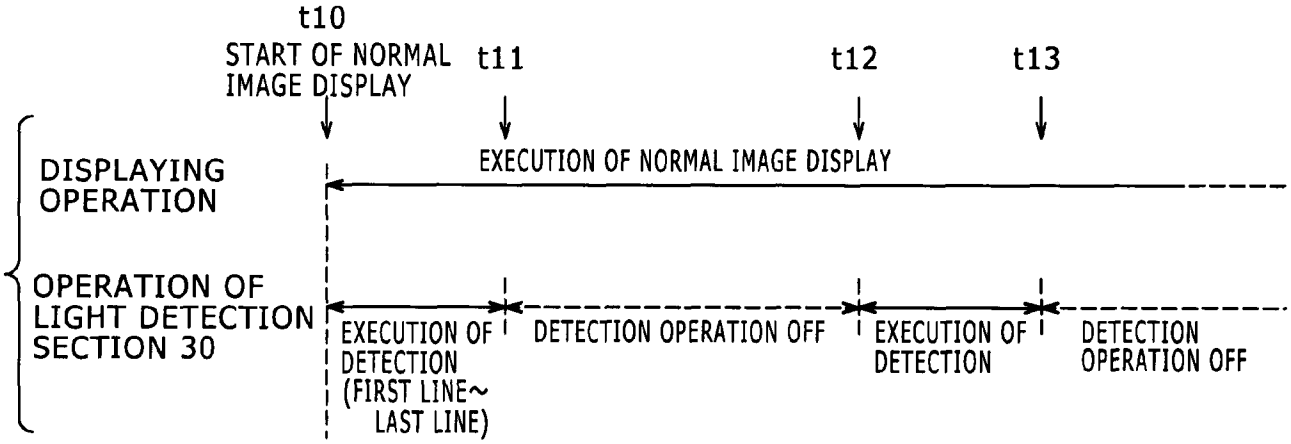

FIG. 12A illustrates a light detection operation carried out in a certain period during execution of the normal image display.

It is assumed that the normal image display is started, for example, at time t10. After the normal image display is started, the light detection operation by the light detection sections 30 is carried out for one line within a period of one frame. In other words, a detection operation similar to that carried out within the period from time t2 to time t3 of FIG. 11A is carried out. However, the display of each pixel circuit 10 is an image display in an ordinary case but is not a display for a light detection operation as in FIG. 11B.

When the light detection operation ends for the first to last lines, the light detection section 30 ends the light detection operation once.

The light detection operation is carried out after every predetermined period, and if it is assumed that the timing of a detection operation period comes at certain time t12, then a light detection operation from the first to the last line is carried out similarly. Then, after the light detection operation is completed, no light detection operation is carried out within a predetermined period of time.

For example, during execution of the normal image display, the light detection operation may be carried out in parallel in a predetermined period.

Figure 12B:
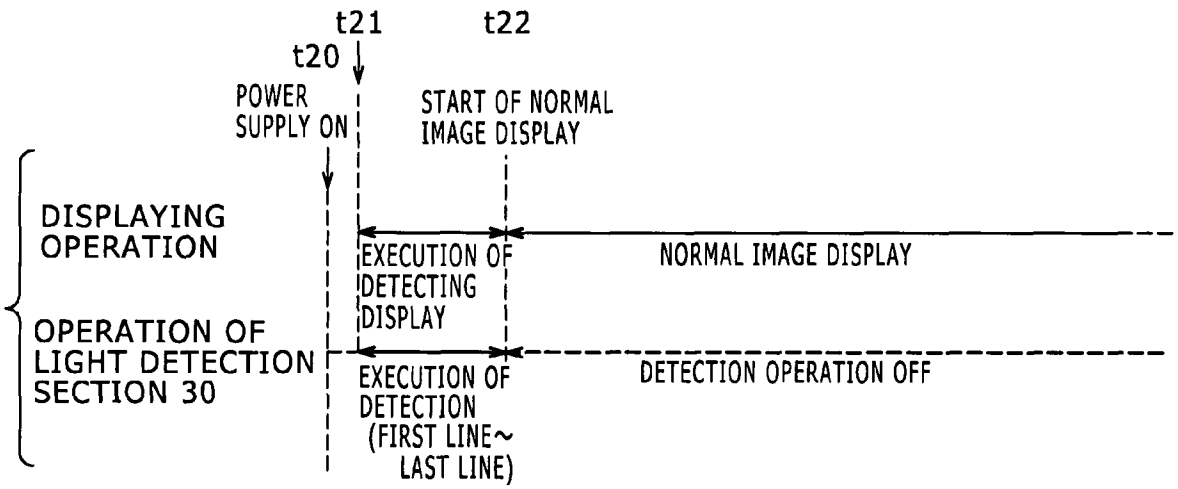

FIG. 12B illustrates a light detection operation carried out when the power supply is turned on.

It is assumed that the power supply to the display apparatus is turned on at time t20. Here, immediately after various initialization operations such as starting up when the power supply is made available are carried out, a light detection operation is carried out from time t21. In particular, a detection operation similar to the operation carried out within the period from time t2 to time t3 of FIG. 11 is carried out. Also each pixel circuit 10 executes a display for a light detection operation for displaying one line by a white display for every one frame.

After the light detection operation for the first to the last lines is completed, the horizontal selector 11 causes the pixel circuits 10 to start the normal image display at time t22. The light detection sections 30 do not carry out the light detection operation.

For example, if the light detection operation is carried out after the normal image display comes to an end, during execution of the normal image display, before ordinary image display is started or at some other timing as described above and then the signal value correction process based on the detection is carried out, degradation of the emitted light luminance can be coped with.

It is to be noted that the light detection operation may be carried out, for example, at both timings after the normal image display ends and before the ordinary image display is started.

Where the light detection operation is carried out at both or one of the timings after the normal image display ends and before the ordinary image display is started, since such a display for the light detection operation as illustrated in FIG. 11B can be carried out, there is an advantage that the detection can be carried out with emitted light of a high gradation as in the case of the white display. Also it is possible for a display of an arbitrary gradation to be executed to detect a degree of degradation for each gradation.

On the other hand, where the light detection operation is carried out during execution of the normal image display, since the substance of an image being displayed actually is indefinite, it is not possible to specify a gradation to carry out the light detection operation. Therefore, it is necessary to decide a detection value as a value determined taking an emitted light gradation, that is, the signal value Vsig applied then to a pixel of the object of detection into consideration and carry out a signal value correction process. It is to be noted that, since a light detection operation and a correction process can be carried out repetitively during execution of the normal image display, there is an advantage that luminance degradation of the organic EL elements 1 can be coped with substantially normally.

3-3. Light Detection Operation

The light detection operation by the light detection section 30 of the present example is described with reference to FIGS. 13 to 17. The light detection operation is executed after the normal image display of FIGS. 11A and 11B comes to an end.

Figure 13:
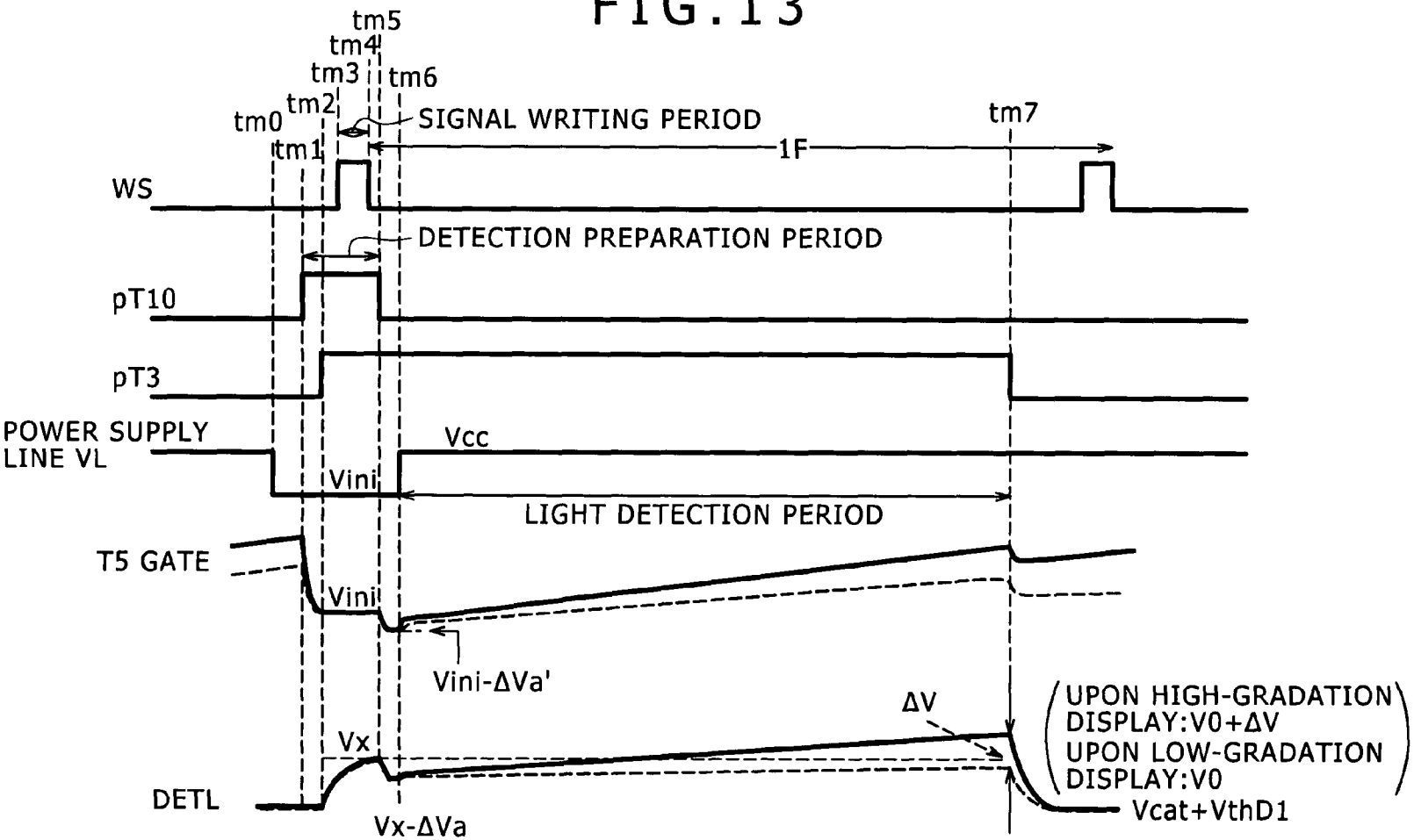
FIG. 13 is a waveform diagram illustrating operation upon light detection by the light detection section shown in FIG. 10.

FIG. 13 shows waveforms regarding the operation of the light detection section 30. In particular, FIG. 13 shows a scanning pulse WS to be applied from the write scanner 12 to a pixel circuit 10, particularly to the sampling transistor Ts.

FIG. 13 further illustrates control pulses pT10 and pT3 to be applied from the detection operation control section 21 to the control lines TLb and TLa, respectively. The sensor serving transistor T10 of the light detection section 30 is turned on/off in response to the control pulse pT10. Further, the switching transistor T3 of the light detection section 30 is turned on/off in response to the control pulse pT3.

FIG. 13 illustrates also a power supply pulse of the power supply line VL. As seen in FIG. 13, the detection operation control section 21 applies the reference potential Vini to the power supply line VL within a detection preparation period preceding to a light detection period but applies the power supply voltage Vcc to the power supply line VL within a period within which the light detection is executed.

FIG. 13 further illustrates a gate voltage of the detection signal outputting transistor T5 and a voltage appearing on the light detection line DETL.

It is assumed that one light detection section 30 carries out light amount detection regarding a corresponding one of the pixel circuits 10 within a period of one frame as seen in FIG. 13.

For the light detection section 30, the detection operation control section 21 first sets the power supply line VL to the reference potential Vini within a period from time tm0 to time tm6 including the detection preparation period.

Then, detection preparation is carried out within the period from time tm1 to time tm5. The detection operation control section 21 first sets the control pulse pT10 to the H level to turn on the sensor serving transistor T10 at time tm1. Further, the detection operation control section 21 sets the control pulse pT3 to the H level to turn on the switching transistor T3 at time tm2. The state in this instance is illustrated in FIG. 14.

Where the sensor serving transistor T10 is turned on at time tm1 at which the power supply line VL is set to the reference potential Vini, the reference potential Vini is inputted to the gate of the detection signal outputting transistor T5. Then, when the switching transistor T3 is turned on, the source of the detection signal outputting transistor T5 is connected to the light detection line DETL.

Here, the reference potential Vini has a level with which the detection signal outputting transistor T5 is turned on. In particular, the reference potential Vini is higher than the sum of the threshold voltage VthT5 of the detection signal outputting transistor T5, the threshold voltage VthD1 of the diode D1 connected to the light detection line DETL and the source potential of the diode D1, which is, for example, the cathode potential Vcat. That is, the reference potential Vini is Vini>VthT5+VthD1+Vcat.

Figure 14:
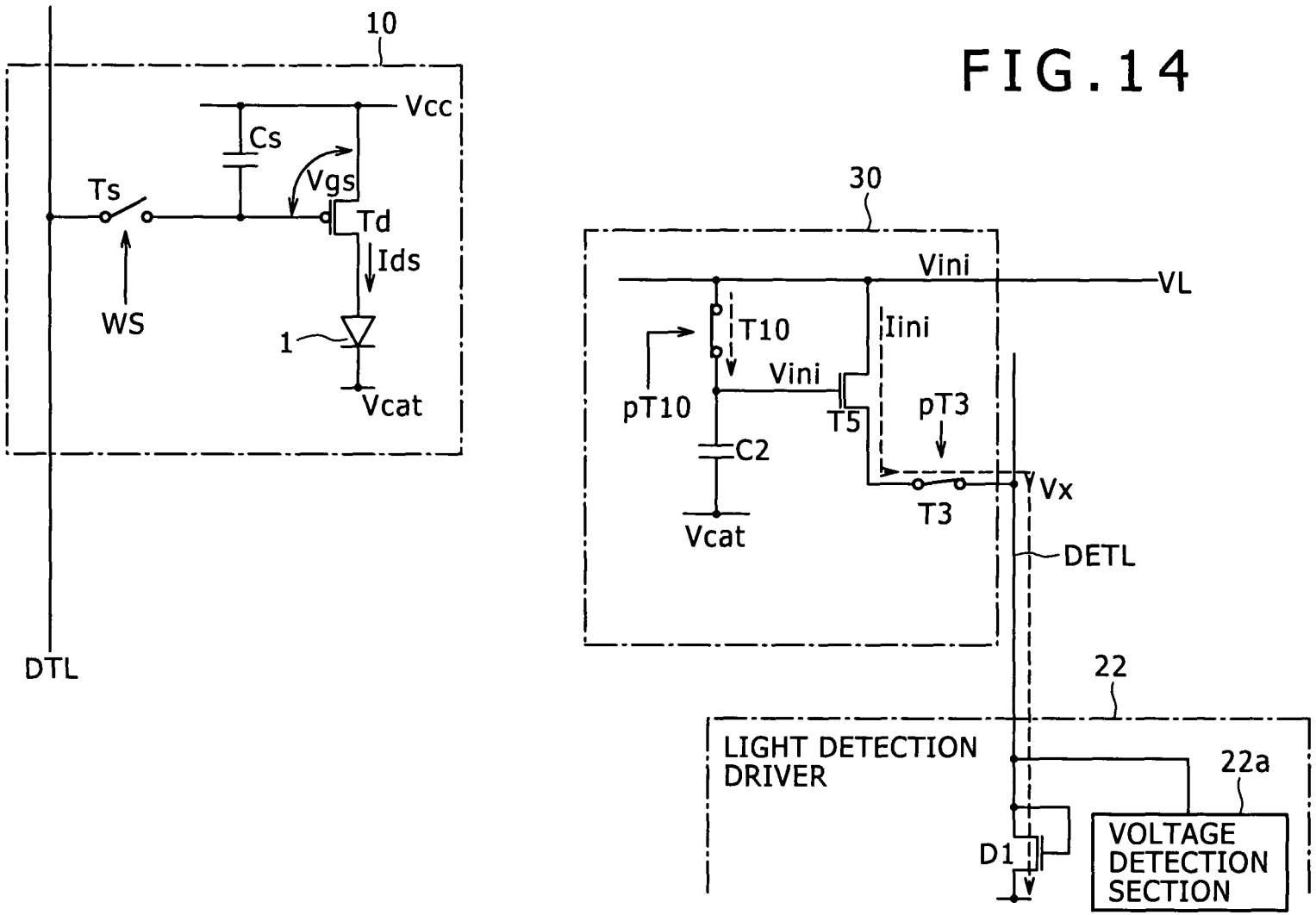
FIGS. 14 to 17 are equivalent circuit diagrams illustrating operation upon light detection by the light detection section shown in FIG. 10.

Thereafter, as seen in FIG. 14, current Iini flows and the light detection line DETL has a certain potential Vx. Since such operation as just described is carried out within the detection preparation period, the gate potential of the detection signal outputting transistor T5 becomes equal to the reference potential Vini and the potential of the light detection line DETL becomes equal to the potential Vx as seen in FIG. 13.

Within the period from time tm3 to time tm4 of FIG. 13, writing of the signal value Vsig into the pixel circuits 10 is carried out for a display for a one-frame period.

Figure 15:
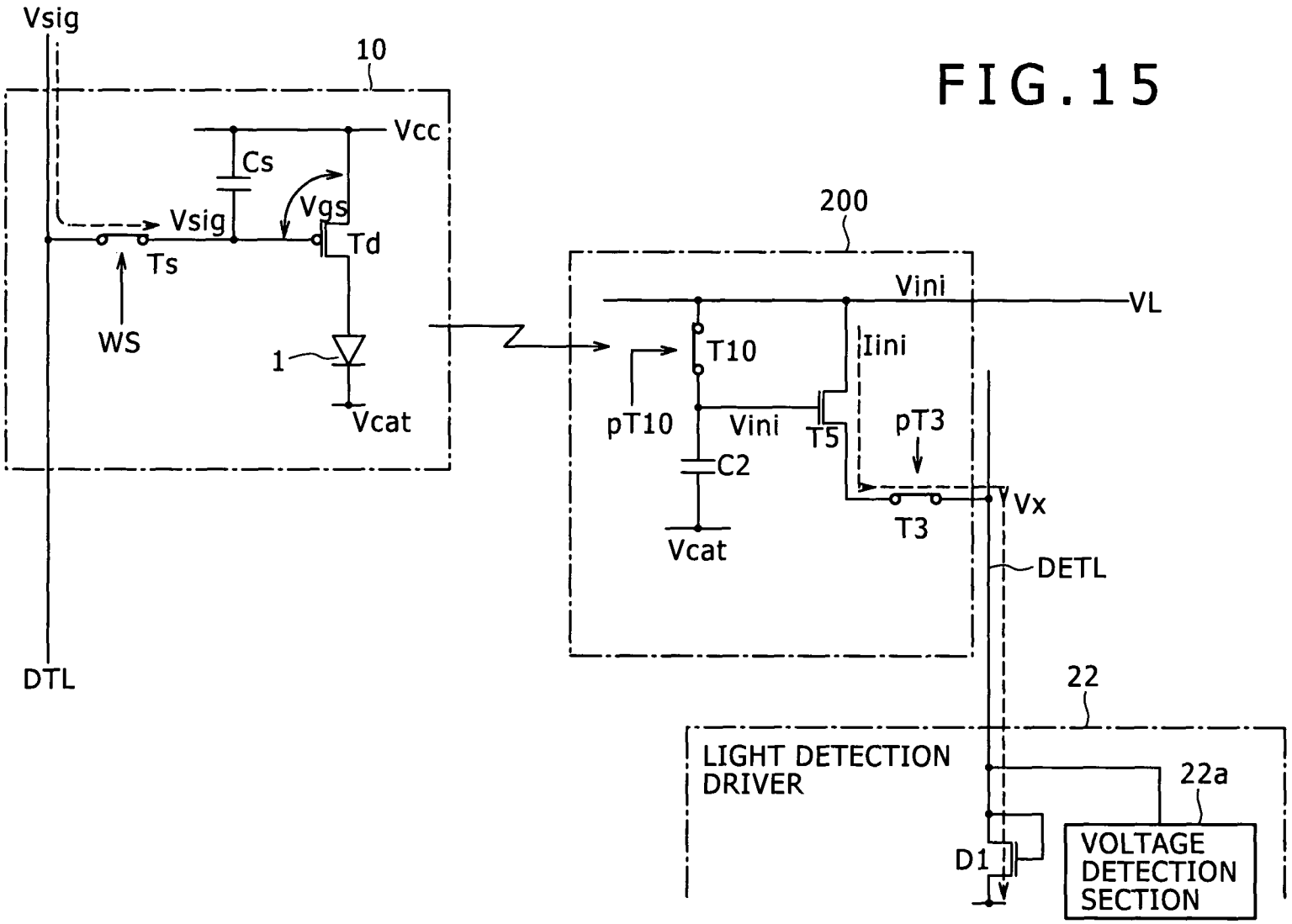

In particular, within the signal wiring period of FIG. 13, the scanning pulse WS is set to the H level to render the sampling transistor Ts conducting. At this time, the horizontal selector 11 applies the signal value Vsig, for example, of the white display gradation to the signal line DTL. Consequently, in the pixel circuits 10, the organic EL element 1 emits light in accordance with the signal value Vsig. A state in this instance is illustrated in FIG. 15.

At this time, since the sensor serving transistor T10 is on, the gate voltage of the detection signal outputting transistor T5 remains equal to the reference potential Vini.

After the signal writing ends, the sampling transistor Ts in the pixel circuits 10 is turned off at time tm4.

Figure 16:
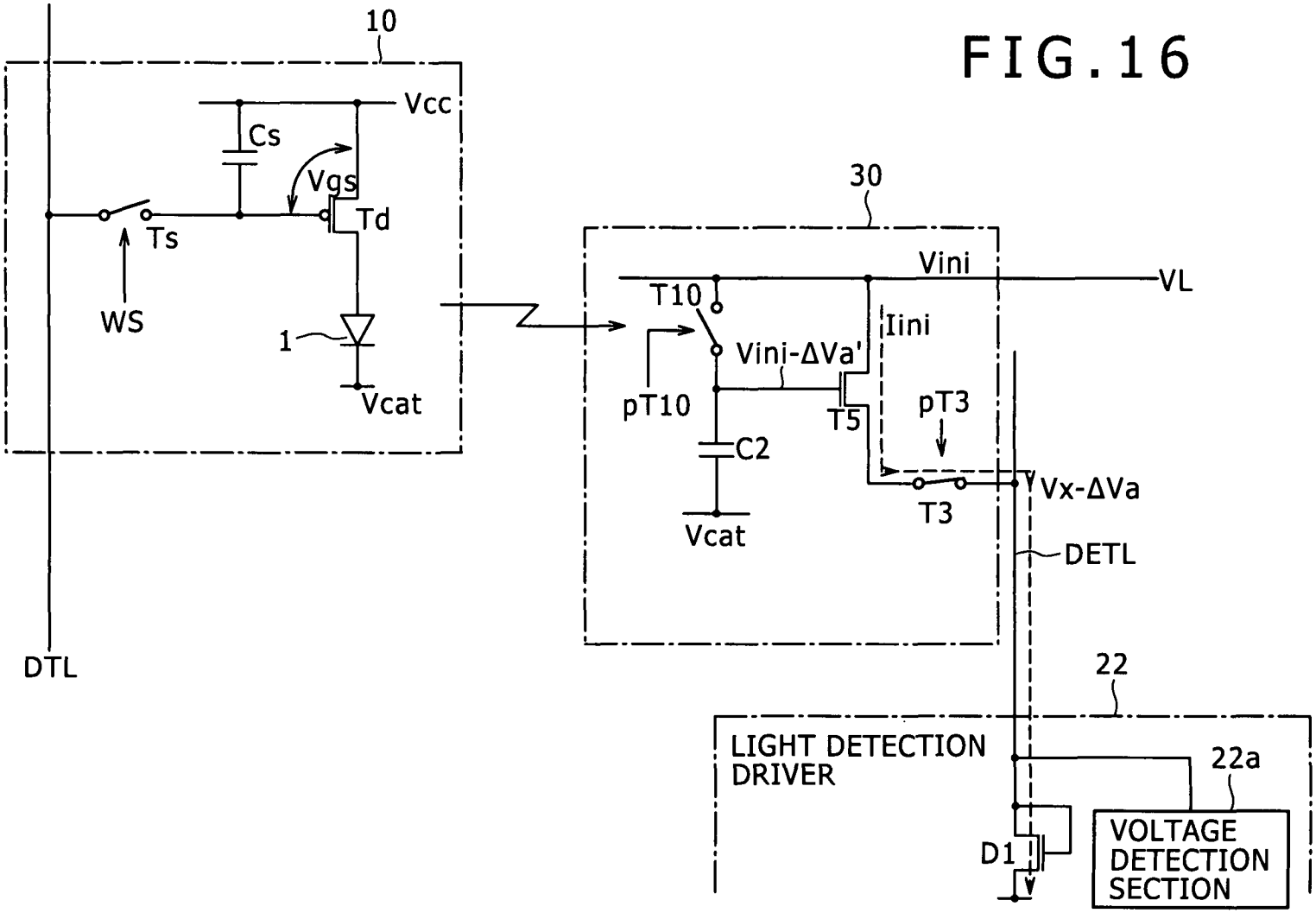

Meanwhile, in the light detection section 30, the control pulse pT10 is placed into the L level at time tm5 to turn off the sensor serving transistor T10. This state is illustrated in FIG. 16.

Where the sensor serving transistor T10 is turned off, a coupling amount ΔVa' corresponding to a capacitance ratio between the capacitor C2 and the parasitic capacitance of the sensor serving transistor T10 is inputted to the gate of the detection signal outputting transistor T5. Therefore, also the voltage of the light detection line DETL varies to a potential given by Vx−ΔVa.

By the coupling, a potential difference appears between the source and the drain of the sensor serving transistor T10 and varies the leak amount of the sensor serving transistor T10 depending upon the received light amount. However, the leak current at this time little varies the gate voltage of the detection signal outputting transistor T5. This arises from the facts that the potential difference between the source and the drain of the sensor serving transistor T10 is small and that the time before a next operation of varying the power supply line VL from the reference potential Vini to the power supply voltage Vcc is short.

At time tm6 after a fixed period of time elapses, the detection operation control section 21 varies the potential of the power supply line VL from the reference potential Vini to the power supply voltage Vcc.

By this operation, the coupling from the power supply line VL is inputted to the gate of the detection signal outputting transistor T5, and consequently, the gate potential of the detection signal outputting transistor T5 rises. Since the potential of the power supply line VL varies to the high potential, a great potential difference appears between the source and the drain of the sensor serving transistor T10, and leak current flows from the power supply line VL to the gate of the detection signal outputting transistor T5 in response to the received light amount.

Figure 17:
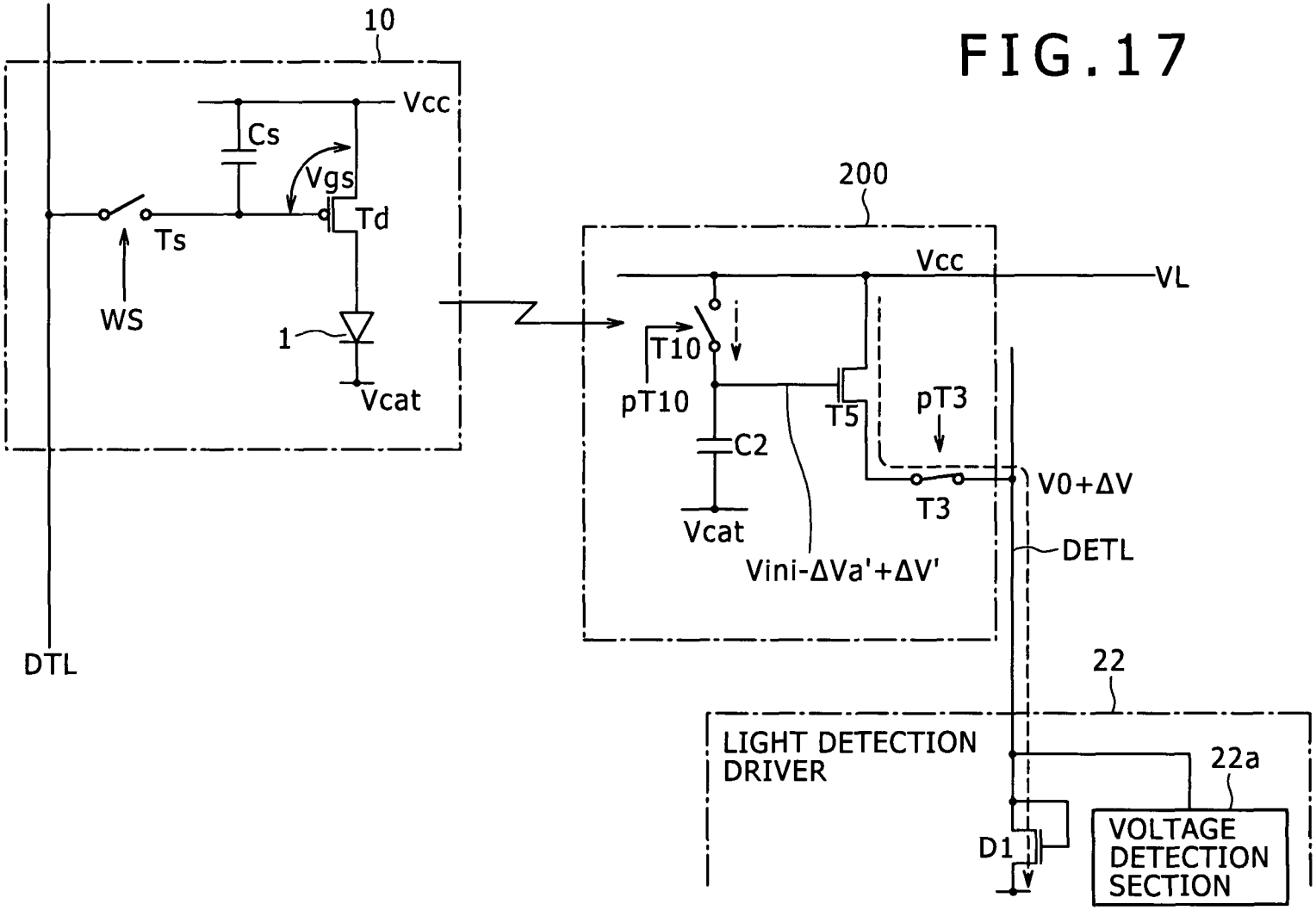

This state is illustrated in FIG. 17. By the operation described, the gate voltage of the detection signal outputting transistor T5 varies from Vini−ΔVa' to Vini−ΔVa'+ΔV'. FIG. 13 illustrates a manner wherein the gate potential of the detection signal outputting transistor T5 gradually rises from Vini−ΔVa' to Vini−ΔVa'+ΔV' after time tm6.

Together with this, also the potential of the light detection line DETL rises from the potential Vx−ΔVa to V0+ΔV. It is to be noted that the potential V0 is a potential of the light detection line DETL in a low gradation displaying state, that is, in a black displaying state. Since the amount of current flowing to the sensor serving transistor T10 increases as the amount of light received by the sensor serving transistor T10 increases, the voltage of the light detection line DETL upon a high gradation display is higher than that upon a low gradation display.

This potential variation of the light detection line DETL is detected by the voltage detection section 22*a*. This detection voltage corresponds to the emitted light amount of the organic EL element 1. In other words, if a particular gradation display such as, for example, a white display is being executed by the pixel circuit 10, then the detection potential represents a degree of degradation of the organic EL element 1.

After lapse of a fixed interval of time, the control pulse pT3 is set to the L level at time tm7 to turn off the switching transistor T3 thereby to end the detection operation. Consequently, no more current is supplied to the light detection line DETL, and the potential becomes equal to Vcat+VthD1. It is to be noted that VthD1 represents a threshold voltage of the diode D1.

For example, detection with regard to the pixel circuits 10 of the pertaining line within one frame is carried out in the following manner.

The light detection section 30 in the present embodiment which carries out such a light detection operation as described above can carry out a light detection operation with a high degree of accuracy similarly to the light detection section 200 described hereinabove with reference to FIG. 5.

In particular, the detection signal outputting circuit of the light detection section 30 is configured as a source follower circuit, and if the gate voltage of the detection signal outputting transistor T5 varies, then the variation is outputted from the source of the detection signal outputting transistor T5. Therefore, the variation of the gate voltage of the detection signal outputting transistor T5 by the variation of leak current of the sensor serving transistor T10 is outputted from the source of the sensor serving transistor T10 to the light detection line DETL.

Further, the gate-source voltage Vgs of the detection signal outputting transistor T5 is set so as to be higher than the threshold voltage Vth of the detection signal outputting transistor T5. Therefore, the value of current outputted from the detection signal outputting transistor T5 is much higher than that of the circuit configuration described hereinabove with reference to FIG. 3. Thus, even if the current value of the sensor serving transistor T10 is low, where the current flows through the detection signal outputting transistor T5, detection information of the emitted light amount can be outputted appropriately to the light detection driver 22.

Further, the number of transistors which form the light detection section 30 can be reduced, and a high yield can be implemented.

Further, also the arrangement of elements on the pixel array 20 is provided with room, and this is suitable for design.

Further, where the light detection driver 22 feeds back the detected light amount information as information for correction of the signal value Vsig to the horizontal selector 11, a countermeasure against a drawback in picture quality such as a screen burn can be taken.

3-4. Modification to the First Embodiment

While the configuration which uses the sensor serving transistor T10 is described hereinabove as the first embodiment, modifications to the present first embodiment are described.

Figure 18:
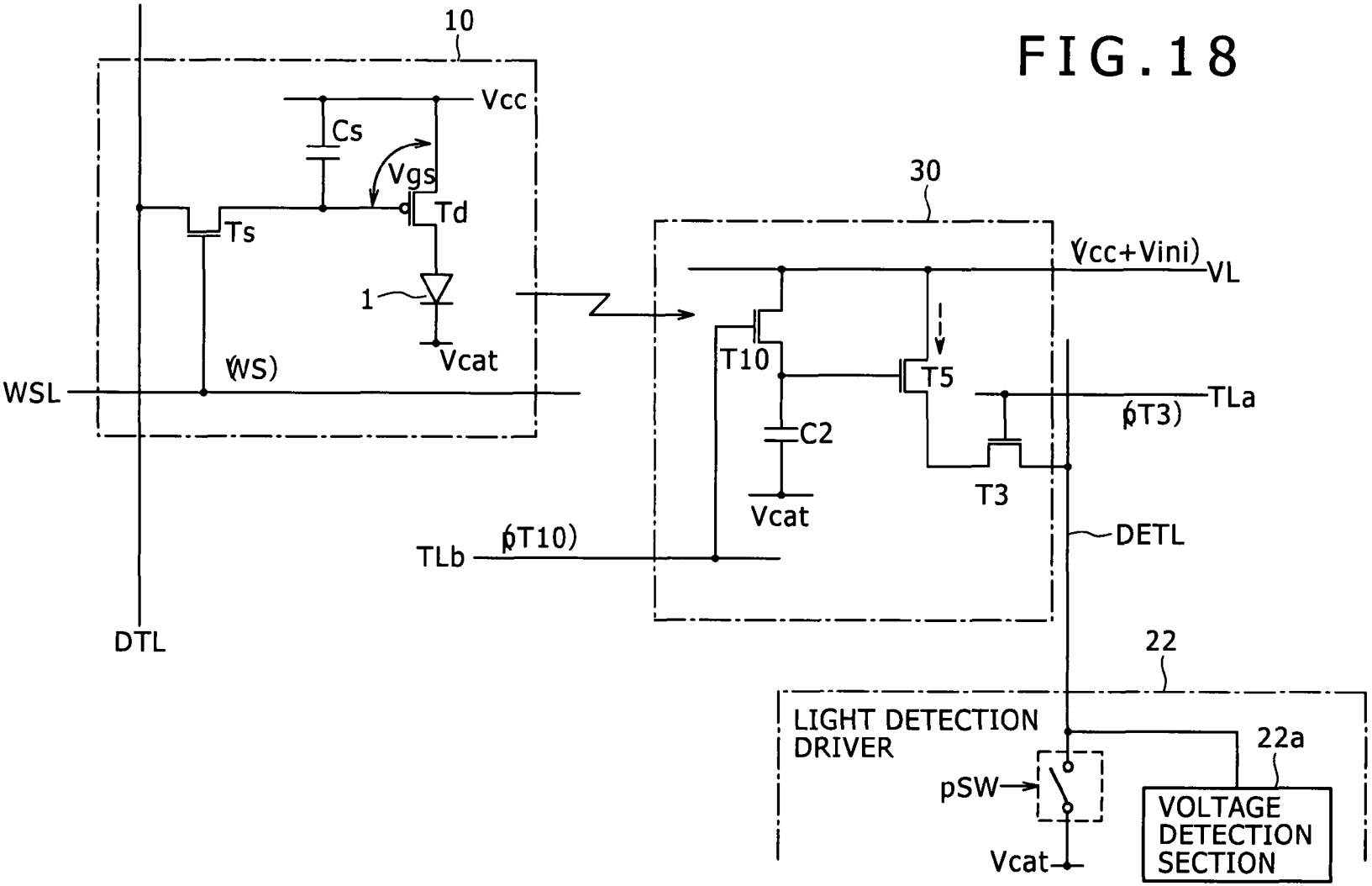
FIG. 18 is a circuit diagram showing a modification to the pixel circuit and the light detection section shown in FIG. 10.

The configuration of a modification is shown in FIG. 18. In the modification shown in FIG. 18, the diode D1 connected to the light detection line DETL in the light detection driver 22 is replaced with a switch SW and a fixed power supply such as, for example, the cathode potential Vcat.

The switch SW is switched on/off with a control signal pSW from the detection operation control section 21.

Also in the case of the present configuration, light amount detection can be carried out similarly.

Figure 19:
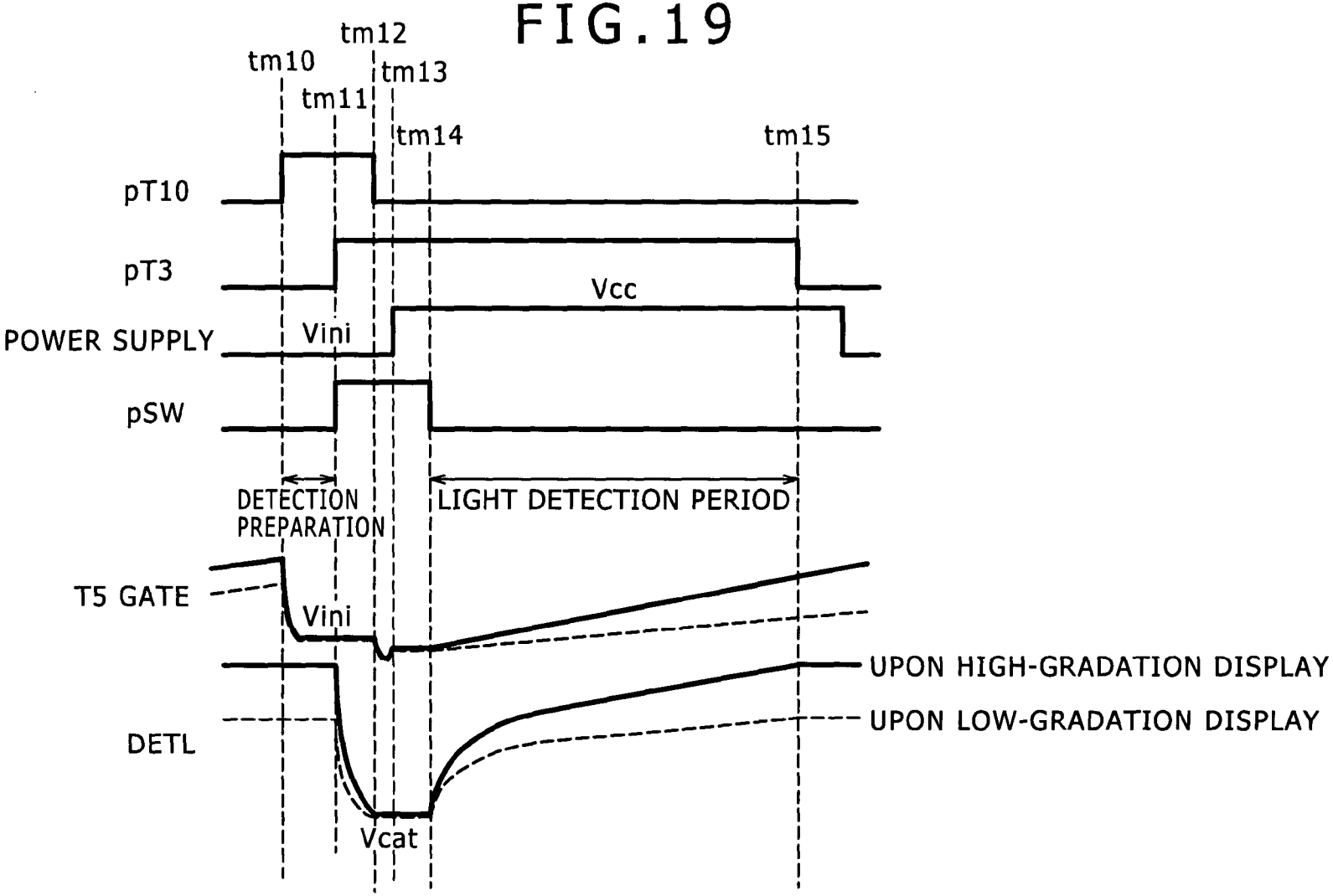
FIG. 19 is a waveform diagram illustrating light detection operation by the modified light detection section shown in FIG. 18.

An example of the operation by the configuration shown in FIG. 18 is described with reference to FIG. 19.

First, within a detection preparation period from time tm10 to time tm11, the sensor serving transistor T10 is turned on with the control pulse pT10 to input the reference potential Vini to the gate of the detection signal outputting transistor T5 in a state wherein the power supply line VL is set to the reference potential Vini.

Further, at time tm11, the switching transistor T3 is turned on with the control pulse pT10 and the switch SW is switched on with the control signal pSW.

By the operations till now, the gate potential of the detection signal outputting transistor T5 is initialized to the reference potential Vini and the potential of the light detection line DETL is initialized to the cathode potential Vcat.

Then, the sensor serving transistor T10 is turned off at time tm12, and the potential of the light detection line DETL is changed from the reference potential Vini to the power supply voltage Vcc at time t13 to carry out light detection.

Then, the time tm14 after lapse of a fixed period of time is set as light detection period starting time, and the switch SW is switched off so that the voltage detection section 22*a* starts light detection.

In the configuration shown in FIG. 18, by turning on the sensor serving transistor T10, a fixed potential, that is, the reference potential Vini, is inputted to the gate of the detection signal outputting transistor T5 to carry out a threshold voltage correction operation.

Also by the present system, a voltage corresponding to emitted light of the organic EL element 1 is outputted to the light detection line DETL.

As another modification, the following example may be applicable.

Also it is suitable to vary the sensitivity of the sensor serving transistor T10 in the light detection section 30 in order to fix the voltage level to be outputted to the light detection line DETL from the light detection section 30 which detects light of a different wavelength.

In particular, the sensitivity of the sensor serving transistor T10 for detecting light having high energy is set low while the sensitivity of another sensor serving transistor T10 for detecting light having low energy is set high. As an example, in order to vary the sensitivity of light, the transistor size determined by the channel length or the channel width of a transistor as the sensor serving transistor T10 or the film thickness of the channel material should be changed.

In particular, the channel film thickness of a sensor serving transistor T10 of a light detection section 30 which detects light having higher energy such as B light is set thin while the channel width of the sensor serving transistor T10 is set small. Conversely, the channel film thickness of a sensor serving transistor T10 which detects light having low energy is set thin while the channel width of the sensor serving transistor T10 is set large.

For example, among the light detection sections 30 corresponding to a B light pixel, a G light pixel and a R light pixel, the channel film thickness of the sensor serving transistor T10 for detecting B light is set thinnest while the channel film thickness of the sensor serving transistor T10 for detecting R light is set thickest. Or, the channel width of the sensor serving transistor T10 for detecting B light is set smallest while the channel width of the sensor serving transistor T10 for detecting R light is set greatest. Or both countermeasures are applied.

Generally, a light detection element supplies a greater amount of leak current as the wavelength of light to be received thereby becomes shorter, that is, as the energy of light increases. Therefore, by setting the sensitivity of each sensor serving transistor T10 in response to the wavelength of light to be received, the variation of the gate potential of the detection signal outputting transistor T5 in each of the light detection sections 30 can be made a fixed value independently of the energy of the light to be received. As a result, the voltages to be outputted to the light detection lines DETL can be set to an equal voltage which does not vary depending upon the emitted light wavelength. Consequently, simplification of the light detection driver 22 can be anticipated.

It is to be noted that such a view as just described can be applied similarly also to a second embodiment of the present invention hereinafter described.

Further, the configuration of the pixel circuit 10 is not at all limited to the examples described hereinabove, and various other configurations may be adopted. In particular, the first embodiment described above can be applied widely to display apparatus which adopt a pixel circuit which carries out a light emitting operation irrespective of the configuration of the pixel circuit 10 described above with reference to FIG. 10 and include a light detection section provided outside the pixel circuit for detecting the emitted light amount of the pixel circuit. This regard is also the same as the second embodiment.

4. Second Embodiment

4-1. Circuit Configuration

A second embodiment of the present invention is described. A configuration of the organic EL display apparatus according to the second embodiment is shown in FIG. 20, and a difference of the configuration from that of the organic EL display apparatus described hereinabove with reference to FIG. 1 is described below. It is to be noted that the organic EL display apparatus of the present embodiment includes several common components to those of the first embodiment, and overlapping description of the common components is omitted herein to avoid redundancy.

Figure 20:
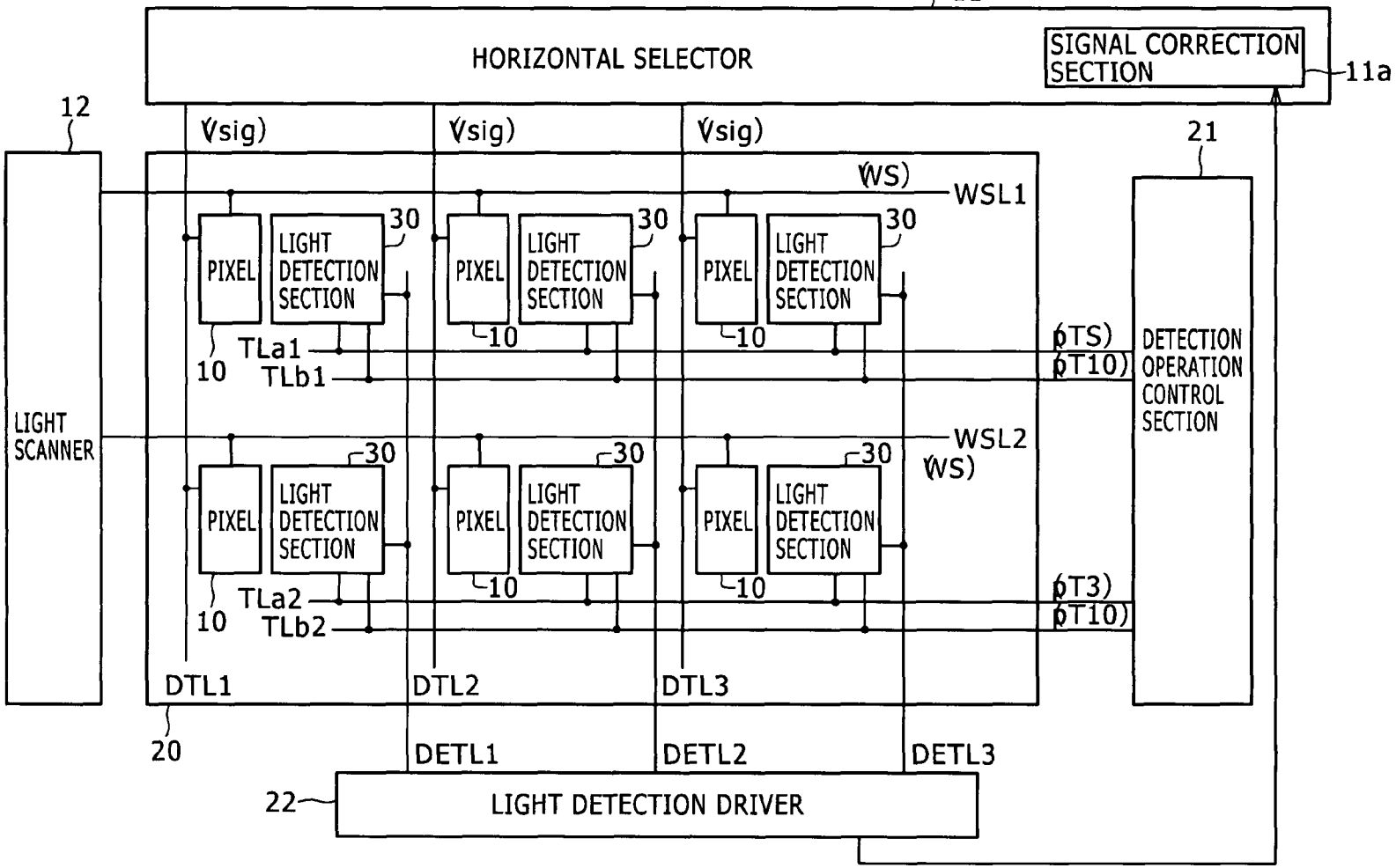
FIG. 20 is a block diagram showing a display apparatus according to a second embodiment of the present invention.

The apparatus of FIG. 20 is different from that of FIG. 1 in that it does not include the power supply lines VL extending from the detection operation control section 21 to the light detection sections 30.

In the first embodiment described hereinabove, the detection operation control section 21 applies a pulse voltage as the power supply voltage Vcc and the reference potential Vini to the light detection sections 30 through the power supply lines VL. In contrast, in the second embodiment, a power supply line hereinafter described with reference to FIG. 21 which has a fixed potential is introduced into each light detection section 30. In short, as the power supply, not pulse power is supplied from the detection operation control section 21. This signifies that a driver for generating a power supply pulse in the detection operation control section 21 is not required.

Figure 21:
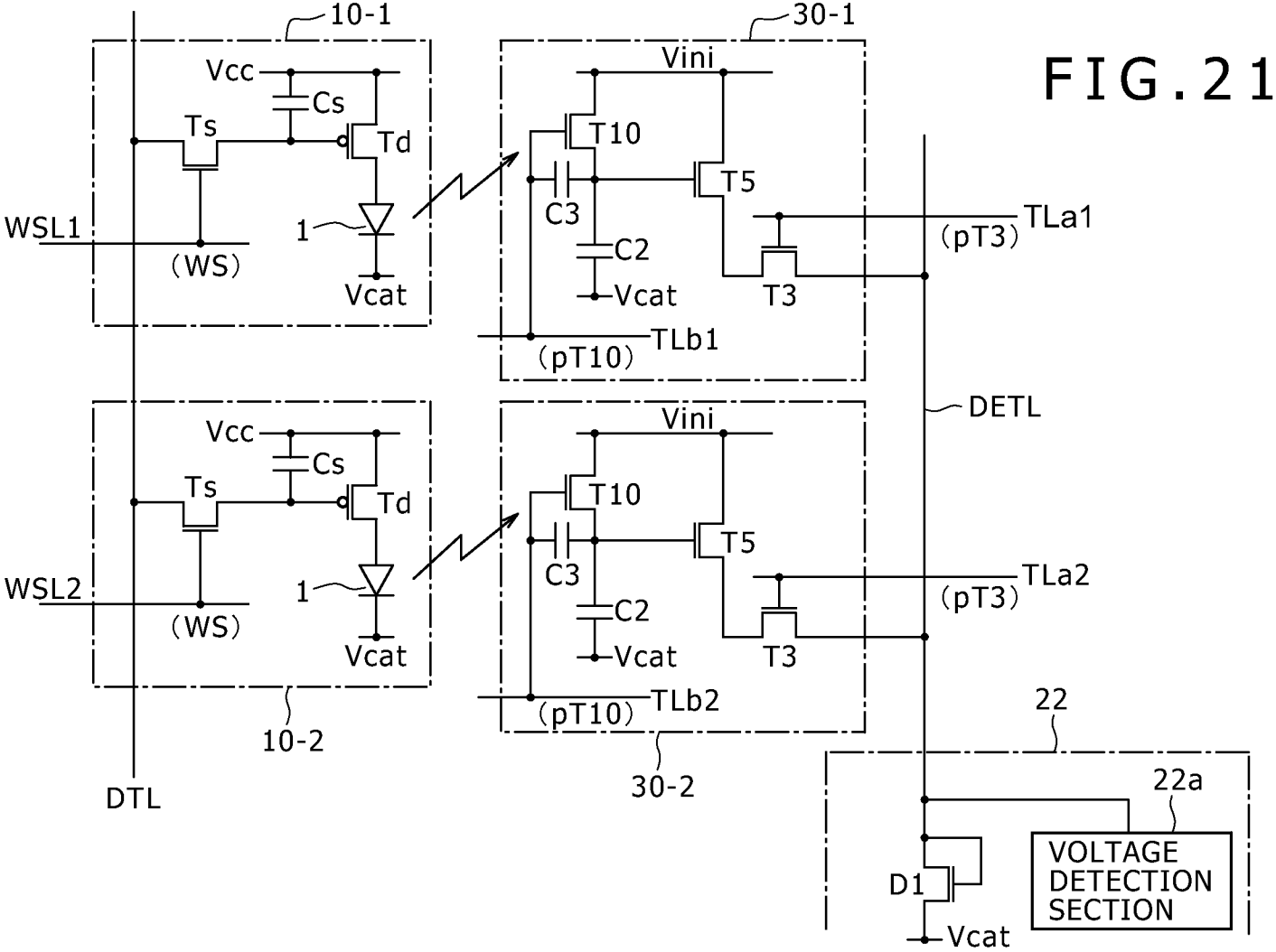
FIG. 21 is a circuit diagram showing a pixel circuit and a light detection section shown in FIG. 20.

FIG. 21 shows a configuration of a pixel circuit 10 and the light detection section 30.

It is to be noted that FIG. 21 shows two pixel circuits 10, that is, 10-1 and 10-2, connected to the same signal line DTL, and two light detection sections 30, that is, 30-1 and 30-2, corresponding to the pixel circuits 10-1 and 10-2, respectively, and connected to the same light detection line DETL. In the following description, except where distinction is required particularly, they are referred to collectively as "pixel circuits 10" and "light detection sections 30."

The circuit configuration of the pixel circuits 10 is similar to that described hereinabove with reference to FIG. 3. As described hereinabove, the configuration of the pixel circuits 10 is not limited to that shown in the drawings.

A detection signal outputting circuit as a light detection section 30 in the second embodiment includes a sensor serving transistor T10, capacitors C2 and C3, a detection signal outputting transistor T5 in the form of an n-channel TFT, and a switching transistor T3. In short, as a component, the capacitor C3 is additionally provided to the components in the first embodiment described hereinabove.

The sensor serving transistor T10 is connected between a power supply line (hereinafter referred to simply as "reference potential Vini") having a fixed reference potential Vini and the gate of the detection signal outputting transistor T5. The sensor serving transistor. T10 not only is switched between an on state and an off state so as to function as a switching element but also functions as a light sensor in the off state thereof similarly as in the first embodiment described hereinabove.

The sensor serving transistor T10 is disposed so as to detect light emitted from the organic EL element 1. Then, in the off state, the leak current of the sensor serving transistor T10 increases or decreases in response to the amount of received light by the sensor serving transistor T10. In particular, if the emitted light amount of the organic EL element 1 is great, then the increasing amount of the leak current is great, but if the emitted light amount of the organic EL element 1 is small, then the increasing amount of the leak current is small.

Further, the sensor serving transistor T10 is connected at the gate thereof to a control line TLb (in FIG. 21, the sensor serving transistors T10 are connected at the gate thereof to the control lines TLb1 and TLB2). Accordingly, the sensor serving transistors T10 are turned on/off with a control pulse pT10 of the detection operation control section 21 shown in FIG. 20. When the sensor serving transistor T10 is turned on, the reference potential Vini is inputted to the gate of the detection signal outputting transistor T5.

The capacitor C2 is connected between the cathode potential Vcat and the gate of the detection signal outputting transistor T5.

The capacitor C3 is connected to the gate of the detection signal outputting transistor T5 and the gate of the sensor serving transistor T10.

The detection signal outputting transistor T5 is connected at the drain thereof to the reference potential Vini and at the source thereof to the switching transistor T3.

The switching transistor T3 is connected between the source of the detection signal outputting transistor T5 and the light detection line DETL. The switching transistor T3 is connected at the gate thereof to the control line TLa, in FIG. 21, to the control line TLa1 or TLa2 and accordingly is turned on/off with the control pulse pT3 of the detection operation control section 21 shown in FIG. 20.

When the switching transistor T3 is turned on, current flowing to the detection signal outputting transistor T5 is outputted to the light detection line DETL.

The light detection driver 22 includes a voltage detection section 22*a* for detecting the potential of each of the light detection lines DETL. The voltage detection section 22*a* detects a detection signal voltage outputted from the light detection section 30 and supplies the detection signal voltage as emitted light amount information, that is, information of luminance degradation, of the organic EL element 1 to the horizontal selector 11 shown in FIG. 20, particularly to the signal value correction section 11*a*.

Further, similarly as in the case described hereinabove with reference to FIG. 10, the diode D1 in the form of, for example, a transistor having a diode connection is connected to the light detection line DETL so as to provide a current path to a fixed potential such as, for example, the cathode potential Vcat.

4-2. Light Detection Operation

A light detection operation of the second embodiment is described. It is to be noted that the detection period may be such as described hereinabove with reference to FIGS. 11A and 11B or 12A and 12B.

Figure 22:
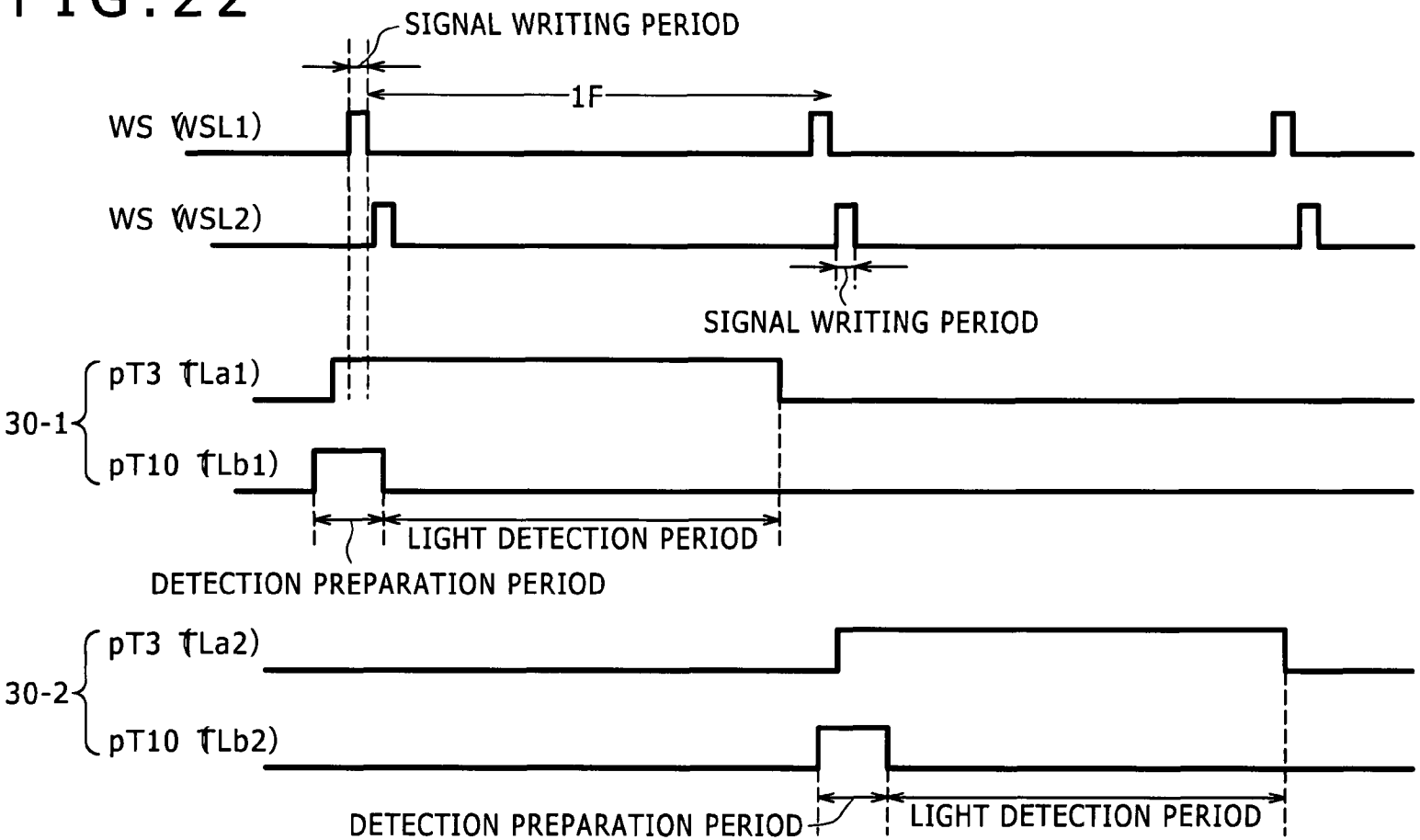
FIG. 22 is a waveform diagram illustrating a light detection period by the light detection section shown in FIG. 20.

FIG. 22 illustrates a scanning pulse WS to the pixel circuits 10-1 and 10-2, control pulses pT3 and pT10 to the light detection section 30-1, and control pulses pT3 and pT10 to the light detection section 30-2. For example, as seen in FIGS. 11A and 11B, light detection is carried out for every one line after the normal image display ends or at some other timing, and a single detection operation is carried out within one frame.

In particular, while, in the pixel circuit 10-1, writing of the signal value Vsig is carried out to carry out emission of light for one frame at a certain timing, at this time, in the light detection section 30-1, detection preparation and light detection are carried out with the control pulses pT3 and pT10.

Within a next frame period, writing of the signal value Vsig is carried out to carry out emission of light for one frame at a certain timing by the pixel circuit 10-2, and at this time, the light detection section 30-2 carries out detection preparation and light detection with the control pulses pT3 and pT10, respectively.

A light detection operation is described with reference to FIGS. 23 to 28 with attention paid to the pixel circuit 10-1 and the light detection section 30-1.

Figure 23:
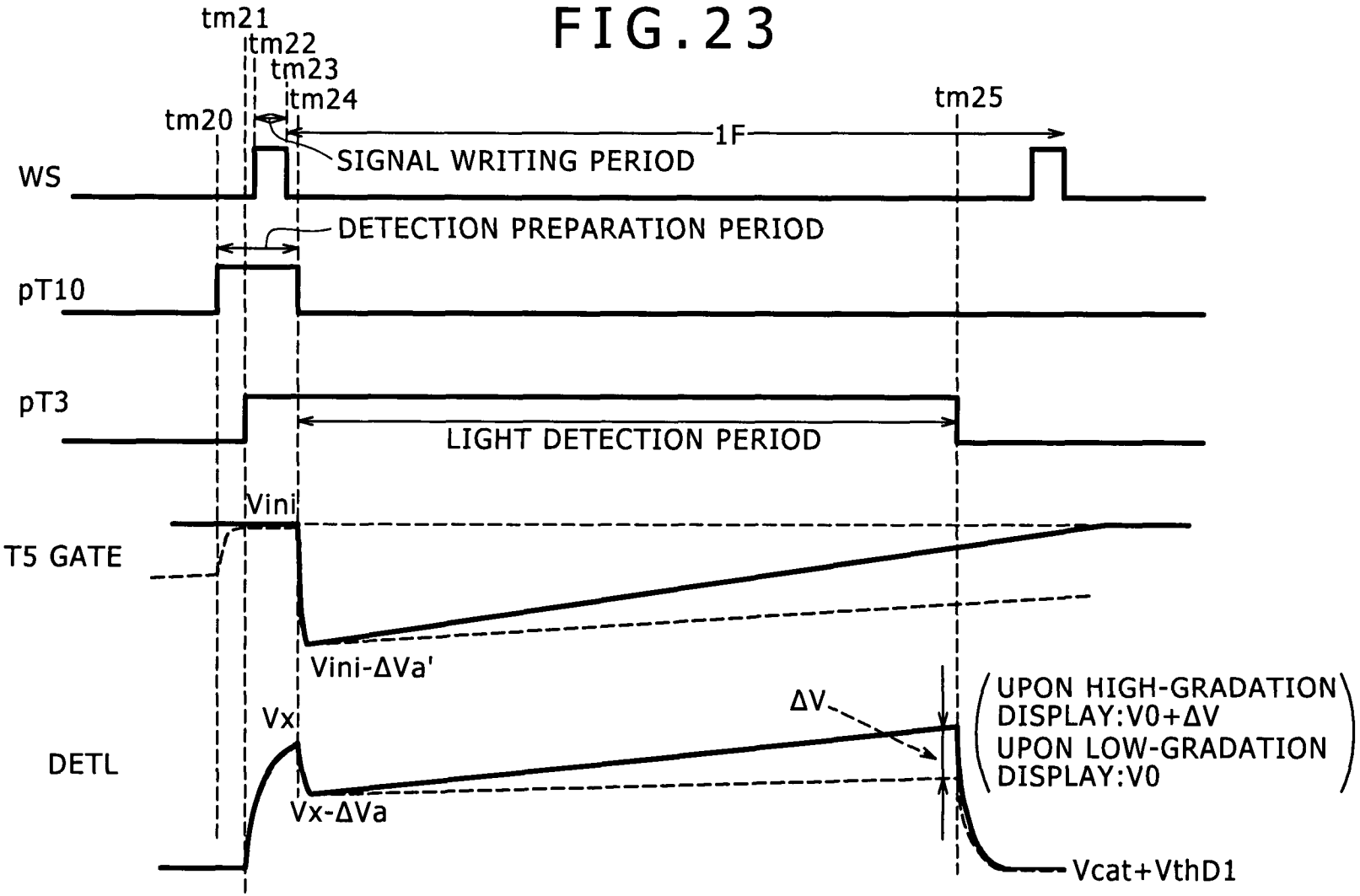
FIG. 23 is a waveform diagram illustrating light detection operation by the light detection section shown in FIG. 20.

FIG. 23 illustrates the scanning pulse WS to be supplied from the write scanner 12 to the pixel circuit 10-1, particularly to the sampling transistor Ts, as a waveform regarding operation of the light detection section 30-1.

FIG. 23 further illustrates the control pulses pT10 and pT3 to be applied to the control lines TLb1 and TLa1, respectively. The sensor serving transistor T10 of the light detection section 30 is turned on/off with the control pulse pT10. Meanwhile, the switching transistor T3 of the light detection section 30 is turned on/off with the control pulse pT3.

Further, FIG. 23 illustrates also the gate voltage of the detection signal outputting transistor T5 and the voltage appearing on the light detection line DETL.

To the light detection section 30-1, the detection operation control section 21 sets the control pulse pT10 to the H level at time tm20 to turn on the sensor serving transistor T10. Further, at time tm21, the control pulse pT3 is set to the H level to turn on the switching transistor T3. A state at this time is illustrated in FIG. 24.

Since the sensor serving transistor T10 is connected to the reference potential Vini, when the sensor serving transistor T10 is turned on at time tm20, the reference potential Vini is inputted to the gate of the detection signal outputting transistor T5. Then, when the switching transistor T3 is turned on, the source of the detection signal outputting transistor T5 is connected to the light detection line DETL.

Figure 24:
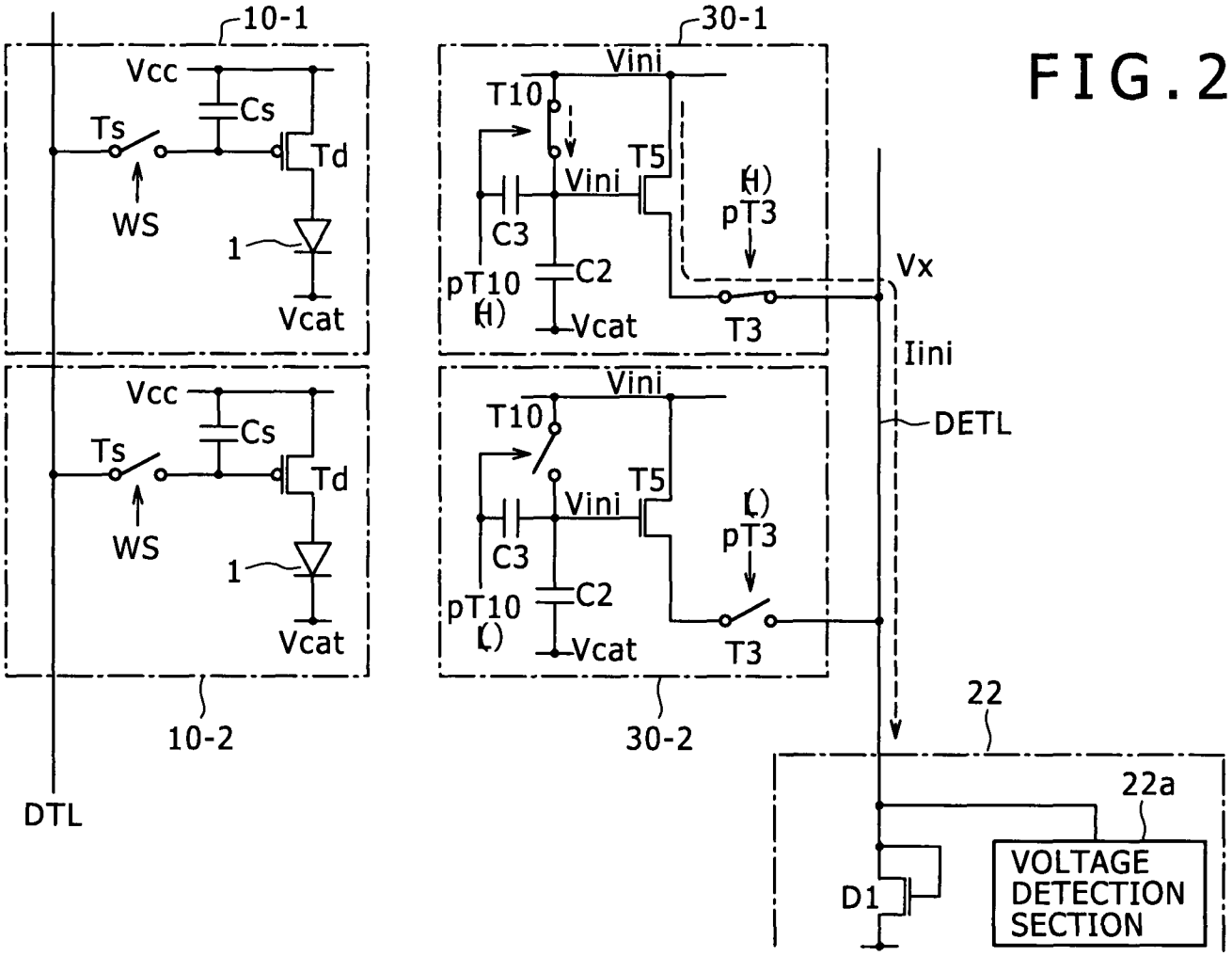
FIGS. 24 to 28 are equivalent circuit diagrams illustrating operation upon light detection by the light detection section shown in FIG. 20.

At this time, if the reference potential Vini has a value for supplying current to the detection signal outputting transistor T5, then current Iini flows as seen in FIG. 24 and the light detection line DETL has a certain potential Vx.

In particular, the reference potential Vini is determined so as to satisfy a condition that it is higher than the sum of the threshold voltage VthT5 of the detection signal outputting transistor T5, the threshold voltage VthD1 of the diode D1 connected to the light detection line DETL and a power supply connected to the source of the diode D1 such as, for example, the cathode potential Vcat. In short, the current Iini flows under the condition of Vini>VthT5+VthD1+Vcat.

Within a period from time tm22 to time tm23 of FIG. 23, writing of the signal value Vsig into the pixel circuit 10-1 is carried out for a display for a one-frame period.

Figure 25:
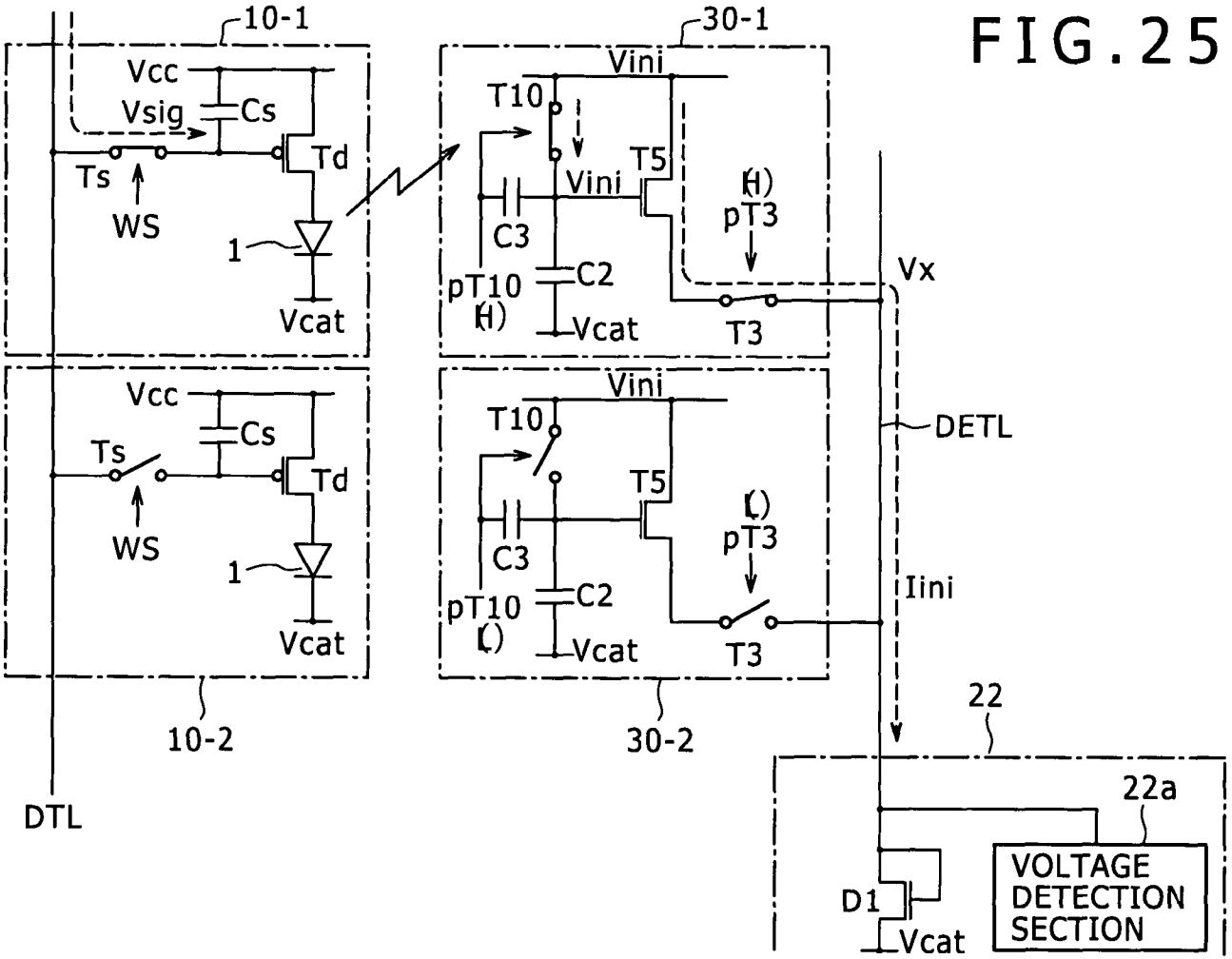

In particular, within a signal writing period of FIG. 23, the scanning pulse WS is set to the H level to render the sampling transistor Ts conducting. At this time, the horizontal selector 11 provides the signal value Vsig of, for example, the white display gradation to the signal line DTL. Consequently, the organic EL element 1 in the pixel circuit 10 emits light in response to the signal value Vsig. A state at this time is illustrated in FIG. 25.

At this time, since the sensor serving transistor T10 is on, the gate voltage of the detection signal outputting transistor T5 remains the reference potential Vini. Also the potential of the light detection line DETL remains the potential Vx and does not vary.

After the signal writing ends, the sampling transistor Ts in the pixel circuit 10-1 is turned off at time tm23.

Figure 26:
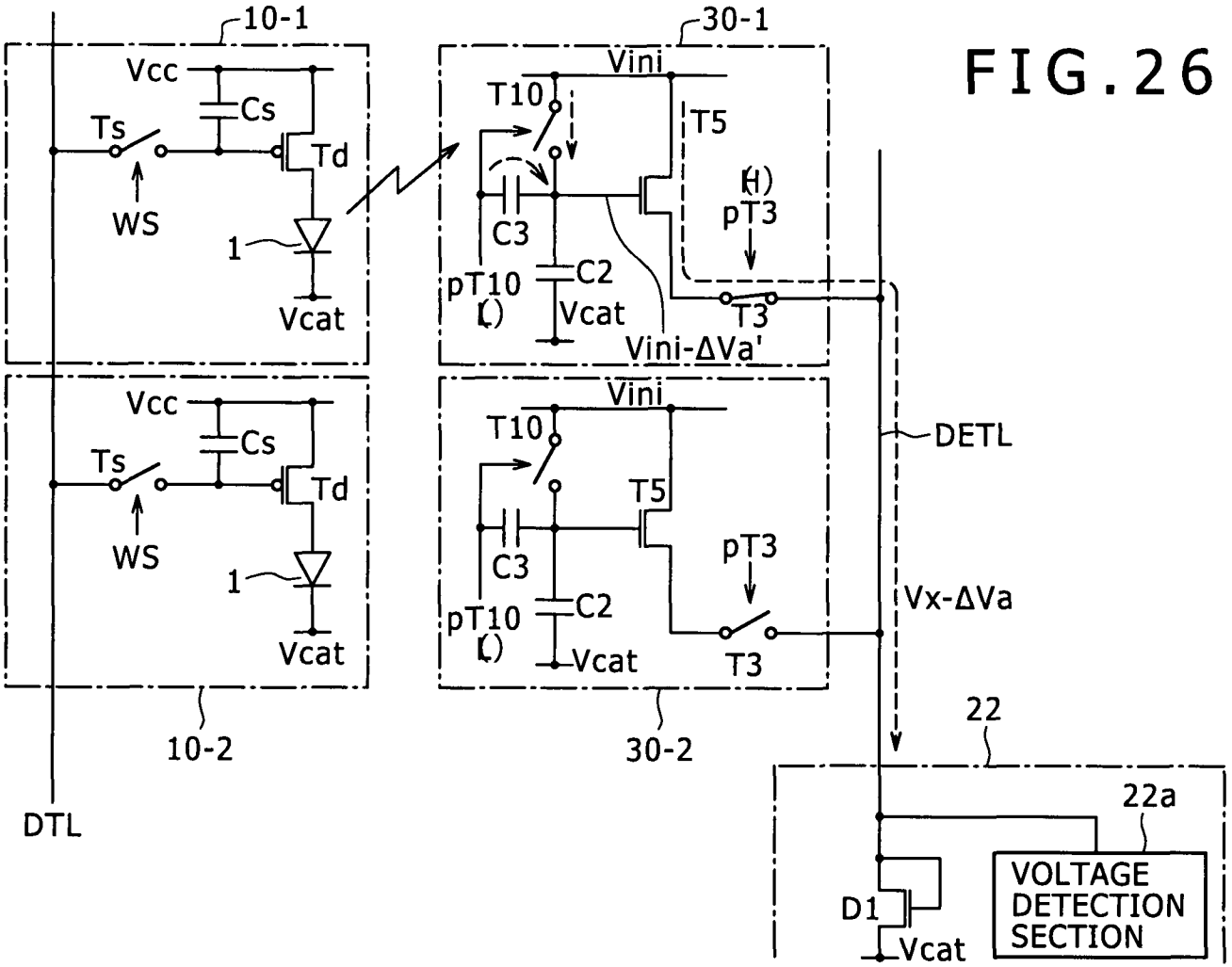

In the light detection section 30-1, the control pulse pT10 is set to the L level to turn off the sensor serving transistor T10 at time tm24. A state at this time is illustrated in FIG. 26.

In this instance, the voltage of the control pulse pT10 applied to the gate of the sensor serving transistor T10 varies from the high potential (H) to the low potential (L), and this voltage variation is applied to the gate of the detection signal outputting transistor T5 through the capacitor C3. Consequently, the gate potential of the detection signal outputting transistor T5 varies from the reference potential Vini to a potential of Vini−Δva'. Here, "−Δva'" is a gate voltage dropping amount provided by the voltage variation from the H level to the L level of the control pulse pT10 and the capacitance ratio between the capacitors C3 and C2.

The potential Vini−ΔVa' is set such that it is higher than the sum of the threshold voltage VthT5 of the detection signal outputting transistor T5, the threshold voltage VthD1 of the diode D1 and the power supply (Vcat) connected to the source of the diode D1 as described hereinabove. In other words, the reference potential Vini, capacitors C2 and C3 and so forth are designed so as to satisfy Vini−ΔVa'>VthT5+VthD1+Vcat. Consequently, the current Iini flows and the potential of the light detection line DETL varies from Vx to Vx−ΔVa. Here, "−ΔVa" is a potential variation amount of the light detection line DETL corresponding to the variation "−ΔVa'" of the gate voltage of the detection signal outputting transistor T5.

By such coupling when the sensor serving transistor T10 is off as described above, a potential difference ΔVa' appears between the drain and the source of the sensor serving transistor T10.

If this potential difference ΔVa' is great, then the sensor serving transistor T10 varies the leak current thereof depending upon the amount of light received thereby and varies the gate potential of the detection signal outputting transistor T5.

Figure 27:
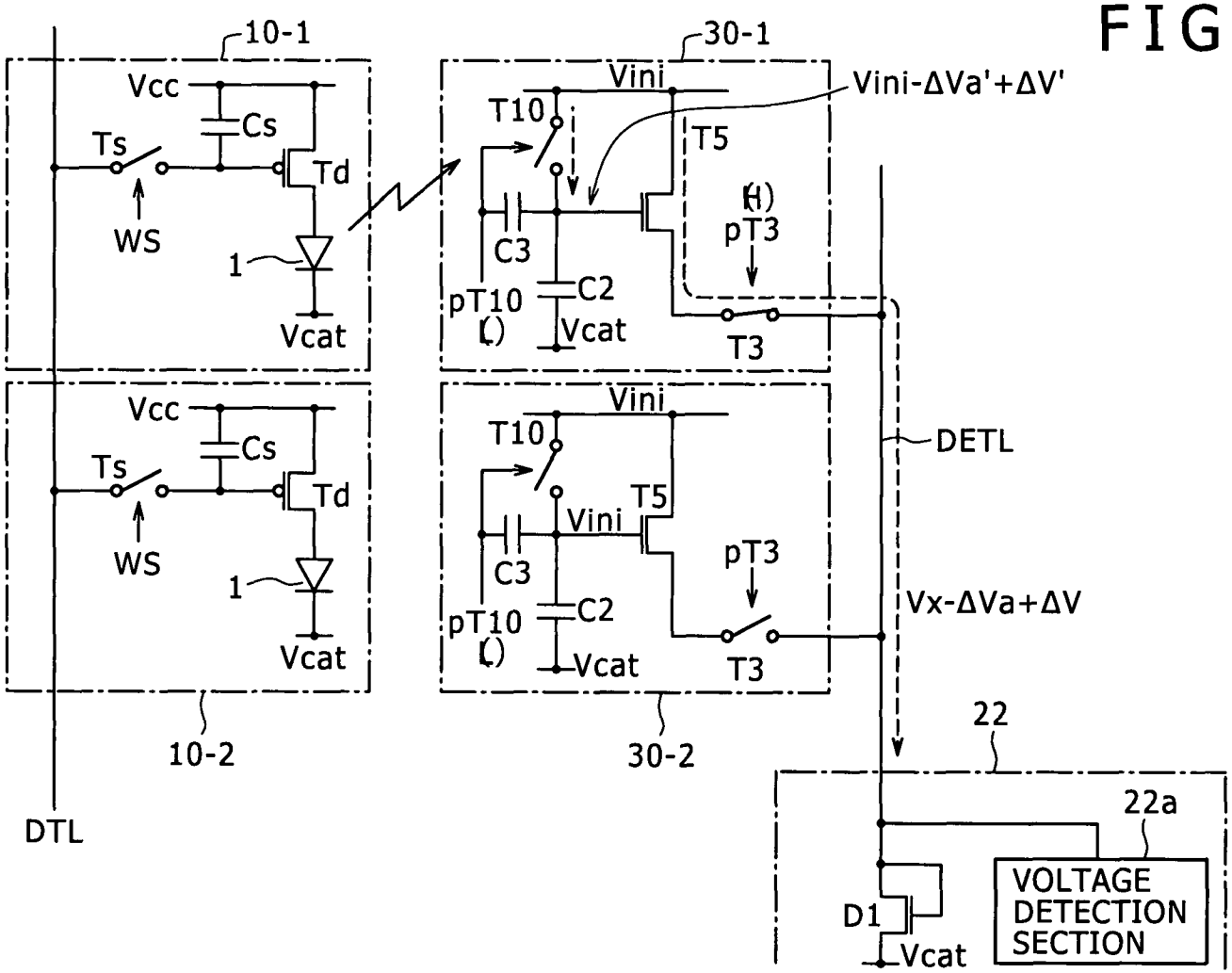

By the operations described above, the gate potential of the detection signal outputting transistor T5 becomes Vini−ΔVa'+ΔV' as seen in FIG. 27 after lapse of a fixed interval of time. The "+ΔV'" is a variation amount of the gate potential of the detection signal outputting transistor T5 caused by the leak current flowing to the sensor serving transistor T10 in an off state. By the variation of the gate potential of the detection signal outputting transistor T5, also the potential of the light detection line DETL becomes Vx−ΔVa+ΔV.

FIG. 23 illustrates a manner wherein the gate potential of the detection signal outputting transistor T5 rises, after time tm24, from Vini−ΔVa' to Vini−ΔVa'+ΔV' and the potential of the light detection line DETL rises from Vx−ΔVa to Vx−ΔVa+ΔV.

Where the potential of the light detection line DETL in a low gradation displaying state, that is, in the black displaying state, is represented by V0, the potential V0 is given by V0=Vx−ΔVa. Thus, since the amount of current flowing to the sensor serving transistor T10 increases as the amount of light received by the sensor serving transistor T10 increases, the voltage of the light detection line DETL in a high gradation displaying state is higher than the voltage in the low gradation displaying state, which is V0+ΔV.

This potential variation of the light detection line DETL is detected by the voltage detection section 22*a*. The detected voltage corresponds to the amount of light emitted from the organic EL element 1.

In other words, the emitted light luminance can be detected from the potential ΔV. Further, if a display of a particular gradation such as, for example, the white gradation is executed by the pixel circuit 10, then the detected potential represents the degree of degradation of the organic EL element 1.

Figure 28:
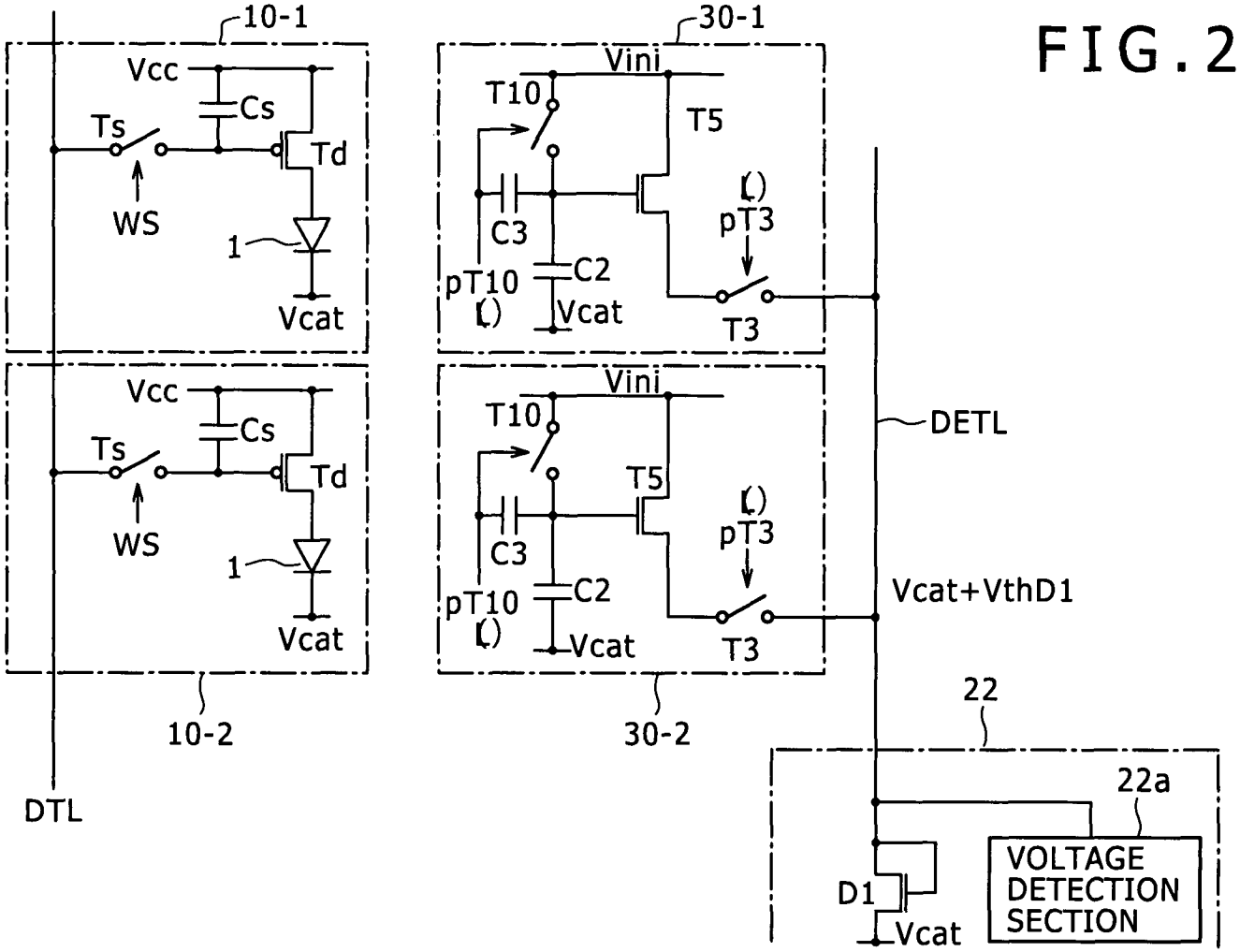

After lapse of a fixed period of time, the control pulse pT3 is set to the L level at time tm25, and the switching transistor T3 is turned off to end the detection operation as seen in FIG. 28. Consequently, supply of current to the light detection line is stopped, and the potential of the light detection line varies to Vcat+VthD1. It is to be noted that VthD1 is the threshold voltage of the diode D1.

Detection regarding the pixel circuits 10 of a pertaining line, for example, within one frame is carried out in such a manner as described above.

Further, after the switching transistor T3 is turned off, the gate potential of the detection signal outputting transistor T5 gradually rises and finally becomes equal to the reference potential Vini.

In the second embodiment having such a configuration as described above, the light detection section 30 can be formed from three transistors (T3, T5 and T10) and two capacitors (C2 and C3) as well as two control lines (TLa and TLb) and one fixed power supply (reference potential Vini).

Particularly, the power supply line is configured such that it supplies not pulse power of the reference potential Vini/power supply voltage Vcc but the fixed reference potential Vini to the sensor serving transistor T10.

In the first embodiment, the power supply line VL supplies pulse power of the reference potential Vini/power supply voltage Vcc so that, when the sensor serving transistor T10 is off, a potential difference appears between the drain and the source of the sensor serving transistor T10 so as to generate leak current. In contrast, in the second embodiment, the potential variation "−ΔVa'" described hereinabove is generated by the capacitors C2 and C3 so that a potential difference may appear between the drain and the source of the sensor serving transistor T10 thereby to generate leak current.

In the present second embodiment, not only a countermeasure against a drawback in picture quality such as a screen burn can be taken similarly as in the case of the first embodiment, but also the number of control lines to the light detection section 30 can be reduced. In short, while the reference potential Vini is provided as a power supply, there is no necessity to provide a pulse power supply voltage. Accordingly, it is necessary for the detection operation control section 21 to include drivers for the control pulses pT3 and pT10 to the control lines TLa and TLb, but the driver for the power supply line VL in the first embodiment is not required. Consequently, simplification and reduction of the cost of the configuration can be implemented.

Further, the two capacitors C2 and C3 in the light detection section 30 have a role of retaining the gate potential of the detection signal outputting transistor T5 similarly to the capacitor C2 in the first embodiment. Therefore, the capacitors C2 and C3 need not have an increased capacitance, but the sum value of the capacitors C2 and C3 may be set substantially equal to the capacitor C2 in the first embodiment. Therefore, even if the number of capacitors increases, the yield does not drop significantly.

It is to be noted that, while the present invention is applied to the pixel circuit 10 wherein the organic EL element 1 emits light simultaneously with image signal writing, it can be applied also to a pixel circuit wherein emission and non-emission of light are controlled by a switch or a power supply line. In this instance, even if, when no light is emitted, a light detection preparation operation is carried out and, after the sensor serving transistor T10 is turned off, a light emitting operation starts to carry out a light detection operation, light detection can be carried out without any problem.

4-3. Modifications to the Second Embodiment

Several modifications to the second embodiment described above are described below.

First, a modification I is described with reference to FIGS. 29 and 30. It is to be noted that the present modification I has a circuit configuration similar to that described above with reference to FIG. 21 but is different in control timings.

Figure 29:
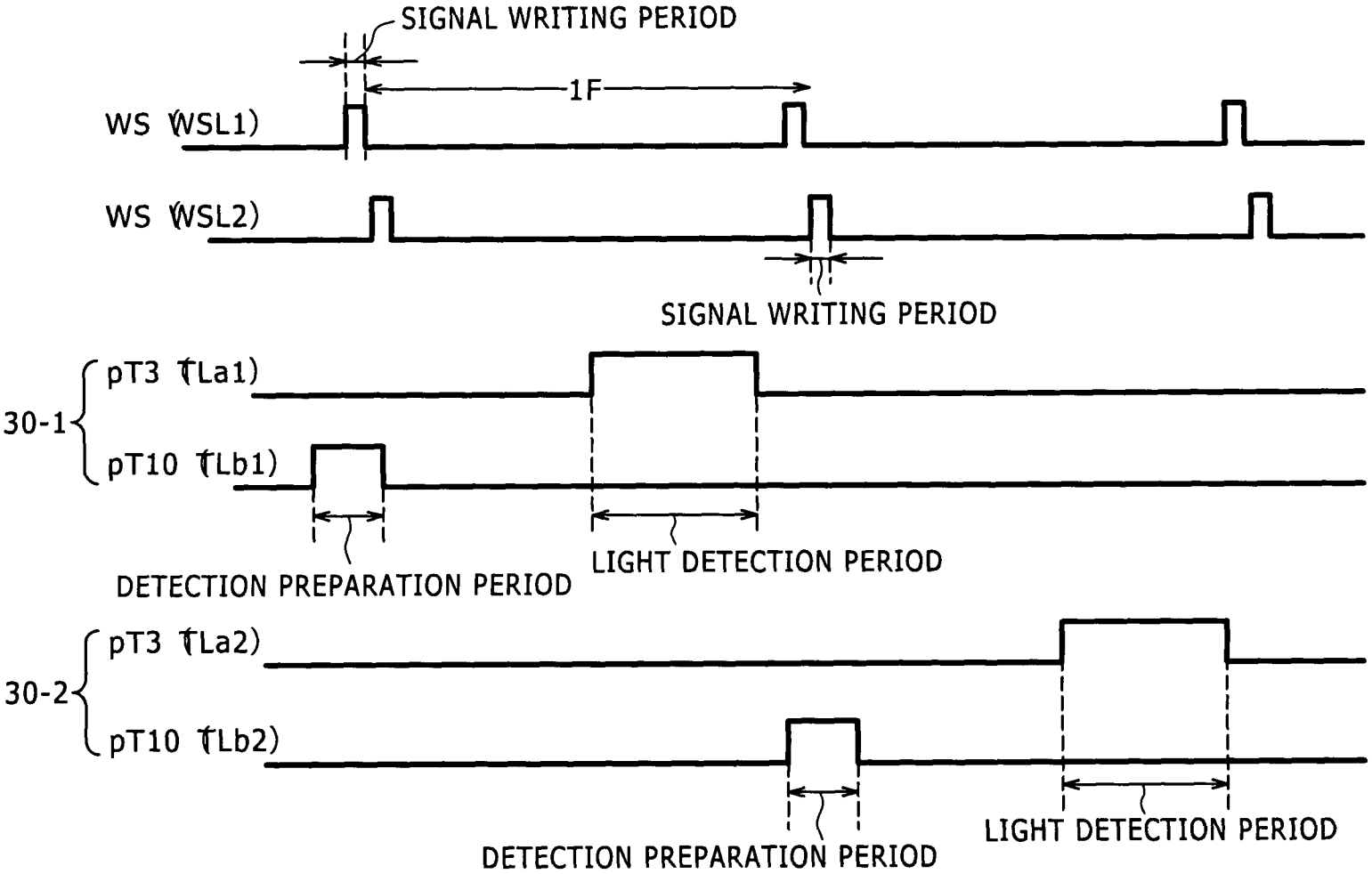
FIG. 29 is a waveform diagram illustrating a light detection period by a modification I to the second embodiment.
Figure 30:
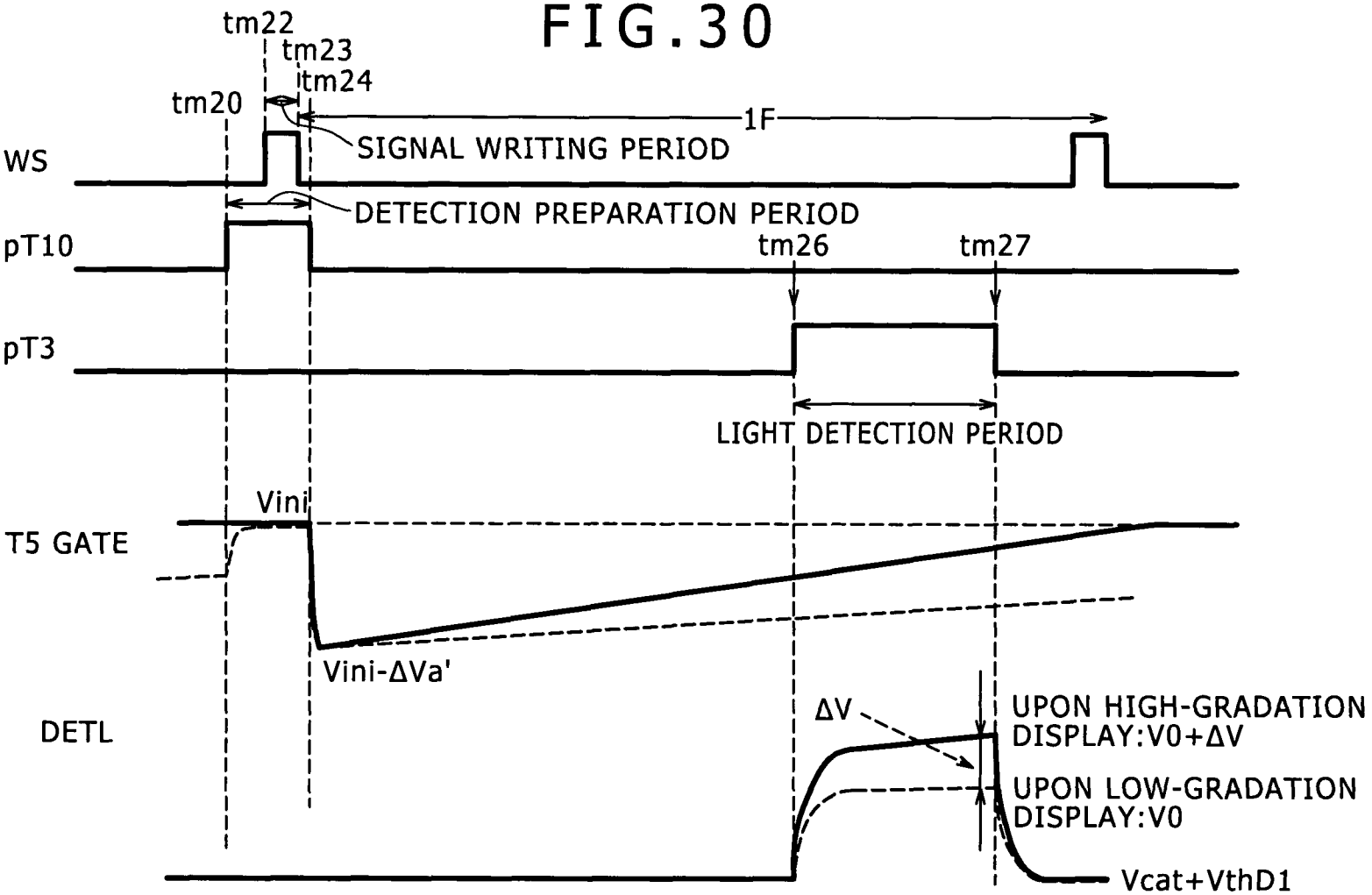
FIG. 30 is a waveform diagram illustrating a light detection operation of the modification I to the second embodiment.

FIGS. 29 and 30 illustrate signal waveforms similarly to FIGS. 21 and 22.

In the signal waveforms of FIG. 22, part of a period within which the control pulse pT3 has the H level overlaps with part of a period within which the control pulse pT10 has the H level. In contrast, in the signal waveforms of FIG. 29, a period within which the control pulse pT3 has the H level does not overlap in time with a period within which the control pulse pT10 has the H level.

In other words, a period within which the sensor serving transistor T10 is on, that is, a detection preparation period, and a period within which the switching transistor T3 is on, that is, a light detection period, are different periods from each other without overlapping with each other in time.

The light detection operation is described with reference to FIG. 30.

At time tm20, the control pulse pT10 is placed into the H level to turn on the sensor serving transistor T10, and consequently, the gate voltage of the detection signal outputting transistor T5 becomes equal to the reference potential Vini.

Within a period from time tm22 to tm23, the scanning pulse WS is on and the signal value Vsig is written into the pixel circuit 10.

Thereafter, at time tm24, the control pulse pT10 is placed into the L level to turn off the sensor serving transistor T10. Thereupon, by coupling through the capacitor C3 which appears at the timing at which the sensor serving transistor T10 is turned off, the gate voltage of the detection signal outputting transistor T5 drops to the reference potential Vini−ΔVa'.

By the potential difference ΔVa' between the drain and the source of the sensor serving transistor T10 which appears thereupon, light leak current flows from the reference potential Vini line through the sensor serving transistor T10. Accordingly, the gate voltage of the detection signal outputting transistor T5 varies in response to the amount of light received by the sensor serving transistor T10.

At time tm26 after lapse of a fixed interval of time, the control pulse pT3 is placed into the H level to turn on the switching transistor T3.

As the switching transistor T3 turns on, the potential of the light detection line DETL varies in response to current flowing to the detection signal outputting transistor T5. In particular, as seen in FIG. 30, the potential of the light detection line DETL rises in response to the gate potential of the detection signal outputting transistor T5 after time tm26.

Since the value of the gate potential of the detection signal outputting transistor T5 at this time exhibits a variation depending upon the amount of light received by the sensor serving transistor T10 as described above, also the current flowing from the reference potential Vini line through the detection signal outputting transistor T5 is influenced by the variation of the value of the gate potential of the detection signal outputting transistor T5. In particular, the detection voltage when the luminance of light of the organic EL element 1 is high is higher than the detection voltage when the luminance of light of the organic EL element 1 is low.

Accordingly, the voltage detection section 22*a* can detect the emitted light amount of the organic EL element 1 from the variation amount ΔV from the potential V0 which is the potential of the light detection line DETL in a low gradation displaying state.

Thereafter, at time tm27, the control pulse pT3 is placed into the L level to turn off the switching transistor T3 thereby to end the light detection.

In the present modification I, the period within which through-current flows from the reference potential Vini line to the source potential of the diode D1, for example, to a cathode potential Vcat line, through the light detection line DETL can be reduced to the light detection period from time tm26 to time tm27. As a result, reduction in power consumption of the light detection section 30 can be implemented.

Figure 31:
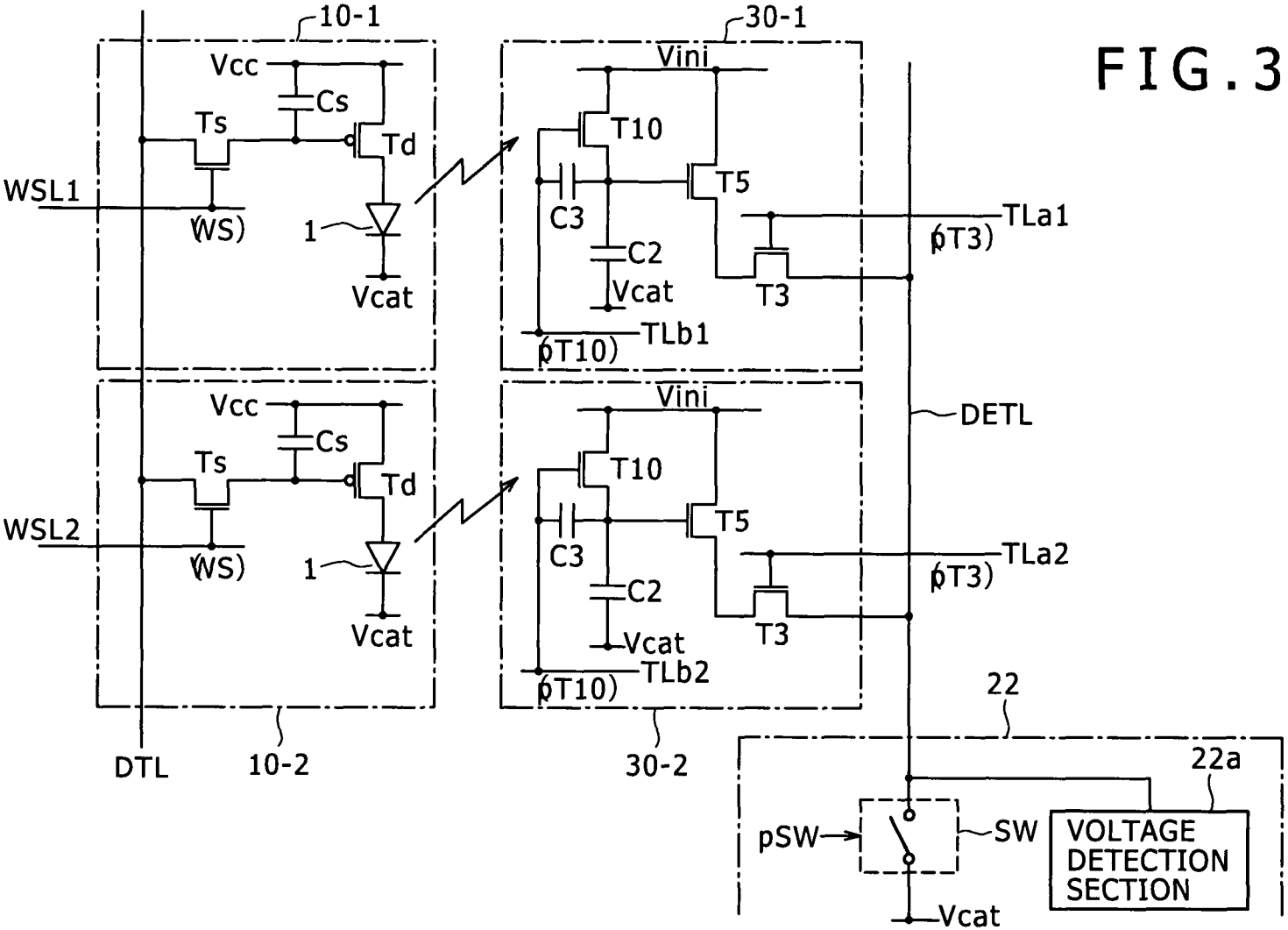
FIG. 31 is a circuit diagram showing a modification II to the second embodiment.

FIG. 31 shows a configuration of a modification II.

In the modification II shown in FIG. 31, the diode D1 connected to the light detection line DETL in the light detection driver 22 is replaced with a switch SW and a fixed power supply such as, for example, the cathode potential Vcat.

The switch SW is controlled on/off with a control signal pSW, for example, from the detection operation control section 21. Also with the configuration described, light amount detection can be carried out similarly.

Figure 32:
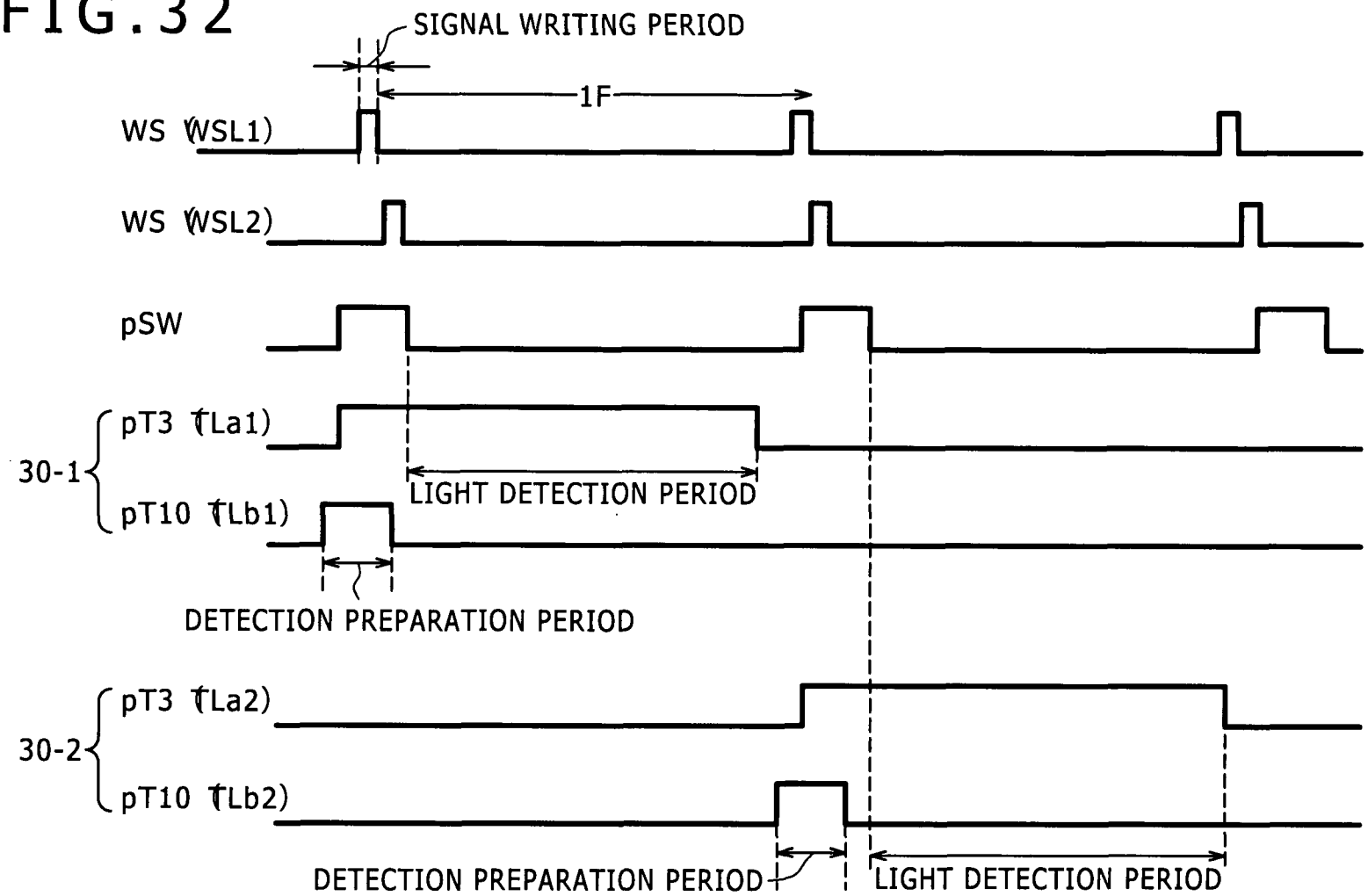
FIG. 32 is a waveform diagram illustrating a light detection period by the modification II to the second embodiment.
Figure 33:
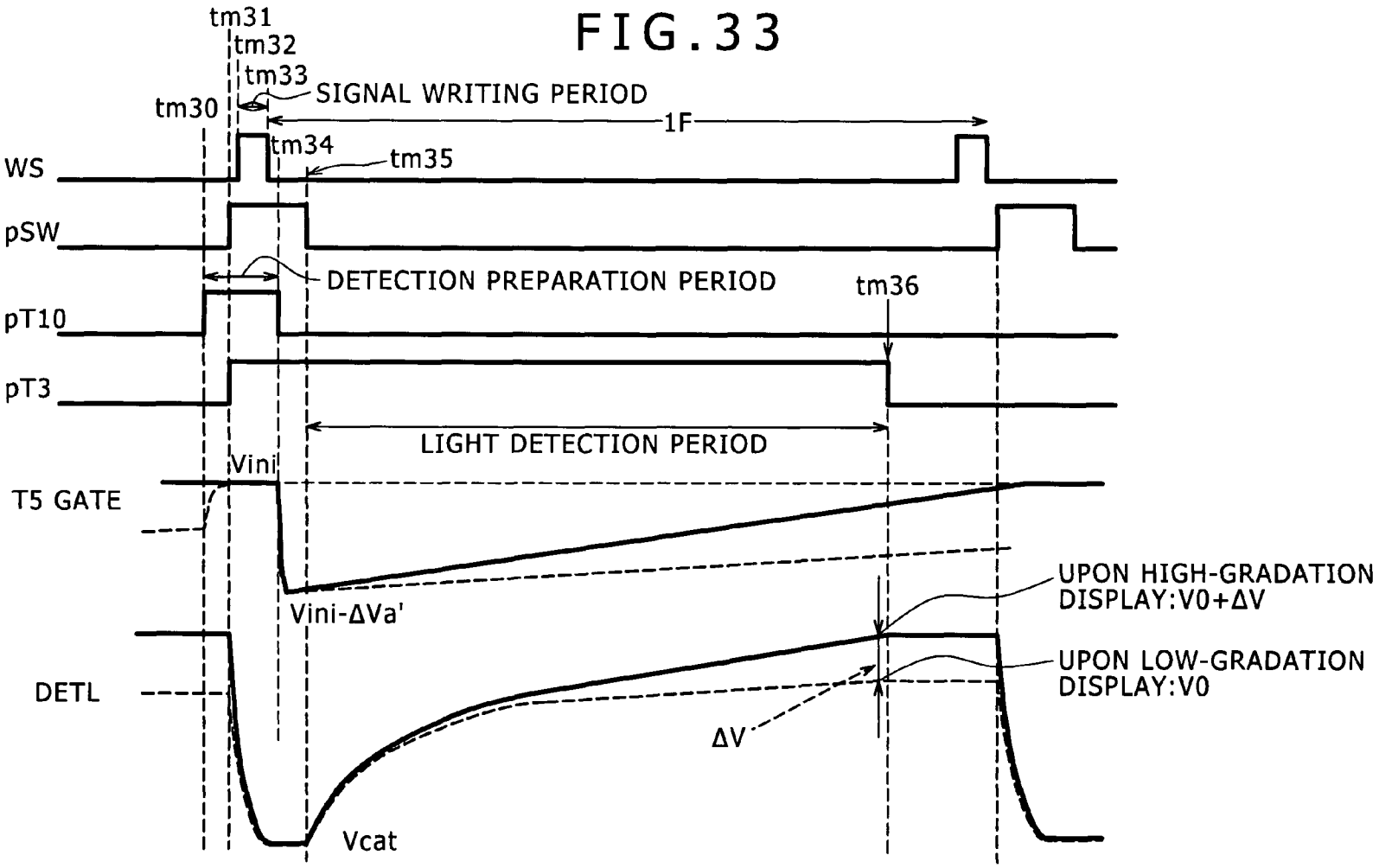
FIG. 33 is a waveform diagram illustrating a light detection operation of the modification II to the second embodiment.

FIGS. 32 and 33 illustrate signal waveforms similar to those in FIGS. 22 and 23 and further illustrate the control signal pSW.

Further, as an example, the light detection operation period is set to one frame (1F). As seen in FIG. 32, a light detection period is executed for each line within a period of one frame as seen in FIG. 32.

The light detection operation is described with reference to FIG. 33.

At time tm30, the sensor serving transistor T10 is turned on with the control pulse pT10 so that the gate voltage of the detection signal outputting transistor T5 becomes equal to the reference potential Vini.

At time tm31, the switching transistor T3 is turned on with the control pulse pT3. Further, the control signal pSW is turned on to charge the light detection line DETL to the cathode potential Vcat. It is assumed that the on-resistance of the switch SW in this instance is so low that it can be ignored. Further, while the initialization potential of the light detection line DETL is the cathode potential Vcat of the organic EL element 1 as an example, the initialization voltage is not limited to this, and for example, a separate power supply may be prepared for the initialization potential.

Within a period from time tm32 to tm33, writing of the signal value Vsig into the pixel circuit 10 is carried out, and then, emission of light by the pixel circuit 10 is carried out.

At this time, the gate-source voltage of the detection signal outputting transistor T5 is set so as to be higher than the threshold voltage of the detection signal outputting transistor T5.

In this state, the sensor serving transistor T10 is turned off with the control pulse pT10 at time tm34. Consequently, the gate voltage of the detection signal outputting transistor T5 changes to Vini−ΔVa'. Further, the source-drain voltage of the sensor serving transistor T10 becomes equal to ΔVa'.

Since the sensor serving transistor T10 is turned off, light leak current flows from the reference potential Vini line through the sensor serving transistor T10, and the gate potential of the detection signal outputting transistor T5 begins to vary in response to the amount of light received by the sensor serving transistor T10.

Thereafter, at time tm35, the switch SW is switched off with the control signal pSW.

At this time, if the gate-source voltage Vgs of the detection signal outputting transistor T5 is higher than the threshold value of the detection signal outputting transistor T5, then the potential of the light detection line DETL begins to rise gradually in a direction in which the threshold value correction of the detection signal outputting transistor T5 is carried out.

After lapse of a fixed period of time, the gate voltage of the detection signal outputting transistor T5 varies from Vini−ΔVa' to Vini−£Va'+ΔV', and together with this, also the potential of the detection line becomes equal to V0+ΔV. At this time, since the amount of current flowing to the sensor serving transistor T10 as a light detection element increases as the amount of light received by the sensor serving transistor T10 increases, the detection voltage in a high gradation displaying state is higher than the voltage in a low gradation displaying state. This voltage variation is detected by the voltage detection section 22*a*.

At time tm36, the control pulse pT3 is set to the L level to turn off the switching transistor T3 thereby to end the light detection period.

Figure 34:
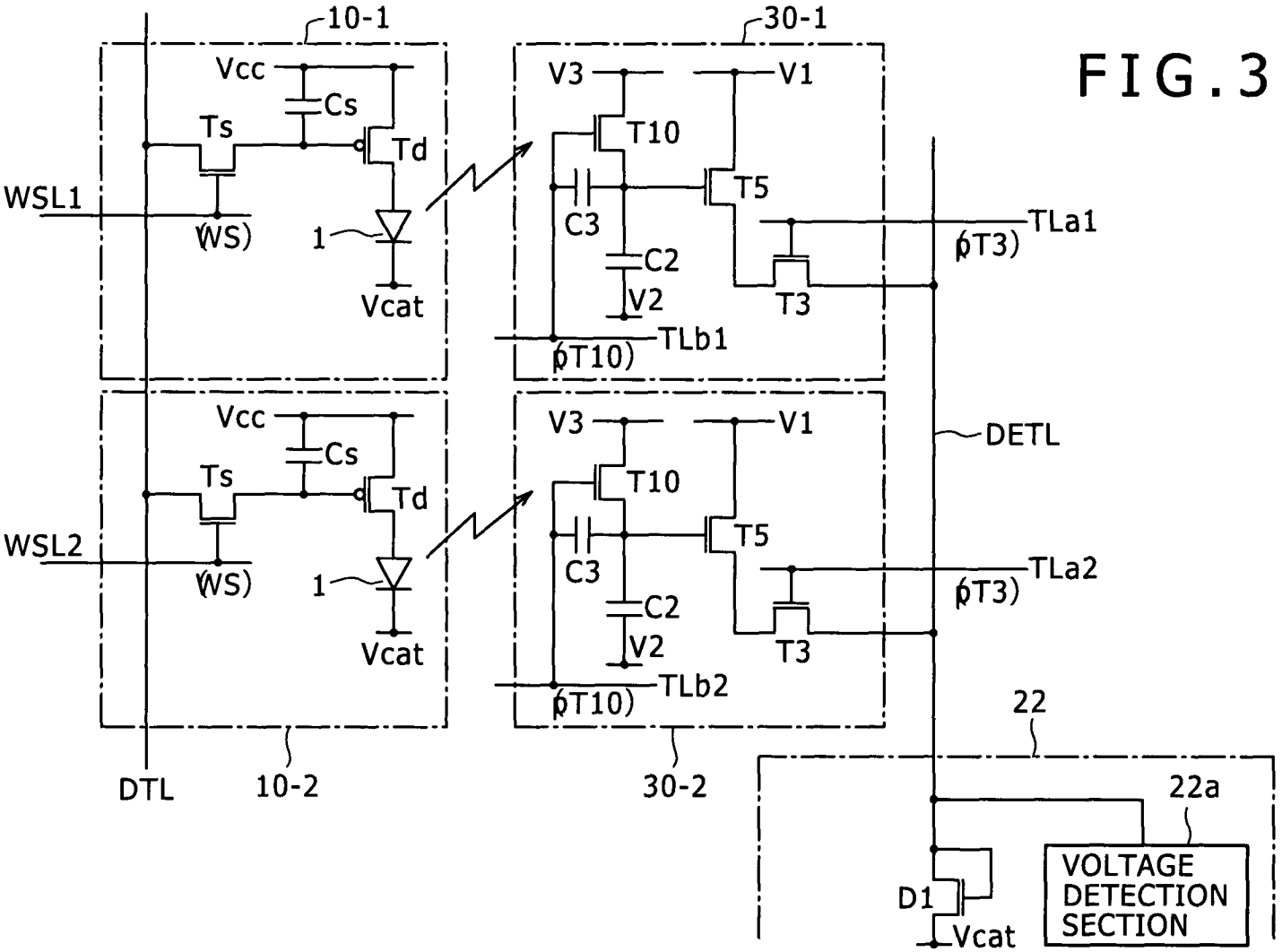
FIG. 34 is a circuit diagram view showing a modification III to the second embodiment.

A modification III is shown in FIG. 34. The configuration of the modification III is different from that described hereinabove with reference to FIG. 21 only in that the power supplies are formed independently of each other.

The detection signal outputting transistor T5 is connected at the drain thereof to a first power supply V1 and connected at the gate thereof to a second power supply V2 through the capacitor C2.

The sensor serving transistor T10 is connected at the drain thereof to a third power supply V3.

In this manner, the power supplies V1, V2 and V3 may be formed as different fixed power supplies independent of each other. The power supply potentials may be designed such that the light detection operation described above can be executed to the end.

It is to be noted that, in the example described as the second embodiment with reference to FIGS. 21 to 28, it can be considered that the power supplies V1, V2 and V3 are set so as to satisfy V1=V3 and Vini and V2=Vcat.

In short, both of the first and third power supplies are set to the fixed reference potential Vini such that, when the sensor serving transistor T10 is placed into an on state, the reference potential Vini is supplied to the gate node of the detection signal outputting transistor T5.

Further, though not shown, the first power supply V1, second power supply V2 and third power supply V3 may be an equal fixed reference potential. Also in this instance, when the sensor serving transistor T10 is placed into an on state, the third power supply V3 which is a reference potential is supplied to the gate node of the detection signal outputting transistor T5.

As a modification IV, light detection in regard to a plurality of lines may be carried out at the same timing, or a plurality of light detection periods for different lines may be overlapped with each other. Since the number of light detection elements can be increased by adopting any of such timing relationships, it is possible to increase the light detection accuracy and further reduce the light detection period.

Figure 35A:
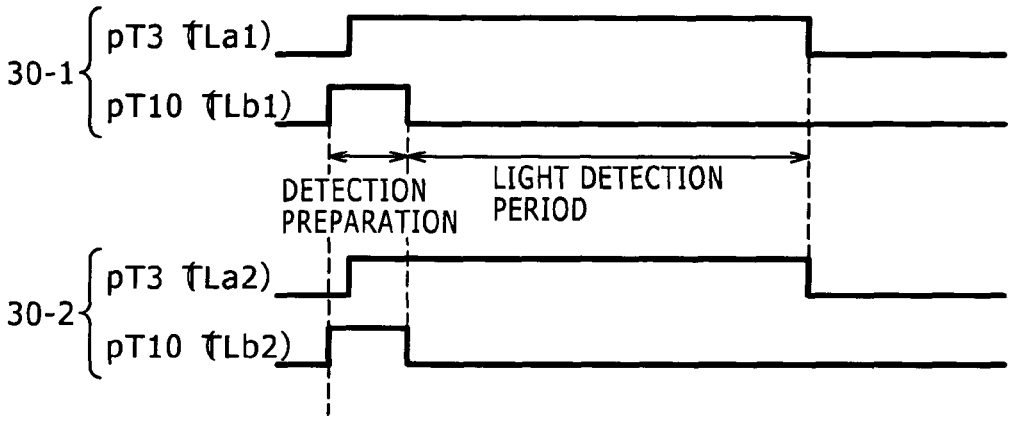
FIGS. 35A and 35B are waveform diagrams illustrating light detection operations of a modification IV to the second embodiment.

FIG. 35A illustrates the control pulses pT3 and pT10 for two lines. For example, by applying such control pulses pT3 and pT10 as shown in FIG. 35A to the light detection sections 30-1 and 30-2, a light detection operation is carried out at the same time by the light detection sections 30-1 and 30-2. For example, when the pixel circuit 10-1 is driven to emit light, the detection operation regarding the luminance of the emitted light is carried out at the same time by the light detection sections 30-1 and 30-2.

By carrying out detection using a plurality of light detection sections 30 in this manner, the light detection accuracy can be increased. Further, since it is possible to accelerate the charging operation for the light detection line DETL with the current Iini to reduce the charging time, also it is possible to reduce the light detection period.

Figure 35B:
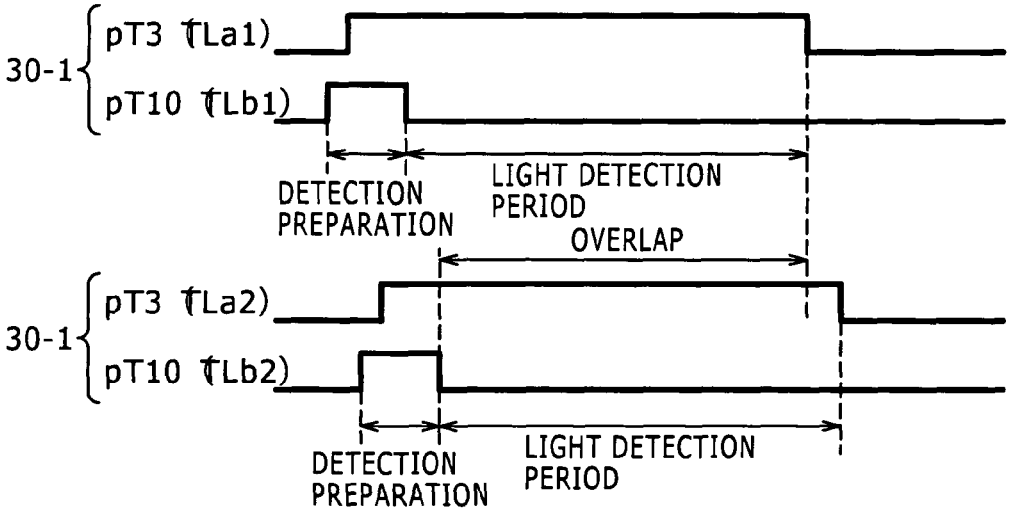

FIG. 35B illustrates an example wherein light detection periods overlap with each other. Also where light detection periods are overlapped with each other without making them fully overlap with each other, improvement of the detection accuracy and reduction of the detection period can be implemented.

Such modifications wherein a plurality of light detection sections output light detection information simultaneously or in a temporarily overlapping relationship with each other as described above may naturally be applied to light detection sections 30 for three or more lines.

Where, when the emitted light luminance of EL elements is detected on a particular line, light detection periods for a plurality of lines are overlapped with each other, it is possible to enhance the light detection sensitivity or to reduce the light detection period or reduce the size of the light detection elements. As a result, enhancement of the yield can be implemented, and besides a countermeasure against a drawback in picture quality by degradation of the efficiency of light emitting elements such as a screen burn can be taken.

5. Applications

Now, applications of the present invention are described.

The present invention can be applied to an electronic apparatus wherein light is irradiated upon a screen from the outside to carry out information inputting.

Figure 36A:
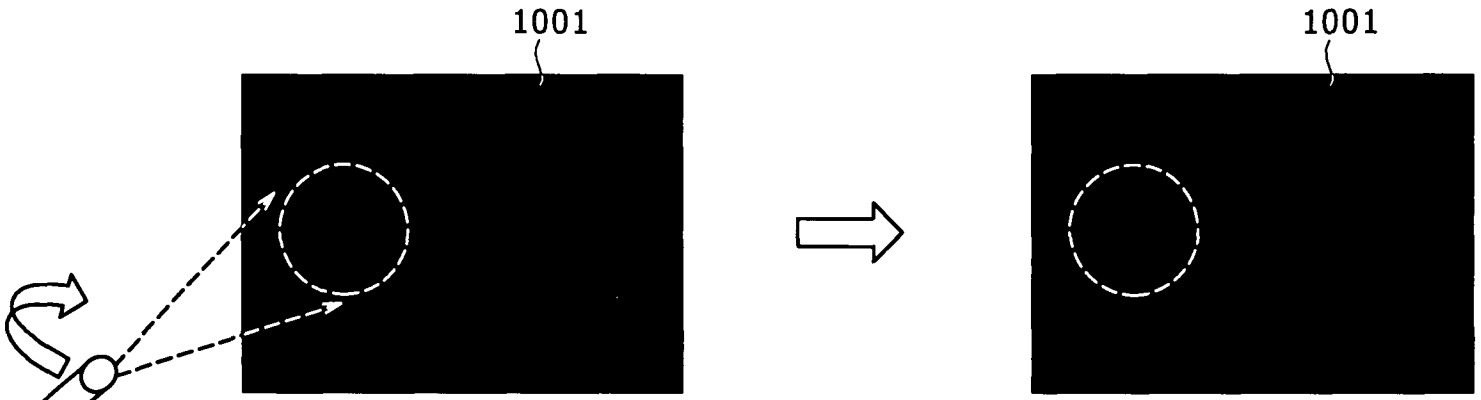
FIGS. 36A and 36B are schematic views showing examples of an application of the present invention.

For example, FIG. 36A illustrates a state wherein a user operates a laser pointer 1000 to direct a laser beam to a display panel 1001.

The display panel 1001 may be any of the organic EL display panels described hereinabove with reference to FIGS. 1 and 20.

For example, while the overall screen displays black, a circle is drawn on the display panel 1001 using the light of the laser pointer 1000. Thus, the circle is displayed on the screen of the display panel 1001.

In particular, the light of the laser pointer 1000 is detected by the light detection sections 30 on the pixel array 20. Then, the light detection sections 30 transmit detection information of the laser light to the horizontal selector 11, particularly to the signal value correction section 11*a*.

The horizontal selector 11 applies the signal value Vsig of a predetermined luminance to the pixel circuits 10 corresponding to the light detection sections 30 by which the laser light is detected.

Consequently, light of a high luminance can be generated from the screen of the display panel 1001 at the irradiated position of the laser light. In short, such a display as to draw a graphic figure, a character, a symbol or the like on the panel can be carried out by laser irradiation.

Figure 36B:
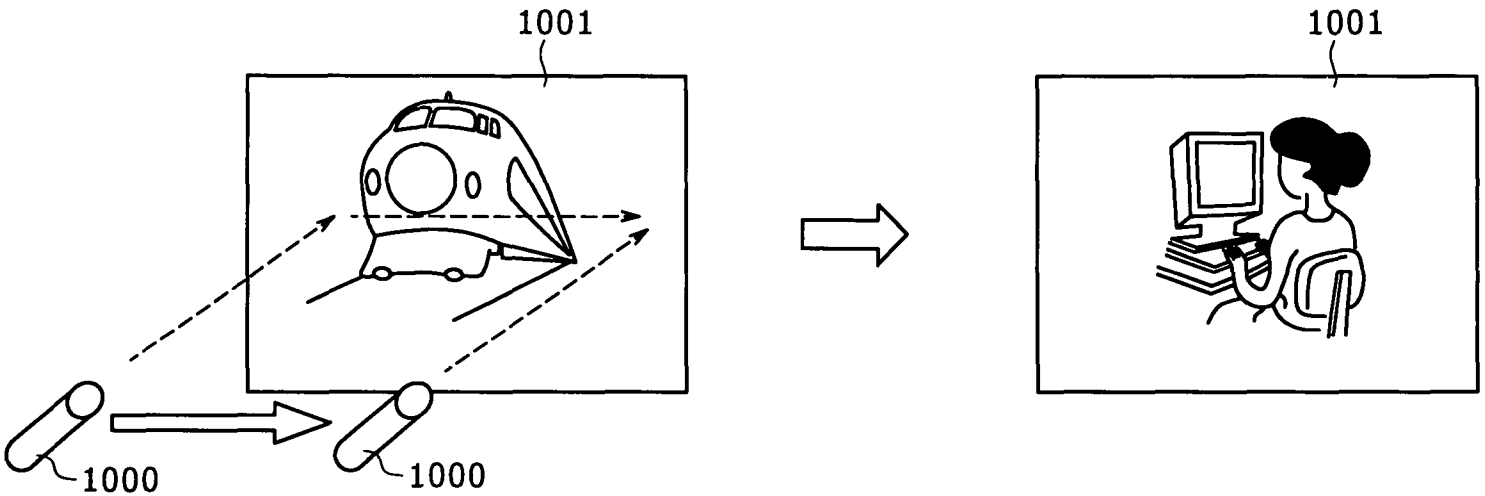

FIG. 36B illustrates an example wherein an input of a direction by the laser pointer 1000 is detected.

Referring to FIG. 36B, a laser beam is irradiated from the laser pointer 1000 such that it moves, for example, from the right to the left. Since the variation of the laser irradiation position on the screen can be detected as a result of detection by the light detection sections 30 on the display panel 1001, it can be detected in which direction the laser light is directed by the user.

For example, changeover of the display contents or the like is carried out so that this direction may be recognized as an operation input.

Naturally, it is possible to recognize the operation contents by directing the laser beam to an operation icon or the like displayed on the screen.

In this manner, it is possible to recognize light from the outside as a coordinate input on the display panel 1001 so as to be applied to various operations and applications.

Further, in such applications to picture drawing or operation inputting as described above, if a plurality of light detection sections 30 output light detection information simultaneously or in a temporarily overlapping relationship with each other as in the modification IV described hereinabove, then the detection capacity of external light can be improved advantageously.

For example, when light provided from the outside is detected, the light detection sensitivity can be enhanced by making light detection periods for a plurality of lines overlap with each other, and it is possible to reduce the light detection period or reduce the size of the light detection elements. As a result, enhancement of the yield can be implemented, and besides a countermeasure against a drawback in picture quality by degradation of the efficiency of light emitting elements such as a screen burn can be taken.

The present application contains subject matter related to that disclosed in Japanese Priority Patent Application JP 2009-115192 filed in the Japan Patent Office on May 12, 2009 and Japanese Priority Patent Application JP 2010-001879 filed in the Japan Patent Office on Jan. 7, 2010, the entire contents of which are hereby incorporated by reference.

While preferred embodiments of the present invention have been described using specific terms, such description is for illustrative purpose only, and it is to be understood that changes and variations may be made without departing from the spirit or scope of the following claims.

What is claimed is:

1. A display apparatus, comprising:

a plurality of pixel circuits disposed forming a matrix at intersections of a plurality of signal lines and a plurality of scanning lines, respective ones of the plurality of pixel circuits including a light emitting element;

a light emission driving section adapted to apply a signal value to respective ones of the pixel circuits to cause the pixel circuit to emit light of a luminance corresponding to the signal value; and a light detection section including a light detection element, and a detection signal outputting circuit for outputting light detection information from the light detection element, the light detection section switching the light detection element between an on state and an off state and detecting light emitted from the light emitting element of the pixel circuit when the light detection element is in the off state;

wherein the light detection element is connected between a power supply line and a control terminal of the detection signal outputting circuit, wherein current flowing between current terminals of the light detection element varies in accordance with a potential at the control terminal, wherein a first potential is supplied to the power supply line and to a current terminal of the light detection element, and wherein a second potential is supplied during a detection period within which the light detection element is placed in a second state, to the power supply line while the potential at the control terminal approaches the second potential in response to light of the light emitting element.

2. The display apparatus according to claim 1, wherein the detection signal outputting circuit includes a detection signal outputting transistor for outputting the light detection information, the light detection information corresponding to a variation amount of current of the light detection element in the off state.

3. The display apparatus according to claim 2, wherein the detection signal outputting circuit supplies a predetermined reference potential to a gate node of the detection signal outputting transistor by switching of the light detection element into an on state, and supplies, when the light detection element is in the off state, current in accordance with reception of light from the light emitting element to the gate node of the detection signal outputting transistor to vary a gate potential of the detection signal outputting transistor such that the detection signal outputting transistor outputs light detection information in accordance with the variation of the gate potential.

4. The display apparatus according to claim 3, wherein the power supply line for switchably supplying a predetermined operation power supply potential and a reference potential is connected to the detection signal outputting circuit, the light detection element and the detection signal outputting transistor are connected to the power supply line, the reference potential is supplied to the gate node of the detection signal outputting transistor when the light detection element is placed into the on state when the power supply line supplies the reference potential, and when the light detection element is placed into the off state and the power supply line supplies the operation power supply potential, current generated by the light detection element upon reception of light from the light emitting element is supplied to the gate node of the detection signal outputting transistor to vary the gate potential of the detection signal outputting transistor such that the detection signal outputting transistor outputs light detection information in accordance with the variation of the gate potential.

5. The display apparatus according to claim 4, wherein the detection signal outputting circuit further comprises a switching transistor for connecting an output terminal of the detection signal outputting transistor to a light detection line, and the detection signal outputting transistor outputs the light detection information to the light detection line within a period within which the switching transistor is in the on state.

6. The display apparatus according to claim 2, wherein the detection signal outputting circuit is configured such that:

the detection signal outputting transistor is connected to a first power supply;

a first capacitor is connected between a control terminal of the detection signal outputting transistor and a second power supply;

the light detection element is a sensor-switch serving element connected between the control terminal of the detection signal outputting transistor and a third power supply;

a second capacitor is connected between a control terminal of the sensor-switch serving element and the control terminal;

a voltage of the third power supply is supplied to the control terminal of the detection signal outputting transistor when the sensor-switch serving element is in an on state; and when the sensor-switch serving element is in the off state, current generated in response to reception of light from the light emitting element is supplied to the gate node of the detection signal outputting transistor to vary the gate potential of the detection signal outputting transistor such that the detection signal outputting transistor outputs light detection information in accordance with the variation of the gate potential.

7. The display apparatus according to claim 6, wherein the detection signal outputting circuit further includes a switching transistor for connecting a detection signal outputting terminal of the detection signal outputting transistor to a light detection line, and within a period within which the switching transistor is placed in the on state, the detection signal outputting transistor outputs the light detection information to the light detection line.

8. The display apparatus according to claim 7, wherein a period within which the sensor-switch serving element is in placed in the on state and a period within which the switching transistor is placed in the on state are different from each other and do not overlap with each other in time.

9. The display apparatus according to claim 6, wherein, when the sensor-switch serving element is in the off state, a potential difference is generated between the source and the drain of a transistor as the sensor-switch serving element through the second capacitor.

10. The display apparatus according to claim 6, wherein the first power supply and the third power supply are formed as a fixed reference potential, and when the sensor-switch serving element is placed into the on state, the reference potential is supplied to the gate node of the detection signal outputting transistor.

11. The display apparatus according to claim 6, wherein the first, second and third power supplies are determined as the same fixed reference potential, and when the sensor-switch serving element is placed into the on state, the reference potential is supplied to the gate node of the detection signal outputting transistor.

12. The display apparatus according to claim 1, wherein the light detection section corresponds to the respective ones of the plurality of pixel circuits and is configured such that a channel film thickness or a transistor size of a transistor which forms the sensor-switch serving element is set in response to a wavelength of light emitted by the respective ones of the plurality of pixel circuits.

13. The display apparatus according to claim 1, further comprising a correction information production section adapted to supply the light detection information outputted from the light detection section as information for correction of the signal value to the light emission driving section.

14. The display apparatus according to claim 1, wherein the light detection section carries out a light detection operation before normal image display is started or after normal image display is ended by the respective ones of the plurality of pixel circuits.

15. The display apparatus according to claim 1, wherein the light detection section carries out a light detection operation within an intermittent period within a normal image displaying period.

16. The display apparatus according to claim 1, wherein a plurality of such light detection sections are provided and are individually driven and controlled so as to output the light detection information at the same time or in an overlapping relationship with each other in time.

17. A light detection method for a display apparatus which includes a pixel circuit having a light emitting element and a light detection section for detecting light from the light emitting element of the pixel circuit and outputting light detection information, the light detection section comprising a sensor-switch serving element, comprising:

outputting light detection information corresponding to a variation amount of current flowing to the sensor-switch serving element, the sensor-switch element having a gate directly connected to a control line and a control signal supplied from the control line to the sensor-switch element to switch between an on state and an off state, detecting light from the light emitting element of the pixel circuit when the sensor-switch serving element is in the off state, connecting the light detection element between a power supply line and a control terminal of a detection signal outputting circuit, varying current flowing between current terminals of the detection signal outputting circuit in accordance with a potential at the control terminal, supplying a first potential to the power supply line and to the control terminal, and supplying a second potential during a detection period within which the light detection element is placed in a second state, to the power supply line while the potential at the control terminal approaches the second potential in response to light of the light emitting element.

18. An electronic apparatus comprising the display device according to claim 1.

19. A display apparatus, comprising:

a pixel circuit including a light emitting element; and a light detection section including a light detecting transistor, a detection signal outputting transistor and a power supply line;

the light detecting transistor being connected between the power supply line and the gate of the detection signal outputting transistor;

the detection signal outputting transistor varying current to flow between the drain and the source in accordance with a potential to the gate;

a first potential being supplied to the power supply line and also to the gate of the detection signal outputting transistor but through the light detecting transistor; and a second potential being supplied, within a detection period within which the light detecting transistor is placed in a second state, to the power supply line while a gate potential of the detection signal outputting transistor varies toward the second potential in response to light of the light emitting element.

20. A display apparatus, comprising:

a pixel circuit including a light emitting element; and a light detection section including a light detecting transistor, a detection signal outputting transistor, a power supply line and a capacitance element;

the light detecting transistor being connected between the power supply line and the gate of the detection signal outputting transistor;

the detection signal outputting transistor varying current to flow between the drain and the source in accordance with a potential to the gate;

the capacitance element being connected between the gate of the light detecting transistor and the gate of the detection signal outputting transistor;

a predetermined potential being supplied to the power supply line;

the predetermined potential being supplied to the gate of the detection signal outputting transistor through the light detecting transistor within a detection preparation period within which the light detecting transistor is placed in a first state;

a gate potential of the detection signal outputting transistor being varied by changeover of the light detecting transistor from the first state to a second state; and the gate potential of the detection signal outputting transistor being varied toward the predetermined potential in response to light of the light emitting element within a detection period within which the light detecting transistor is placed in the second state.

* * * * *